US008530123B2

(12) United States Patent
Fujiwara et al.

(10) Patent No.: US 8,530,123 B2
(45) Date of Patent: Sep. 10, 2013

(54) ELECTROPHOTOGRAPHIC PHOTORECEPTOR, ELECTROPHOTOGRAPHIC PHOTORECEPTOR CARTRIDGE, AND IMAGE-FORMING APPARATUS

(75) Inventors: Kumiko Fujiwara, Niigata (JP); Teruyuki Mitsumori, Tokyo (JP); Hiroaki Fujiwara, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 718 days.

(21) Appl. No.: 12/666,651

(22) PCT Filed: Jun. 27, 2008

(86) PCT No.: PCT/JP2008/061727

§ 371 (c)(1),
(2), (4) Date: Apr. 9, 2010

(87) PCT Pub. No.: WO2009/001925

PCT Pub. Date: Dec. 31, 2008

(65) Prior Publication Data

US 2010/0330474 A1 Dec. 30, 2010

(30) Foreign Application Priority Data

Jun. 28, 2007 (JP) ..... 2007-171305

(51) Int. Cl.
*G03G 5/00* (2006.01)

(52) U.S. Cl.
USPC ..... 430/56; 399/159

(58) Field of Classification Search
USPC ..... 430/56; 399/159
See application file for complete search history.

(56) References Cited

U.S. PATENT DOCUMENTS

| | | | |
|---|---|---|---|
| 6,405,005 | B1 | 6/2002 | Kitamura et al. |
| 2003/0215726 | A1 | 11/2003 | Sugino et al. |
| 2010/0028791 | A1 | 2/2010 | Takaki et al. |

FOREIGN PATENT DOCUMENTS

| | | | |
|---|---|---|---|
| CN | 101438211 | A | 5/2009 |
| JP | 61-258258 | | 11/1986 |
| JP | 3-1149 | | 1/1991 |
| JP | 6-75403 | A | 3/1994 |
| JP | 07-056369 | | 3/1995 |
| JP | 8-62921 | | 3/1996 |
| JP | 09-265198 | | 10/1997 |
| JP | 11-202535 | | 7/1999 |
| JP | 2000-19753 | | 1/2000 |
| JP | 2000-19753 | A | 1/2000 |
| JP | 2001-272802 | A | 10/2001 |
| JP | 2003-29459 | | 1/2003 |
| JP | 2003-29459 | A | 1/2003 |
| JP | 2003-262965 | | 9/2003 |
| JP | 2004-37516 | A | 2/2004 |
| JP | 2006-036647 | | 2/2006 |
| JP | 2006-089401 | | 4/2006 |
| JP | 2007-279446 | | 10/2007 |

OTHER PUBLICATIONS

Chinese Office Action issued Aug. 18, 2011, in Patent Application No. 200880020557.4 (with English-language translation).
Chinese Office Action issued Apr. 18, 2012 in patent application No. 200880020557.4 with English translation.
Japanese Office Action Issued Jul. 3, 2012 in Patent Application No. 2007-171305 (with English translation).

*Primary Examiner* — Mark A Chapman
(74) *Attorney, Agent, or Firm* — Oblon, Spivak, McClelland, Maier & Neustadt, L.L.P.

(57) ABSTRACT

The invention provides an electrophotographic photoreceptor for use in an image-forming apparatus comprising a charging unit which charges an electrophotographic photoreceptor, an exposure unit which exposes the charged electrophotographic photoreceptor to light to form an electrostatic latent image on the electrophotographic photoreceptor, and a developing unit which develops the electrostatic latent image, wherein the electrophotographic photoreceptor comprises a conductive substrate and a photosensitive layer and the photosensitive layer contains a compound represented by the following formula (1).

15 Claims, 1 Drawing Sheet

[Fig. 1]
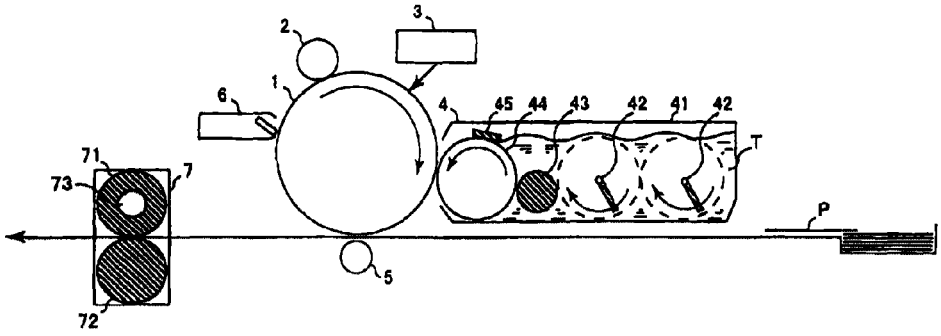
[Fig. 2]
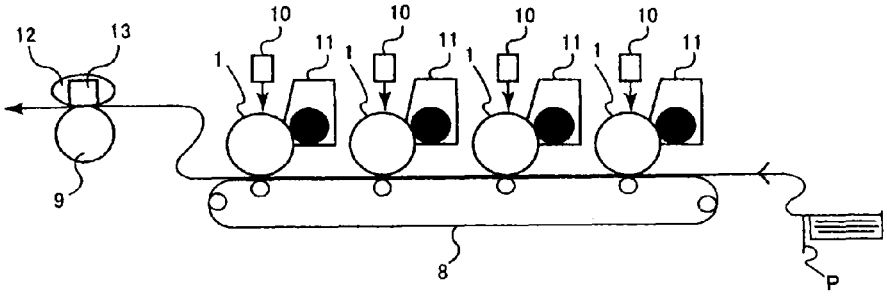

ELECTROPHOTOGRAPHIC PHOTORECEPTOR, ELECTROPHOTOGRAPHIC PHOTORECEPTOR CARTRIDGE, AND IMAGE-FORMING APPARATUS

TECHNICAL FIELD

The present invention relates to electrophotographic photoreceptor and an electrophotographic photoreceptor cartridge each for use in copiers, printers, and the like and to image-forming apparatus.

BACKGROUND ART

Electrophotography, which was invented by C. F. Carlson, has advantages such as instantaneousness and the ability to give high-quality images having high storability. Because of this, electrophotography is extensively used not only in the field of copiers but in the field of various printers and facsimile. Recently, electrophotography has come to be extensively used also in digital multifunction appliances. Applications thereof are spreading widely. With respect to photoreceptors serving as the core of electrophotography, use is being mainly made of photoreceptors employing an organic photoconductive material which has advantages such as non-polluting properties, ease of film formation, and ease of production. Of these, the so-called multilayer type photoreceptor having superposed layers including a charge-generating layer and a charge-transporting layer has the following advantages. It can be obtained as a higher-sensitivity photoreceptor. There is a wide choice of materials, and a highly safe photoreceptor is hence obtained. Furthermore, the coating operations contribute to high productivity and are relatively advantageous in cost. Because of these advantages, photoreceptors of the multilayer type are mainly used at present and are being produced in large quantities.

On the other hand, digitization for image formation is proceeding rapidly in order to obtain images of higher quality or to store input images or edit the images at will. So far, the apparatus which digitally form images have been limited to the laser printers or LED printers as output apparatus for word processors or personal computers and to some kinds of color laser copiers, etc. Recently, however, digitization has been almost completely achieved also in the field of common copiers, in which image formation in an analogue manner was mainly used hitherto.

In the case of conducting such digital image formation, a laser light or an LED light is mainly used as a light source for optical digital-signal input to a photoreceptor. Light sources for optical input which are presently in wide use emit near infrared light having a wavelength of 780 nm or 660 nm or a light having a long wavelength close to these. In recent years, blue lasers have been put to practical use, and a light having a short wavelength of 400-500 nm has become usable as a light source for optical input. Photoreceptors for use in digital image formation are required to have effective sensitivity to such various light sources for optical input, and a wide variety of materials have hitherto been investigated. Besides being high in sensitivity, the photoreceptors are required to have basic properties such as sufficient electrification characteristics, reduced dark decay after charging, low residual potential, and satisfactory stability of these properties during repetitions of use.

Especially in repetitions of use in copiers or printers, there is a problem that the photosensitive layer deteriorates gradually. There is hence a desire for the property of being less damaged by repetitions of use and for stable electrical characteristics. These properties greatly depend on the charge-generating substance, charge-transporting substance, additives, and binder resins. As the charge-generating substance, phthalocyanine pigments and azo pigments are mainly used because of the necessity of having sensitivity to light sources for optical input. As the charge-transporting substance, various kinds of substances are known. Of these, amine compounds are extensively utilized because they have an exceedingly low residual potential (see, for example, patent document 1 and patent document 2). As the additives, various ones are known. Well known of these are ones having the effect of enhancing ozone resistance (see, for example, patent document 3 and patent document 4). Furthermore, with respect to binder resins for use in photosensitive layers, in particular, charge-transporting layers, polycarbonate resins and polyarylate resins are advantageously used (see, for example, patent document 5).

Patent Document 1: JP-A-2000-075517
Patent Document 2: JP-A-2002-040688
Patent Document 3: Japanese Patent No. 2644278
Patent Document 4: JP-A-9-265194
Patent Document 5: JP-A-2000-075517

DISCLOSURE OF THE INVENTION

Problems that the Invention is to Solve

With the recent trend toward higher speeds at which electrophotographic photoreceptors are used, the electrophotographic photoreceptors are coming to be required to have higher sensitivity. It is also necessary that an electrophotographic photoreceptor suitable for conditions for various devices such as a charging device, light source for optical input, and developing device should be precisely designed each time. There are cases where even when a photoreceptor produced so as to have required properties can initially form satisfactory images, this photoreceptor deteriorates in image formation during long-term repetitions of use. It has been necessary to conduct considerable investigations in order to obtain a suitable photoreceptor.

An object of the invention, which has been achieved in view of the problems described above, is to provide an electrophotographic photoreceptor which has excellent electrical characteristics (in particular, has preferred electrical characteristics even when a light having a wavelength in a wide range of from a short wavelength to a long wavelength is used as a light source for optical input) and which can stably form satisfactory images having high resolution and high quality even when repeatedly used over long. Another object is to provide an electrophotographic photoreceptor cartridge and an image-forming apparatus each employing the electrophotographic photoreceptor.

Means for Solving the Problems

The present inventors diligently made investigations in order to overcome the problems described above. As a result, it has been found that an electrophotographic photoreceptor which has preferred electrical characteristics and can form satisfactory images even when repeatedly used over long can be obtained by incorporating an ester compound having a specific structure into a photosensitive layer. The invention has been thus completed.

[1] An electrophotographic photoreceptor for use in an image-forming apparatus comprising: a charging unit which charges an electrophotographic photoreceptor; an exposure unit which exposes the charged electrophotographic photoreceptor to light to form an electrostatic latent image on the electrophotographic photoreceptor; and a developing unit which develops the electrostatic latent image, wherein the electrophotographic photoreceptor includes a conductive substrate and a photosensitive layer, the photosensitive layer contains a compound represented by the following formula (1), and the exposure unit has an LED (first mode of the invention).

[Ka-1]

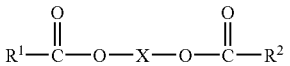

(1)

[In formula (1), $R^1$ and $R^2$ each independently represent an organic group having 30 carbon atoms or less and X represents a saturated hydrocarbon group having 3-30 carbon atoms.]

[2] An electrophotographic photoreceptor for use in an image-forming apparatus comprising: a charging unit which charges an electrophotographic photoreceptor; an exposure unit which exposes the charged electrophotographic photoreceptor to light to form an electrostatic latent image on the electrophotographic photoreceptor; and a developing unit which develops the electrostatic latent image, wherein the electrophotographic photoreceptor includes a conductive substrate and a photosensitive layer, the photosensitive layer contains a compound represented by the following formula (1), and the electrostatic latent image has a resolution of 1,200 dpi or higher (second mode of the invention).

[Ka-2]

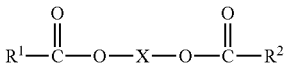

(1)

[In formula (1), $R^1$ and $R^2$ each independently represent an organic group having 30 carbon atoms or less and X represents a saturated hydrocarbon group having 3-30 carbon atoms.]

[3] An electrophotographic photoreceptor for use in an image-forming apparatus comprising: a charging unit which charges an electrophotographic photoreceptor; an exposure unit which exposes the charged electrophotographic photoreceptor to light to form an electrostatic latent image on the electrophotographic photoreceptor; and a developing unit which develops the electrostatic latent image with a toner, wherein the electrophotographic photoreceptor includes a conductive substrate and a photosensitive layer, the photosensitive layer contains a compound represented by the following formula (1), and the toner has an average degree of circularity as determined with a flow type particle image analyzer of 0.94-1.00 (third mode of the invention).

[Ka-3]

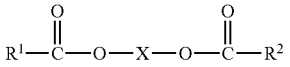

(1)

[In formula (1), $R^1$ and $R^2$ each independently represent an organic group having 30 carbon atoms or less and X represents a saturated hydrocarbon group having 3-30 carbon atoms.]

[4] An electrophotographic photoreceptor for use in a full-color tandem image-forming apparatus comprising: a charging unit which charges an electrophotographic photoreceptor; an exposure unit which exposes the charged electrophotographic photoreceptor to light to form an electrostatic latent image on the electrophotographic photoreceptor; and a developing unit which develops the electrostatic latent image, wherein the electrophotographic photoreceptor includes a conductive substrate and a photosensitive layer and the photosensitive layer contains a compound represented by the following formula (1) (fourth mode of the invention).

[Ka-4]

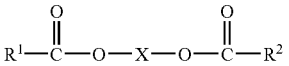

(1)

[In formula (1), $R^1$ and $R^2$ each independently represent an organic group having 30 carbon atoms or less and X represents a saturated hydrocarbon group having 3-30 carbon atoms.]

[5] An image-forming apparatus comprising: a charging unit which charges an electrophotographic photoreceptor having a photosensitive layer; an exposure unit which exposes the charged electrophotographic photoreceptor to light to form an electrostatic latent image on the electrophotographic photoreceptor; and a developing unit which develops the electrostatic latent image, wherein the photosensitive layer contains a compound represented by the following formula (1) and the exposure unit has an LED.

[Ka-5]

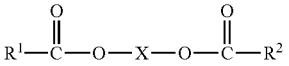

(1)

[In formula (1), $R^1$ and $R^2$ each independently represent an organic group having 30 carbon atoms or less and X represents a saturated hydrocarbon group having 3-30 carbon atoms.]

[6] An image-forming apparatus comprising: a charging unit which charges an electrophotographic photoreceptor having a photosensitive layer; an exposure unit which exposes the charged electrophotographic photoreceptor to light to form an electrostatic latent image on the electrophotographic photoreceptor; and a developing unit which develops the electrostatic latent image, wherein the photosensitive layer contains a compound represented by the following formula (1) and the electrostatic latent image has a resolution of 1,200 dpi or higher.

[Ka-6]

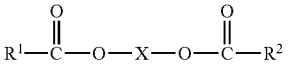

(1)

[In formula (1), $R^1$ and $R^2$ each independently represent an organic group having 30 carbon atoms or less and X represents a saturated hydrocarbon group having 3-30 carbon atoms.]

[7] An image-forming apparatus comprising: a charging unit which charges an electrophotographic photoreceptor having a photosensitive layer; an exposure unit which exposes the charged electrophotographic photoreceptor to light to form an electrostatic latent image on the electrophotographic photoreceptor; and a developing unit which develops the electrostatic latent image with a toner, wherein the photosensitive layer contains a compound represented by the following formula (1) and the toner has an average degree of circularity as determined with a flow type particle image analyzer of 0.94-1.00.

[Ka-7]

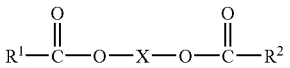

(1)

[In formula (1), $R^1$ and $R^2$ each independently represent an organic group having 30 carbon atoms or less and X represents a saturated hydrocarbon group having 3-30 carbon atoms.]

[8] An image-forming apparatus which is a full-color tandem image-forming apparatus comprising: a charging unit which charges an electrophotographic photoreceptor having a photosensitive layer; an exposure unit which exposes the charged electrophotographic photoreceptor to light to form an electrostatic latent image on the electrophotographic photoreceptor; and a developing unit which develops the electrostatic latent image, wherein the photosensitive layer contains a compound represented by the following formula (1).

[Ka-8]

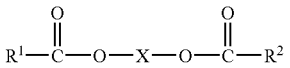

(1)

[In formula (1), $R^1$ and $R^2$ each independently represent an organic group having 30 carbon atoms or less and X represents a saturated hydrocarbon group having 3-30 carbon atoms.]

[9] The electrophotographic photoreceptor according to any one of [1] to [4] above wherein at least one of $R^1$, $R^2$, and X in formula (1) has a cyclic structure.

[10] The electrophotographic photoreceptor according to any one of [1] to [4] above wherein the photosensitive layer contains a compound having a hydrazone structure.

[11] The electrophotographic photoreceptor according to any one of [1] to [4] above wherein the photosensitive layer contains a compound having a diamine structure.

[12] The electrophotographic photoreceptor according to any one of [1] to [4] above, which comprises a polyamide resin.

[13] The electrophotographic photoreceptor according to any one of [1] to [4] above wherein the photosensitive layer contains a polyarylate resin.

[14] The electrophotographic photoreceptor according to any one of [1] to [4] above wherein the photosensitive layer contains a binder resin having a repeating structure represented by the following formula (2):

[Ka-9]

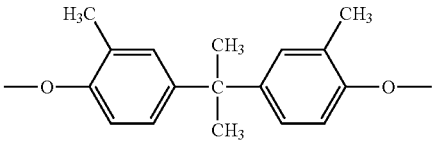

(2)

[15] An electrophotographic photoreceptor cartridge comprising: the electrophotographic photoreceptor according to any one of [1] to [4] above; and at least one selected from a charging unit which charges the electrophotographic photoreceptor, an exposure unit which exposes the charged electrophotographic photoreceptor to light to form an electrostatic latent image on the electrophotographic photoreceptor, a developing unit which develops the electrostatic latent image, and a cleaning unit which cleans the surface of the electrophotographic photoreceptor.

Advantages of the Invention

According to the invention, an electrophotographic photoreceptor having a photosensitive layer containing a specific compound is used in an image-forming apparatus satisfying a specific requirement. Thus, an electrophotographic photoreceptor can be provided which has high sensitivity in a wide wavelength range and can stably form high-resolution high-quality images even when repeatedly used over long. Furthermore, by using the electrophotographic photoreceptor or by using an electrophotographic photoreceptor cartridge employing the electrophotographic photoreceptor, an image-forming apparatus can be provided in which suitable exposure is possible with various light sources for optical input and which can stably form high-resolution high-quality images even when repeatedly used over long.

BRIEF DESCRIPTION OF THE DRAWINGS

FIG. 1 is a diagrammatic view illustrating the constitution of important units of one embodiment of the image-forming apparatus of the invention.

FIG. 2 is a diagrammatic view illustrating one example of a full-color tandem image-forming apparatus of the belt-conveyance direct-transfer type employing a photoreceptor of the invention.

BRIEF DESCRIPTION OF THE REFERENCE NUMERALS AND SINGS

1 electrophotographic photoreceptor
2 charging device (charging roller)
3 exposure device
4 developing device
5 transfer device
6 cleaner
7 fixing device
8 conveying belt
9 pressure roller
10 LED exposure device
11 toner cartridge
12 fixing belt
13 heat source
41 developing chamber
42 agitator
43 feed roller

44 developing roller
45 control member
71 upper fixing member (fixing roller)
72 lower fixing member (fixing roller)
73 heater
T toner
P recording paper

BEST MODE FOR CARRYING OUT THE INVENTION

Embodiments of the invention will be explained below. However, the invention should not be construed as being limited to the following explanations, and various modifications of the invention can be made without departing from the spirit of the invention.

[Electrophotographic Photoreceptors]

The electrophotographic photoreceptors of the invention are not particularly limited in the details of their constitutions so long as the photoreceptors include a conductive substrate and, formed thereover, a photosensitive layer containing a compound represented by the following formula (1) according to the invention. Typical constitutions are explained below.

<Photosensitive Layer>

The photosensitive layer is formed over a conductive substrate. Incidentally, when the undercoat layer which will be described later has been formed, the photosensitive layer is formed on the undercoat layer. This case also is included in the meaning of the term "formed over a conductive substrate". Examples of the type of the photosensitive layer include: ones having a single-layer structure in which a charge-generating substance and a charge-transporting substance are present in the same layer and have been dispersed in a binder resin (hereinafter often abbreviated to "single-layer type photosensitive layer"); and ones having a multilayer structure composed of two or more layers including a charge-generating layer containing a charge-generating substance dispersed in a binder resin and a charge-transporting layer containing a charge-transporting substance dispersed in a binder resin (hereinafter often abbreviated to "multilayer type photosensitive layer"). The photosensitive layer according to the invention may be of either of these types. Examples of the multilayer type photosensitive layer include: a normal superposition type multilayered photosensitive layer formed by superposing a charge-generating layer and a charge-transporting layer in this order from the conductive-substrate side; and a reverse superposition type multilayered photosensitive layer formed by superposing in the reverse order, i.e., in the order of a charge-transporting layer and a charge-generating layer. However, the multilayer type can have any desired constitution.

The photosensitive layer in the invention contains a compound represented by the following formula (1).

[Ka-10]

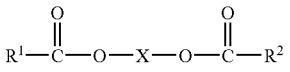

(1)

[In formula (1), $R^1$ and $R^2$ each represent an organic group having 30 carbon atoms or less and X represents a saturated hydrocarbon group having 3-30 carbon atoms.]

Although the compound represented by formula (1) in the invention is contained in the photosensitive layer, it is preferred that the compound should be contained in a layer containing a charge-transporting substance. The compound represented by formula (1) in the invention is used in an amount of preferably from 0.001 part by mass to 30 parts by mass per 100 parts by mass of a binder. The amount thereof is more preferably 0.01 part by mass or larger, and is especially preferably 0.1 part by mass or larger from the standpoint of electrical characteristics. On the other hand, too large amounts of the compound may reduce the effects of the charge-transporting agent or charge-generating agent. The amount of that compound is hence preferably 20 parts by mass or smaller, especially preferably 10 parts by mass or smaller.

In the case where the photosensitive layer is constituted of two or more layers, a compound represented by formula (1) in the invention may be contained in any of these layers or different compounds may be contained respectively in different layers. It is, however, preferred that a compound represented by formula (1) should be contained in a layer required to have the function of transporting charges. Especially preferred is a multilayer type photosensitive layer in which a compound represented by formula (1) is contained in the charge-transporting layer.

$R^1$ and $R^2$ in general formula (1) each independently represent an organic group having 30 carbon atoms or less. The number of carbon atoms therein is preferably 20 or smaller, more preferably 15 or smaller, especially preferably 10 or smaller. $R^1$ and $R^2$ in formula (1) may contain a cyclic structure, and preferably are a hydrocarbon group which may have one or more substituents. More preferably, $R^1$ and $R^2$ are an aryl group which may have one or more substituents or an alkyl group which may have one or more substituents.

Examples of the aryl group in $R^1$ and $R^2$ in formula (1) include phenyl, naphthyl, anthryl, pyrenyl, biphenylyl, and terphenylyl. Preferred are ones having three or less aromatic rings. Especially preferred is phenyl. Examples of the alkyl group in $R^1$ and $R^2$ in formula (1) include alkyl groups such as methyl, ethyl, propyl, isopropyl, pentyl, isopentyl, neopentyl, 1-methylbutyl, 1-methylheptyl, dodecyl, hexadecyl, and octadecyl. Preferred are ones having 10 carbon atoms or less. Especially preferred is methyl, ethyl, cyclohexyl, or propyl.

Examples of the substituents which may be possessed by $R^1$ and $R^2$ in formula (1) include alkyl groups such as methyl, ethyl, propyl, isopropyl, pentyl, isopentyl, neopentyl, 1-methylbutyl, 1-methylheptyl, dodecyl, hexadecyl, and octadecyl; aryl groups such as phenyl, naphthyl, anthryl, and pyrenyl; aralkyl groups such as benzyl and phenethyl; alkoxy groups such as methoxy and ethoxy; hydroxy; nitro; and halogen atoms. Such substituents may further have substituents. Two substituents may be bonded to each other to form a ring or to form a fused ring. The substituents preferably are alkyl groups having 10 carbon atoms or less. More preferred is methyl. $R^1$ and $R^2$ each may independently have two or more substituents.

X represents a saturated hydrocarbon group having 3-30 carbon atoms. Specifically, X is a divalent group of a saturated hydrocarbon compound. Examples thereof include a divalent group of propane, divalent group of butane, divalent group of pentane, divalent group of hexane, divalent group of cyclohexane, divalent group of octane, divalent group of nonane, divalent group of decane, and divalent group of dodecane. Preferred are divalent groups having 20 carbon atoms or less. More preferred are divalent groups having 15 carbon atoms or less. Specifically, such preferred examples include a divalent group of butane, divalent group of octane, divalent group of dimethylcyclohexane, divalent group of bicycloheptane, divalent group of cyclohexane, and divalent group of spirooctane. Ones having a cyclic structure are preferred. Specifically, ones derived from compounds having a cyclohexane framework therein are preferred. Especially preferred is a divalent group of dimethylcyclohexane. Examples thereof include the following structures.

[Ka-11]

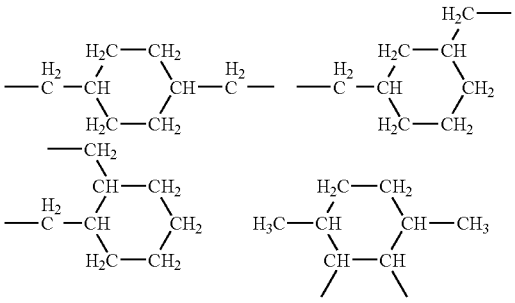

-continued

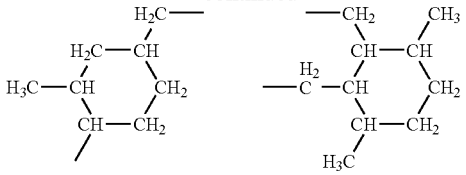

Examples of the structure of the compound represented by formula (1) in the invention are shown below. Hereinafter, the following compounds will be suitably referred to as "Exemplified Compound 1 to Exemplified Compound 37". The following compounds are intended as examples for explaining the invention in detail, and that compound should not be construed as being limited to the following structures unless this is counter to the spirit of the invention.

(1)

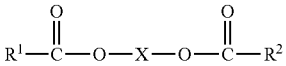

| | $R^1$ | X | $R^2$ |
|---|---|---|---|
| 1 | 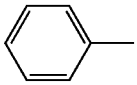 | 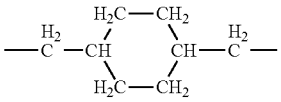 | 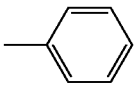 |
| 2 | 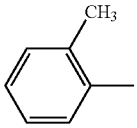 | 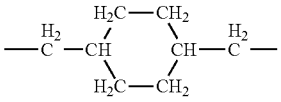 | 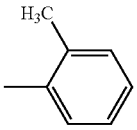 |
| 3 | 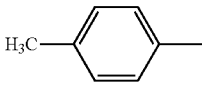 | 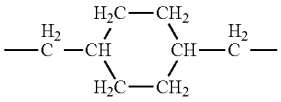 | 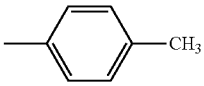 |
| 4 | 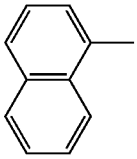 | 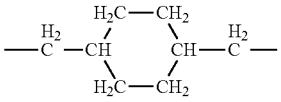 | 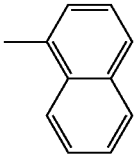 |
| 5 | 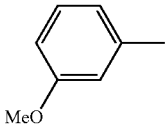 | 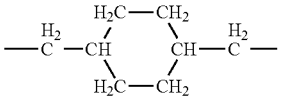 | 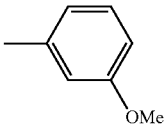 |
| 6 | 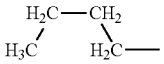 | 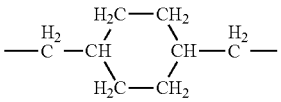 | 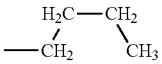 |
| 7 | $H_3C$— | 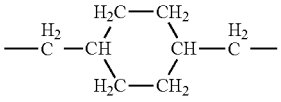 | —$CH_3$ |

-continued
(1)
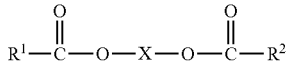
| | $R^1$ | X | $R^2$ |
|---|---|---|---|
| 8 | 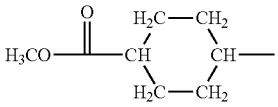 | 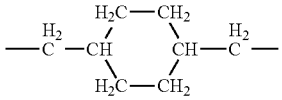 | 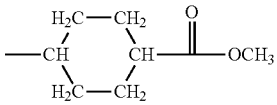 |
| 9 | 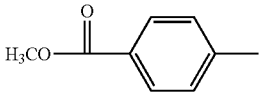 | 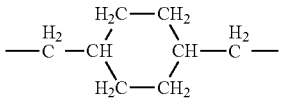 | 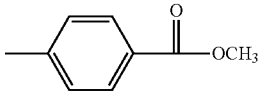 |
| 10 | 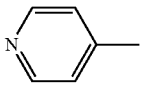 | 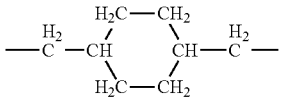 | 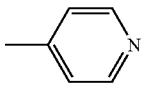 |
| 11 | 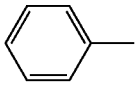 | 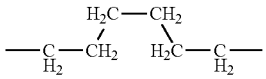 | 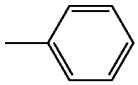 |
| 12 | 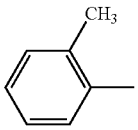 | 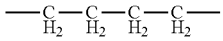 | 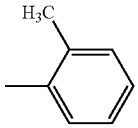 |
| 13 | 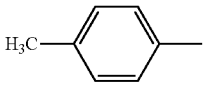 | 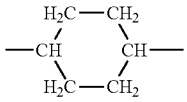 | 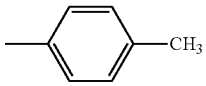 |
| 14 | 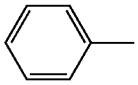 | 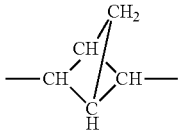 | 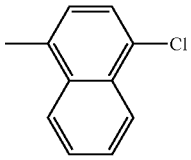 |
| 15 | 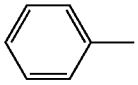 | 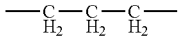 | 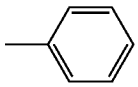 |
| 16 | 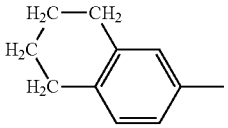 | 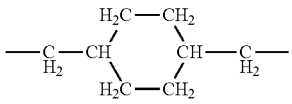 | 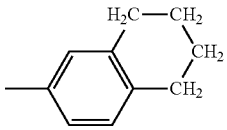 |
| 17 | $H_3C$— | 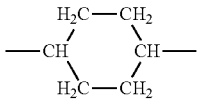 | —$CH_3$ |
| 18 | 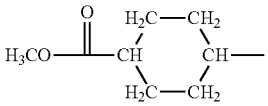 | 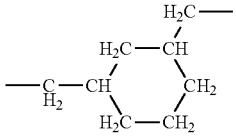 | 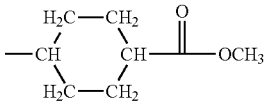 |

-continued
(1)
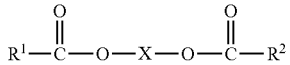
| | $R^1$ | X | $R^2$ |
|---|---|---|---|
| 19 | 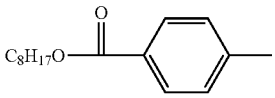 | 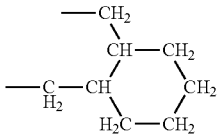 | 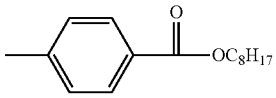 |
| 20 | 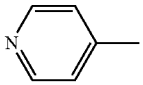 | 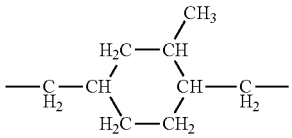 | 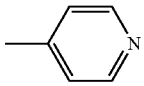 |
| 21 | 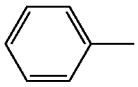 | 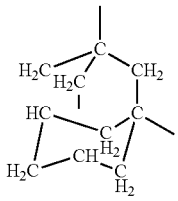 | 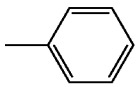 |
| 22 | 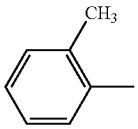 | 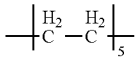 | 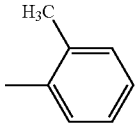 |
| 23 | 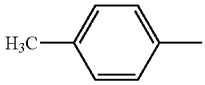 | 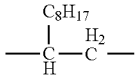 | 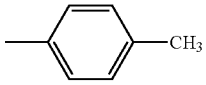 |
| 24 | 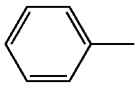 | 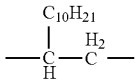 | 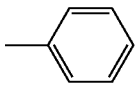 |
| 25 | 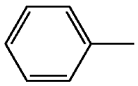 | 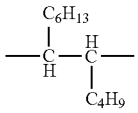 | 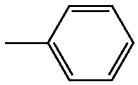 |
| 26 | 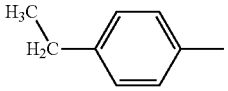 | 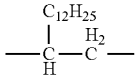 | 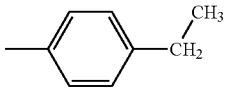 |
| 27 | 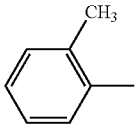 | 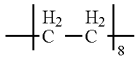 | 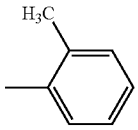 |
| 28 | 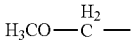 | 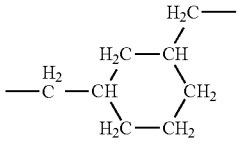 | 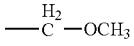 |

-continued (1)

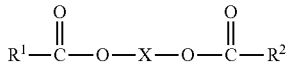

| | $R^1$ | X | $R^2$ |
|---|---|---|---|
| 29 | 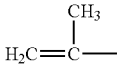 | 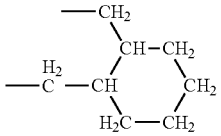 | 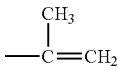 |
| 30 | 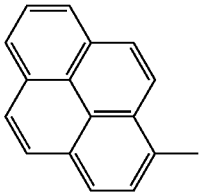 | 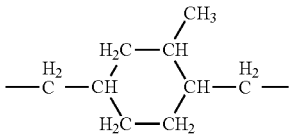 | 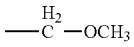 |
| 31 | 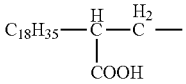 | 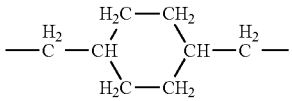 | 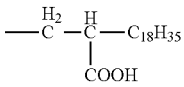 |
| 32 | 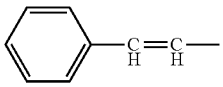 | 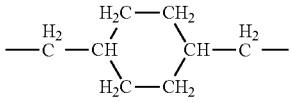 | 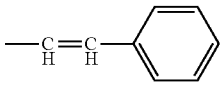 |
| 33 | 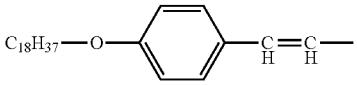 | 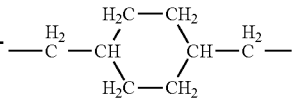 | 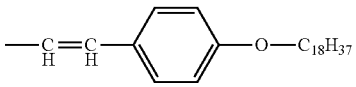 |
| 34 | 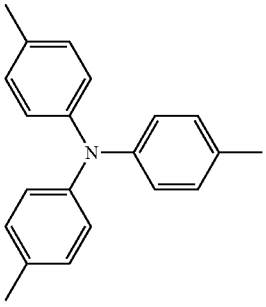 | 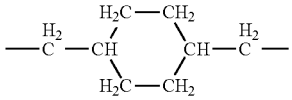 | 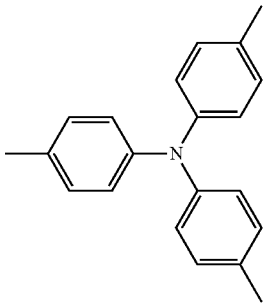 |
| 35 | 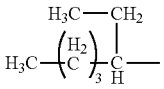 | 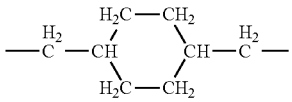 | 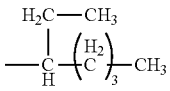 |
| 36 | 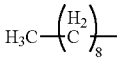 | 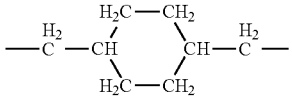 | 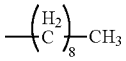 |
| 37 | 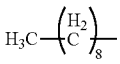 | 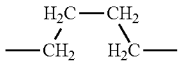 | 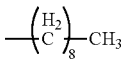 |

<Conductive Substrate>

As the conductive substrate for the electrophotographic photoreceptors of the invention, use may be made mainly of, for example, a metallic material such as aluminum, an aluminum alloy, stainless steel, copper, or nickel, a resinous material to which conductivity has been imparted by adding a conductive powder such as a metal, carbon, or tin oxide, or a resin, glass, paper, or the like which has a surface coated with a conductive material such as aluminum, nickel, or ITO (indium oxide/tin oxide) by vapor deposition or coating fluid application. With respect to shape, a substrate in a drum, sheet, belt, or another shape may be used. Use may also be made of a conductive substrate which is made of a metallic material and which has been coated with a conductive material having an appropriate resistance value for the purpose of regulating conductivity, surface properties, etc. or of covering defects.

In the case where a metallic material such as, e.g., an aluminum alloy is employed as the conductive substrate, it may be used after having been coated with an anodic oxide film. It is desirable that when coating with an anodic oxide film is conducted, the substrate be then subjected to a pore-filling treatment by a known method. For example, an anodic oxide coating film is formed by conducting an anodization treatment in an acid bath containing chromic acid, sulfuric acid, oxalic acid, boric acid, sulfamic acid, or the like. However, an anodization treatment in sulfuric acid gives better results. In the case of anodization in sulfuric acid, it is preferred to set conditions in the following ranges: a sulfuric acid concentration of 100-300 g/L, dissolved-aluminum concentration of 2-15 g/L, liquid temperature of 15-30° C., electrolysis voltage of 10-20 V, and current density of 0.5-2 A/dm$^2$. However, the conditions for the anodization should not be construed as being limited to those shown above.

It is preferred that the anodic oxide film thus formed should be subjected to a pore-filling treatment. The pore-filling treatment may be conducted by a known method. For example, it is preferred to conduct a low-temperature pore-filling treatment in which the substrate is immersed in an aqueous solution containing nickel fluoride as a main component or a high-temperature pore-filling treatment in which the substrate is immersed in an aqueous solution containing nickel acetate as a main component.

The aqueous nickel fluoride solution to be used in the case of the low-temperature pore-filling treatment can have a suitably selected concentration. However, better results are obtained when the solution having a concentration in the range of 3-6 g/L is used. From the standpoint of causing the pore-filling treatment to proceed smoothly, it is preferred to conduct the treatment at a treatment temperature of 25-40° C., preferably 30-35° C., and a pH of the aqueous nickel fluoride solution in the range of 4.5-6.5, preferably 5.5-6.0. As a pH regulator, use can be made of oxalic acid, boric acid, formic acid, acetic acid, sodium hydroxide, sodium acetate, ammonia water, or the like. With respect to treatment period, it is preferred to treat the substrate for a period of 1-3 minutes per micrometer of the coating film thickness. An ingredient such as cobalt fluoride, cobalt acetate, nickel sulfate, or a surfactant may be added to the aqueous nickel fluoride solution beforehand in order to further improve coating film properties. The substrate is subsequently washed with water and dried to complete the low-temperature pore-filling treatment.

As a pore-filling agent in the case of the high-temperature pore-filling treatment, use can be made of an aqueous solution of a metal salt such as nickel acetate, cobalt acetate, lead acetate, nickel cobalt acetate, or barium nitrate. However, it is especially preferred to use nickel acetate. In the case of using an aqueous solution of nickel acetate, the concentration thereof is preferably in the range of 5-20 g/L. It is preferred to conduct the treatment at a treatment temperature of 80-100° C., preferably 90-98° C., and a pH of the aqueous nickel acetate solution in the range of 5.0-6.0.

As a pH regulator for this treatment, use can be made of ammonia water, sodium acetate, or the like. With respect to treatment period, it is preferred to treat the substrate for 10 minutes or longer, preferably 20 minutes or longer. In this case also, sodium acetate, an organic carboxylic acid, an anionic or nonionic surfactant, or the like may be added to the aqueous nickel acetate solution in order to improve coating film properties. The substrate is subsequently washed with water and dried to complete the high-temperature pore-filling treatment. When the anodic oxide coating film has a large average thickness, this film necessitates intense pore-filling conditions, which may be attained with a higher concentration of the pore-filling solution or a higher-temperature longer-period treatment. Consequently, such treatment not only results in poor productivity but also is apt to cause surface defects such as spots, soils, or powdering on the surface of the coating film. From such standpoints, it is preferred to form an anodic oxide coating film having an average thickness of generally 20 μm or smaller, especially 7 μm or smaller.

The surface of the substrate may be smooth or may have been roughened by a special machining method or by conducting an abrading treatment. Alternatively, the substrate may be one whose surface has been roughened by incorporating particles having an appropriate particle diameter into the material constituting the substrate. From the standpoint of cost reduction, a drawn tube can be used as it is without being subjected to machining. In particular, use of an unmachined aluminum substrate obtained by drawing, impact drawing, squeezing, or the like is preferred because the processing eliminates any adherent substances present on the surface, such as soils and foreign substances, and small mars, etc. to give an even and clean substrate.

<Undercoat Layer>

As an undercoat layer may be used a layer made of a resin or of a resin containing particles of, e.g., a metal oxide dispersed therein. It is especially preferred to form an undercoat layer constituted of a binder resin and metal oxide particles dispersed therein. The proportion of the inorganic particles to the binder resin can be selected at will. However, from the standpoint of the stability and applicability of the dispersion, it is preferred to use the particles in an amount in the range of from 10% by mass to 500% by mass.

The thickness of the undercoat layer can be selected at will. However, it is preferably from 0.1 μm to 20 μm from the standpoints of electrophotographic photoreceptor characteristics and applicability. The undercoat layer may contain a known antioxidant or the like.

When this undercoat layer is dispersed in a solvent prepared by mixing methanol and 1-propanol in a ratio of 7:3 by mass and the resultant liquid is examined by the dynamic light-scattering method, then the volume-average particle diameter of the metal oxide particles in the liquid may be 0.1 μm or smaller and is preferably 95 nm or smaller, more preferably 90 nm or smaller. There is no particular lower limit on the volume-average particle diameter thereof. However, the volume-average particle diameter of the metal oxide particles is generally 20 nm or larger. When that range is satisfied, the electrophotographic photoreceptors of the invention have stable exposure-charging cycle characteristics in low-temperature low-humidity environments and can give images inhibited from having image defects such as black spots or color spots.

The metal oxide particles, when examined in the same manner, may have a 90% cumulative particle diameter as determined through cumulation from the smaller-particle-diameter side of 0.3 μm or smaller, preferably 0.2 μm or smaller, more preferably 0.15 μm or smaller. Some conventional electrophotographic photoreceptors have an undercoat layer containing metal oxide particles which are so large that they can extend from the front to the back side of the undercoat layer, and there have been cases where such large metal oxide particles are causative of defects in image formation. Furthermore, when a charging device of the contact type is employed, there have been cases where charge movement from the conductive substrate to the photosensitive layer through the metal oxide particles occurs during the charging of the photosensitive layer, making it impossible to properly conduct charging. However, by using metal oxide particles regulated so as to have a reduced 90% cumulative particle diameter, large metal oxide particles causative of defects as described above can be considerably diminished. As a result, the electrophotographic photoreceptors of the invention can be inhibited from causing defects and from becoming unable to be properly charged, and can form high-quality images.

It is preferred that the metal oxide particles in the undercoat layer should be present as primary particles. Usually, however, such cases are scarce. In most cases, the metal oxide particles have been aggregated and are present as secondary aggregate particles or as a mixture of the two forms. Consequently, what particle size distribution the metal oxide particles in the undercoat layer should have is exceedingly important. Although it is highly difficult to directly evaluate the particle size distribution of the metal oxide particles in an undercoat layer, the particle size distribution of the metal oxide particles in the undercoat layer can be determined by dispersing the undercoat layer in a specific solvent and evaluating the resultant dispersion.

With respect to the volume-average particle diameter and 90% cumulative particle diameter, as determined through cumulation from the smaller-particle-diameter side, of the metal oxide particles in a liquid obtained by dispersing the undercoat layer in a solvent prepared by mixing methanol and 1-propanol in a ratio of 7:3 by mass, use can be made of values determined by the dynamic light-scattering method regardless of the state in which the metal oxide particles are present.

The dynamic light-scattering method is a technique in which the speed of Brownian movement of particles which have been finely dispersed is determined by irradiating the particles with a laser light and detecting the scattering of lights differing in phase according to the speed (Doppler shift) to determine the particle size distribution. The value of the volume-average particle diameter of the metal oxide particles in an undercoat layer in the invention is a value for the metal oxide particles which are in the state of being stably dispersed in a solvent prepared by mixing methanol and 1-propanol in a ratio of 7:3 by mass, and does not mean the particle diameter of the metal oxide particles or other particles which are in the form of a powder before being dispersed. An actual examination is made with a particle size analyzer (MICROTRAC UPA model:9340-UPA, manufactured by Nikkiso Co., Ltd.; hereinafter abbreviated to UPA), which operates by the dynamic light-scattering method, under the following conditions. A specific examination operation is performed based on the instruction manual (Document No. T15-490A00, Revision No. E; made by Nikkiso Co., Ltd.) for the particle size analyzer.

Conditions for examination with the particle size analyzer operating by the dynamic light-scattering method are as follows.

Upper limit of measurement: 5.9978 μm
Lower limit of measurement: 0.0035 μm
Number of channels: 44
Examination period: 300 sec
Examination temperature: 25° C.
Particle transparency: absorption
Refractive index of particle: N/A (not applied)
Particle shape: non-spherical
Density: 4.20 (g/cm$^3$) (*)
Kind of dispersion medium: methanol/1-propanol mixed solvent (mass ratio: methanol/1-propanol=7/3)
Refractive index of the dispersion medium: 1.35

(*) The value of density is for titanium dioxide particles. In the case of other particulate materials, the numerical data given in the instruction manual are used.

In the case where the liquid obtained by dispersing the undercoat layer in a solvent prepared by mixing methanol and 1-propanol in a ratio of 7:3 by mass is too thick and has a concentration outside the measurable-concentration range for an examination apparatus, use is made of a method in which a coating fluid for undercoat layer formation is diluted with a methanol/1-propanol mixed solvent (methanol/1-propanol=7/3 (by mass); refractive index=1.35) to regulate the concentration so as to be in the measurable-concentration range. In the case of the UPA, for example, dilution with the methanol/1-propanol mixed solvent is conducted so as to result in a sample concentration index (signal level) of 0.6-0.8, which is suitable for the examination.

It is thought that even through such dilution, the particle diameters of the metal oxide particles in the liquid obtained by dispersing the undercoat layer do not change. Consequently, the volume-average particle diameter and 90% cumulative particle diameter determined through the dilution are regarded as the volume-average particle diameter and 90% cumulative particle diameter to be determined by examining a liquid obtained by dispersing the undercoat layer according to the invention in a solvent prepared by mixing methanol and 1-propanol in a ratio of 7:3 by mass.

As the metal oxide particles to be contained in the undercoat layer, any metal oxide particles usable in electrophotographic photoreceptors can be employed. Examples of the metal oxide constituting the metal oxide particles include metal oxides containing one metallic element, such as titanium oxide, aluminum oxide, silicon oxide, zirconium oxide, zinc oxide, and iron oxide; and metal oxides containing two or more metallic elements, such as calcium titanate, strontium titanate, and barium titanate. Preferred of these are metal oxide particles made of a metal oxide having a band gap of 2-4 eV. When metal oxide particles having too small a band gap are used, carrier injection from the conductive substrate is apt to occur. There are hence cases where image formation tends to result in the occurrence of defects such as black spots or color spots. When metal oxide particles having too large a band gap are used, there are cases where charge movement is inhibited by electron trapping, resulting in impaired electrical characteristics.

Preferred of those metal oxides constituting the metal oxide particles are titanium oxide, aluminum oxide, silicon oxide, and zinc oxide. More preferred are titanium oxide and aluminum oxide. Even more preferred is titanium oxide. Metal oxide particles of one kind only may be used, or any desired combination of particles of two or more kinds may be used in any desired proportion. Furthermore, metal oxide particles made of one metal oxide only may be used, or metal oxide particles made of any desired combination of two or more metal oxides in any desired proportion may be used.

The metal oxide particles may have any desired crystal form unless they considerably lessen the effects of the invention. For example, metal oxide particles made of titanium oxide as the metal oxide (i.e., titanium oxide particles) are not limited in crystal form, and any of rutile, anatase, brookite, and amorphous ones can be used. Furthermore, with respect to the crystal form of titanium oxide particles, the particles may include ones having two or more crystal states among those different crystal states.

Moreover, the surface of the metal oxide particles may be subjected to various surface treatments. For example, a treatment with, e.g., an inorganic substance such as tin oxide, aluminum oxide, antimony oxide, zirconium oxide, or silicon oxide or an organic substance such as stearic acid, a polyol, or an organosilicon compound may be performed.

Especially when titanium oxide particles are used as the metal oxide particles, it is preferred that the titanium oxide particles have undergone a surface treatment with an organosilicon compound. Examples of the organosilicon compound include silicone oils such as dimethylpolysiloxane and methylhydrogenpolysiloxane; organosilanes such as methyldimethoxysilane and diphenyldimethoxysilane; silazanes such as hexamethyldisilazane; and silane coupling agents such as vinyltrimethoxysilane, γ-mercaptopropyltrimethoxysilane, and γ-aminopropyltriethoxysilane.

It is especially preferred that metal oxide particles should be treated with a silane treating agent represented by the structure of the following formula (i). This silane treating agent has satisfactory reactivity with metal oxide particles and is a satisfactory treating agent.

[Ka-19]

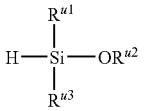

(i)

In formula (i), $R^{u1}$ and $R^{u2}$ each independently represent an alkyl group. The number of carbon atoms in each of $R^{u1}$ and $R^{u2}$ is not limited. However, the number thereof is generally 1 or larger and is generally 18 or smaller, preferably 10 or smaller, more preferably 6 or smaller, especially preferably 3 or smaller. This brings about an advantage that suitable reactivity with metal oxide particles is obtained. When the number of carbon atoms in $R^{u1}$ and $R^{u2}$ is too large, there are cases where this treating agent has reduced reactivity with metal oxide particles or the metal oxide particles after treatment therewith have reduced dispersion stability in a coating fluid.

Example of $R^{u1}$ and $R^{u2}$ include methyl, ethyl, and propyl. In formula (i), $R^{u3}$ represents an alkyl group or an alkoxy group. The number of carbon atoms in $R^{u3}$ is not limited. However, the number thereof is generally 1 or larger and is generally 18 or smaller, preferably 10 or smaller, more preferably 6 or smaller, especially 3 or smaller. This brings about an advantage that suitable reactivity with metal oxide particles is obtained. When the number of carbon atoms in $R^{u3}$ is too large, there are cases where this treating agent has reduced reactivity with metal oxide particles or the metal oxide particles after treatment therewith have reduced dispersion stability in a coating fluid.

Examples of $R^{u3}$ include methyl, ethyl, methoxy, and ethoxy. The outermost surface of the surface-treated metal oxide particles has usually been treated with a treating agent such as any of those described above. In this case, only one surface treatment selected from the surface treatments described above may be conducted, or any desired combination of two or more surface treatments may be conducted. For example, the metal oxide particles may have been treated with a treating agent such as aluminum oxide, silicon oxide, or zirconium oxide prior to a surface treatment with the silane treating agent represented by formula (i). Furthermore, any desired combination of particulate metal oxide materials which have undergone different surface treatments may be used in any desired proportion.

The metal oxide particles in the invention are not limited in average primary-particle diameter, and may have any desired value of the diameter unless this considerably lessens the effects of the invention. However, the average primary-particle diameter of the metal oxide particles in the invention is generally 1 nm or larger, preferably 5 nm or larger, and is generally 100 nm or smaller, preferably 70 nm or smaller, more preferably 50 nm or smaller. This average primary-particle diameter is defined as one determined as an arithmetic average of the diameters of particles directly observed with a transmission electron microscope (hereinafter suitably referred to as "TEM").

The metal oxide particles in the invention are not limited also in refractive index, and any metal oxide particles usable in electrophotographic photoreceptors can be employed. The refractive index of the metal oxide particles in the invention is generally 1.3 or higher, preferably 1.4 or higher, more preferably 1.5 or higher, and is generally 3.0 or lower, preferably 2.9 or lower, more preferably 2.8 or lower.

In a coating fluid for forming the undercoat layer in the invention, the proportion of the metal oxide particles to the binder resin is not limited unless the effects of the invention are considerably lessened. However, in the coating fluid for forming the undercoat layer in the invention, the metal oxide particles are used in an amount in the following range. The amount of the metal oxide particles per part by mass of the binder resin is generally 0.5 parts by mass or larger, preferably 0.7 parts by mass or larger, more preferably 1.0 part by mass or larger, and is generally 4 parts by mass or smaller, preferably 3.8 parts by mass or smaller, more preferably 3.5 parts by mass or smaller. Too small proportions of the metal oxide particles to the binder resin are undesirable because there are cases where the electrophotographic photoreceptor has impaired electrical characteristics and, in particular, has an increased residual potential. On the other hand, when the proportion of the metal oxide particles to the binder resin is too large, there are cases where images formed with the electrophotographic photoreceptor have an increased number of image defects such as black spots or color spots.

As the binder resin to be contained in the undercoat layer, any desired binder resin can be used unless this considerably lessens the effects of the invention. Usually, any binder resin usable in electrophotographic photoreceptors can be employed. Use is generally made of a binder resin which is soluble in solvents, e.g., organic solvents, and gives an undercoat layer which is insoluble or lowly soluble in the solvent, e.g., organic solvent, used in a coating fluid for photosensitive-layer formation and does not substantially mingle with the solvent. Examples of such a binder resin include resins such as phenoxies, epoxies, polyvinylpyrrolidone, poly(vinyl alcohol), casein, poly(acrylic acid), cellulose derivatives, gelatin, starch, polyurethanes, polyimides, and polyamides. Such resins can be used alone or in a cured form obtained by curing with a curing agent. Of the resins shown above, polyamide resins such as alcohol-soluble copolyamides and modified polyamides are preferred because these resins have satisfactory dispersibility and applicability.

Examples of the polyamide resins include so-called copolymer nylons obtained by copolymerization with nylon-6, nylon-6,6, nylon-6,10, nylon-11, nylon-12, or the like; and alcohol-soluble nylon resins such as nylons of the chemically modified type, e.g., N-alkoxymethyl-modified nylons and N-alkoxyethyl-modified nylons.

Especially preferred of these polyamide resins is a copolyamide resin containing a diamine moiety corresponding to a diamine represented by the following formula (ii) (hereinafter, this moiety is sometime abbreviated to "diamine moiety corresponding to formula (ii)) as a component.

[Ka-20]

(ii)

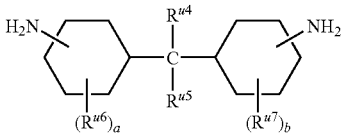

In formula (ii), $R^{u4}$ to $R^{u7}$ represent a hydrogen atom or an organic substituent. Symbols a and b each independently represent an integer of 0-4. In the case where the formula includes two or more substituents, these substituents may be the same or different.

Examples of the organic substituents represented by $R^{u4}$ to $R^{u7}$ include hydrogen groups which may include one or more heteroatoms. Preferred examples of the hydrocarbon groups include alkyl groups such as methyl, ethyl, n-propyl, and isopropyl; alkoxy groups such as methoxy, ethoxy, n-propoxy, and isopropoxy; and aryl groups such as phenyl, naphthyl, anthryl, and pyrenyl. More preferred are alkyl groups and alkoxy groups. Especially preferred are methyl and ethyl.

The number of carbon atoms in each of the organic groups represented by $R^{u4}$ to $R^{u7}$ is not limited unless the effects of the invention are considerably lessened. However, the number thereof is generally 20 or smaller, preferably 18 or smaller, more preferably 12 or smaller, and is generally 1 or larger. When the number of carbon atoms is too large, there are cases where this resin has impaired solubility in solvents. There are cases where this resin gives a coating fluid which gels or where even when the resin dissolves temporarily, the coating fluid opacifies or gels with the lapse of time.

The copolyamide resin containing a diamine moiety corresponding to formula (ii) as a component may contain components other than the diamine moiety corresponding to formula (ii) (hereinafter, those components are sometimes abbreviated to "other polyamide-constituent ingredients") as constituent units. Examples of the other polyamide-constituent ingredients include lactams such as γ-butyrolactam, ϵ-caprolactam, and lauryl lactam; dicarboxylic acids such as 1,4-butanedicarboxylic acid, 1,12-dodecanedicarboxylic acid, and 1,20-eicosanedicarboxylic acid; diamines such as 1,4-butanediamine, 1,6-hexamethylenediamine, 1,8-octamethylenediamine, and 1,12-dodecanediamine; and piperazine. Examples of the copolyamide resin in this case include ones obtained by copolymerizing, for example, two, three, four, or more constituent ingredients for the resin.

In the case where the copolyamide resin containing a diamine moiety corresponding to formula (ii) as a component contains other polyamide-constituent ingredients as structural units, there is no limit on the proportion of the diamine moiety corresponding to formula (ii) in all constituent ingredients. However, the proportion thereof is generally 5 mol % or higher, preferably 10 mol % or higher, more preferably 15 mol % or higher, and is generally 40 mol % or lower, preferably 30 mol % or lower. When the proportion of the diamine moiety corresponding to formula (ii) is too large, there are cases where the coating fluid has impaired stability. When the proportion thereof is too small, there are cases where electrical characteristics change considerably under high-sound high-humidity conditions and the stability of electrical characteristics to environmental changes is poor.

Specific examples of the copolyamide resin are shown below. In the examples, each copolymerization proportion indicates monomer feed proportion (molar proportion).

[Ka-21]

①

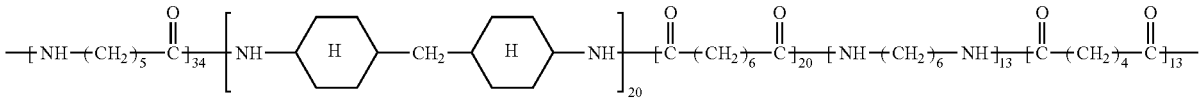

②

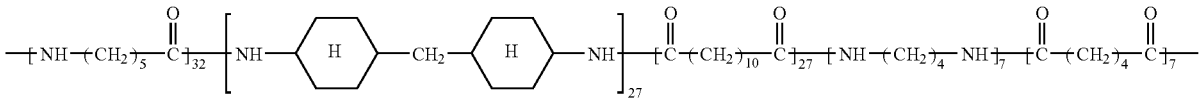

③

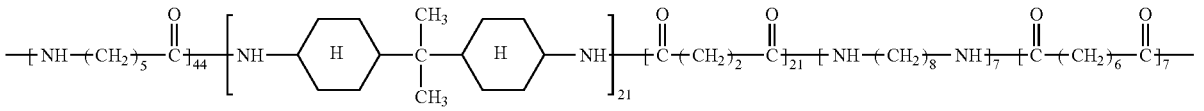

④

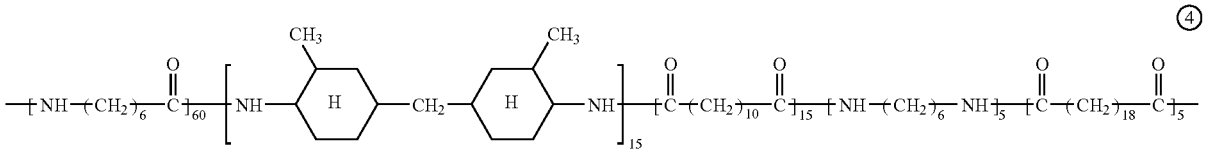

-continued

⑤

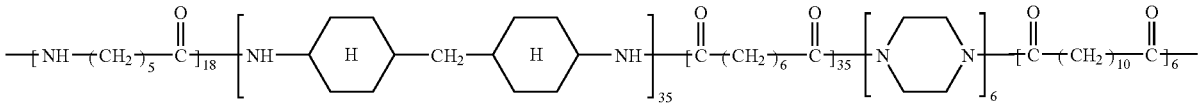

⑥

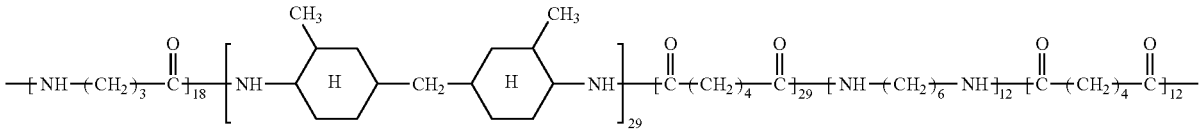

⑦

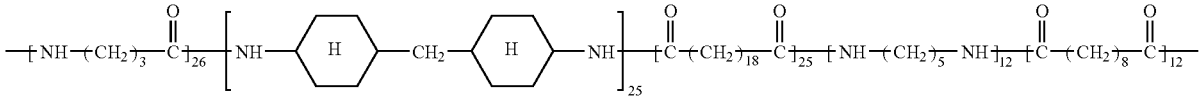

Processes for producing the copolyamide are not limited, and methods of polycondensation for ordinary polyamides may be suitably utilized. For example, polycondensation techniques such as melt polymerization, solution polymerization, and interfacial polymerization can be suitably utilized. For the polymerization, an ingredient such as, for example, a monobasic acid, e.g., acetic acid or benzoic acid, or a monoacidic base, e.g., hexylamine or aniline, may be incorporated as a molecular-weight regulator into the polymerization system.

One of those binder resins may be used alone, or any desired combination of two or more thereof may be used in any desired proportion.

The binder resin is not limited also in number-average molecular weight. For example, in the case of using a copolyamide as the binder resin, the number-average molecular weight of the copolyamide is generally 10,000 or higher, preferably 15,000 or higher, and is generally 50,000 or lower, preferably 35,000 or lower. Too low or too high number-average molecular weights may result in difficulties in maintaining undercoat layer evenness.

The undercoat layer is usually obtained by applying a coating fluid for undercoat layer formation to form a layer therefrom. Various properties of the undercoat layer are influenced by the properties of the coating fluid for undercoat layer formation. The coating fluid may have any desired binder resin content unless the effects of the invention are considerably lessened thereby. However, the content of the binder resin in the coating fluid for forming the undercoat layer in the invention is generally 0.5% by mass or higher, preferably 1% by mass or higher, and is generally 20% by mass or lower, preferably 10% by mass or lower. Usually, the coating fluid for forming the undercoat layer is obtained by dissolving or dispersing the ingredients for constituting the undercoat layer in a solvent.

As the solvent for use in the coating fluid for forming the undercoat layer in the invention, any desired solvent can be used so long as the binder resin in the invention can dissolve therein. As this solvent, an organic solvent is generally used. Examples of the solvent for use in the coating fluid for forming the undercoat layer include alcohols having 5 or less carbon atoms, such as methanol, ethanol, 1-propanol, and 2-propanol; halogenated hydrocarbons such as chloroform, 1,2-dichloroethane, dichloromethane, trichlene, carbon tetrachloride, and 1,2-dichloropropane; nitrogen-containing organic solvents such as dimethylformamide; and aromatic hydrocarbons such as toluene and xylene.

One of those solvents for the coating fluid for forming the undercoat layer may be used alone, or any desired combination of two or more thereof may be used in any desired proportion. Furthermore, even a solvent in which the binder resin in the invention does not dissolve when the solvent is used alone can be employed so long as this solvent is used as a mixed solvent which includes another solvent (e.g., any of the organic solvents enumerated above) and in which the binder resin is soluble. In general, use of a mixed solvent is more effective in diminishing coating unevenness.

In the coating fluid for forming the undercoat layer in the invention, the ratio of the amount of the solvent to the amount of the solid ingredients including the metal oxide particles and the binder resin varies depending on methods for applying the coating fluid for forming the undercoat layer. The ratio thereof may be suitably changed so as to form an even coating film by the coating method to be used.

The coating fluid for forming the undercoat layer may contain ingredients other than the metal oxide particles, binder resin, and solvent described above, unless the effects of the invention are considerably lessened thereby. For example, additives may be incorporated as other ingredients into the coating fluid for forming the undercoat layer. Examples of the additives include heat stabilizers represented by sodium phosphite, sodium hypophosphite, phosphorous acid, hypophosphorous acid, and hindered phenols and other additives for polymerization. One additive may be used alone, or any desired combination of two or more additives may be used in any desired proportion.

Processes for producing the coating fluid for forming the undercoat layer are not particularly limited. It should, however, be noted that the coating fluid for forming the undercoat layer contains metal oxide particles as described above and that the metal oxide particles are in the state of being dispersed in the coating fluid for forming the undercoat layer. Consequently, processes for producing the coating fluid for forming the undercoat layer in the invention usually include a dispersion step for dispersing the metal oxide particles.

<Layer Containing Charge-Generating Substance>

(1. Charge-Generating Substance)

As the charge-generating substance in the electrophotographic photoreceptors of the invention, any known compound can be used unless this compound lessens the effects of the invention. A combination of two or more known compounds may also be used. As such compounds, various photoconductive materials can be used. Examples thereof include selenium and alloys thereof, cadmium sulfide, other inorganic photoconductive materials, and organic pigments such as phthalocyanine pigments, azo pigments, dithioketopyrrolopyrrole pigments, squalene (squarylium) pigments, quinacridone pigments, indigo pigments, perylene pigments, polycyclic quinone pigments, anthanthrone pigments, and benzimidazole pigments. Preferred are organic pigments. More preferred are phthalocyanine pigments and azo pigments.

Usable phthalocyanines include phthalocyanines having various crystal forms such as, for example, metal-free phthalocyanines and phthalocyanine compounds to which a metal, e.g., copper, indium, gallium, tin, titanium, zinc, vanadium, silicon, or germanium, or an oxide, halide, hydroxide, alkoxide, or another form of the metal has coordinated. Preferred are X-form and τ-form metal-free phthalocyanines, which are crystal forms having high sensitivity, A-form (also called β-form), B-form (also called α-form), D-form (also called Y-form), and other titanyl phthalocyanines (another name: oxytitanium phthalocyanines), vanadyl phthalocyanines, chloroindium phthalocyanines, II-form and other chlorogallium phthalocyanines, V-form and other hydroxygallium phthalocyanines, G-form, I-form, and other μ-oxogallium phthalocyanine dimers, and II-form and other μ-oxoaluminum phthalocyanine dimers. More preferred of these phthalocyanines are A-form (β-form), B-form (α-form), and D-form (Y-form) oxytitanium phthalocyanines, II-form chlorogallium phthalocyanine, V-form hydroxygallium phthalocyanine, G-form μ-oxogallium phthalocyanine dimer, and the like. Especially preferred are the oxytitanium phthalocyanines having a main distinct diffraction peak at a Bragg angle (2θ±0.2°) of 27.3° in X-ray powder diffractometry using $CuK_\alpha$ characteristic X-ray and the oxytitanium phthalocyanines having a distinct diffraction peak at a Bragg angle (2θ±0.2°) of 9.0°-9.7° in X-ray powder diffractometry using $CuK_\alpha$ characteristic X-ray. Examples of preferred azo compounds are shown below.

[Ka-22]

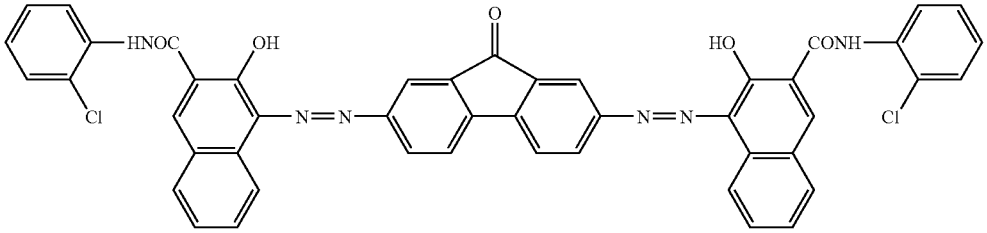

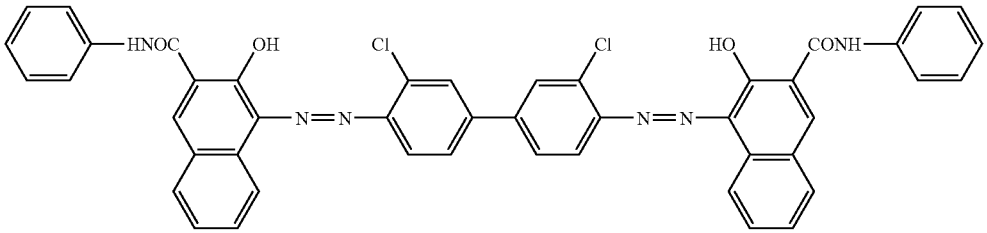

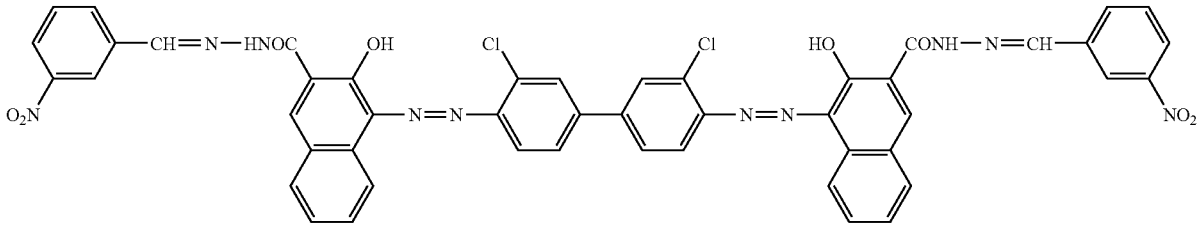

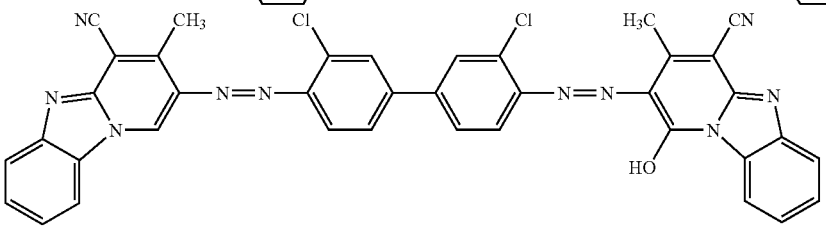

[Ka-23]
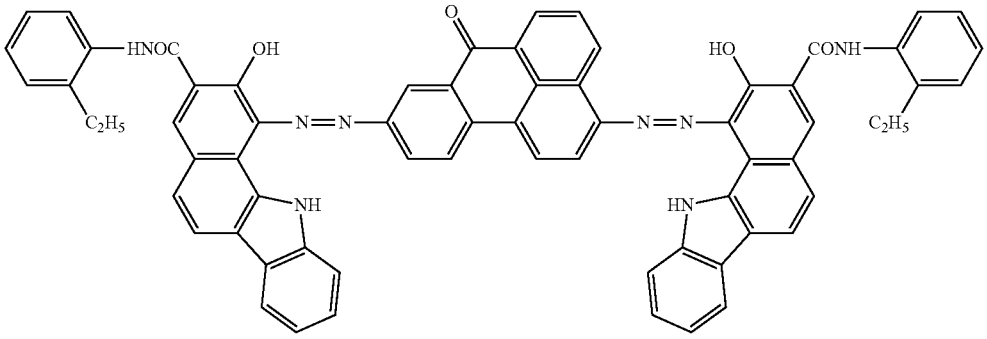
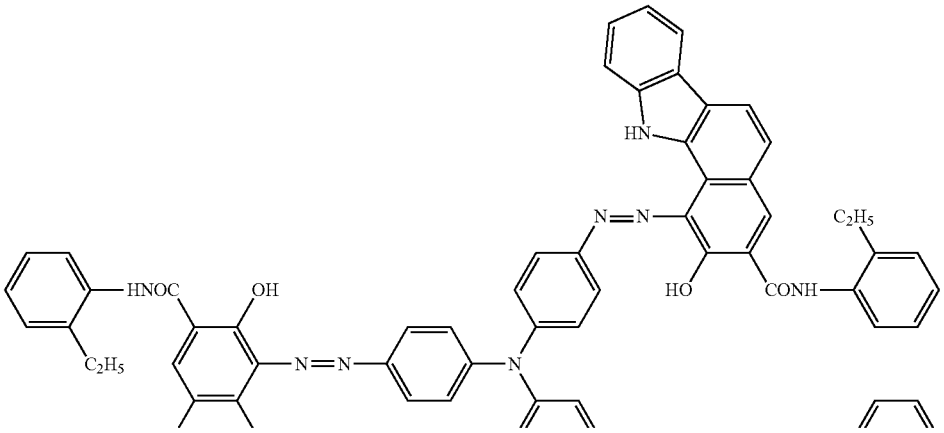
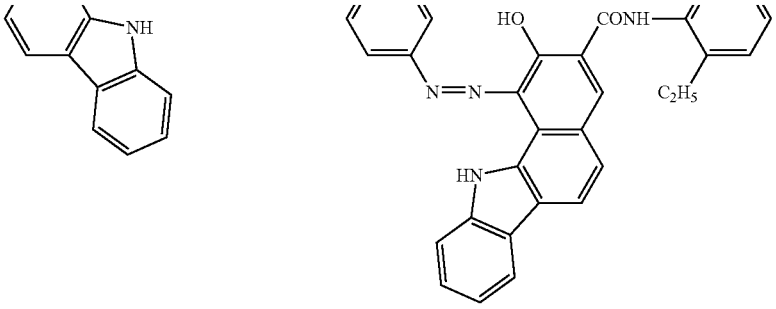

-continued
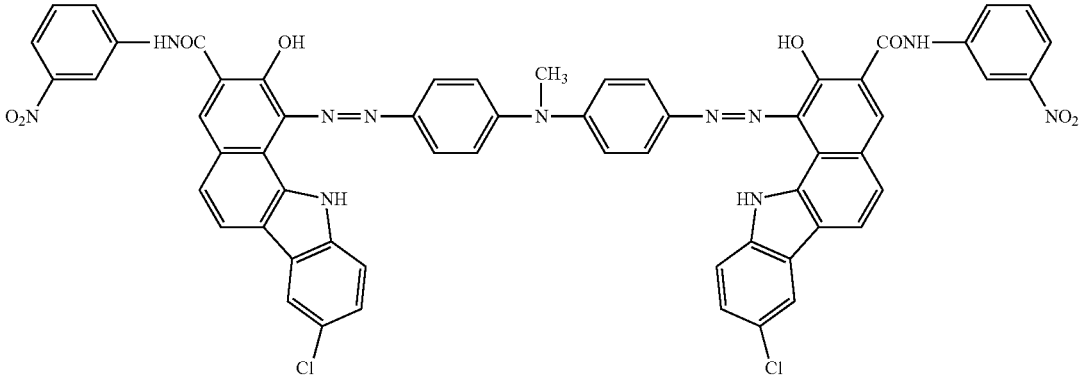
[Ka-24]
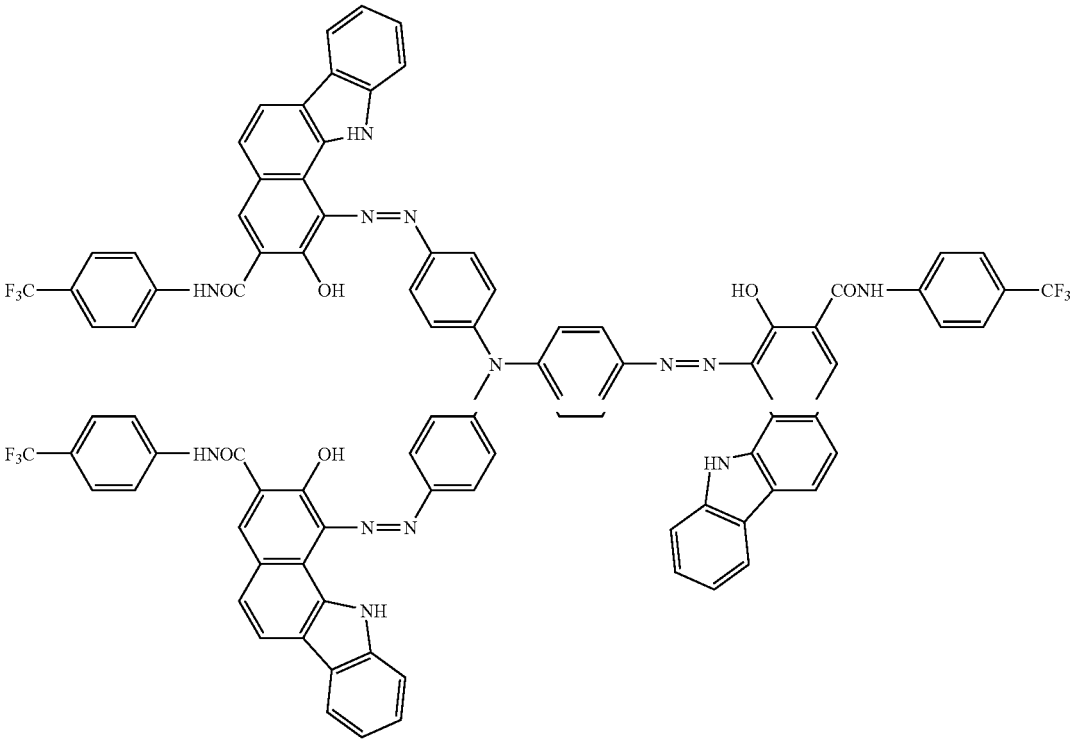
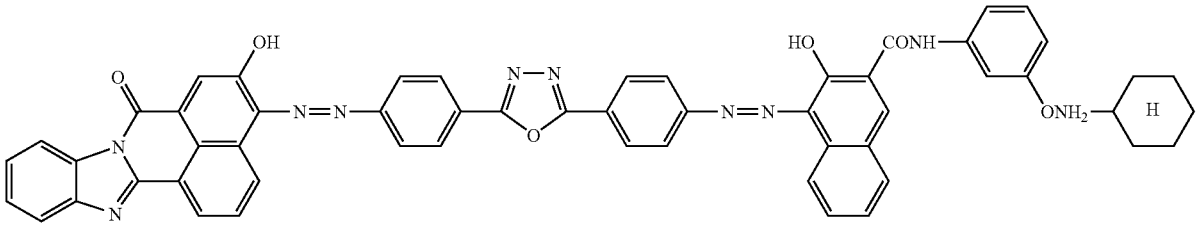
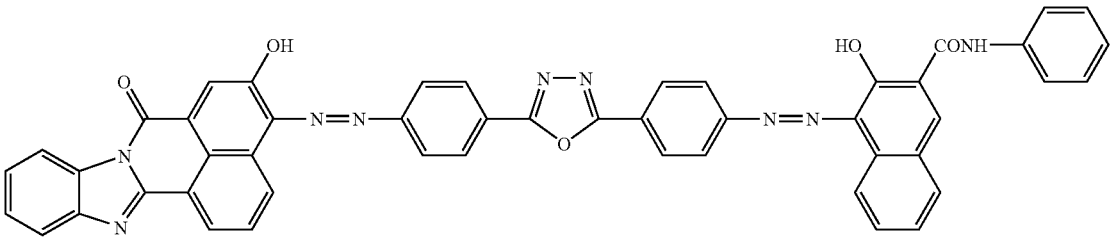

-continued

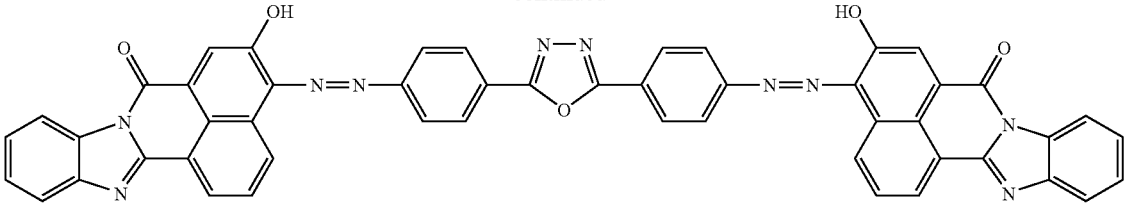

[Ka-25]

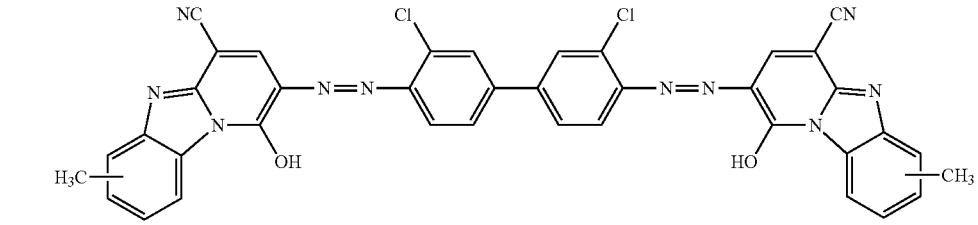

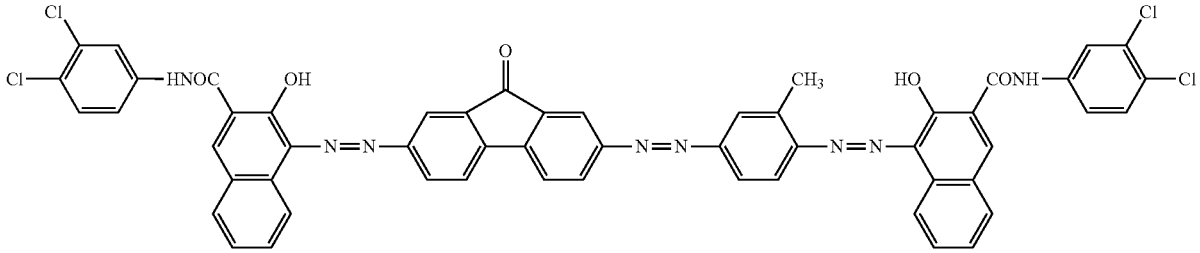

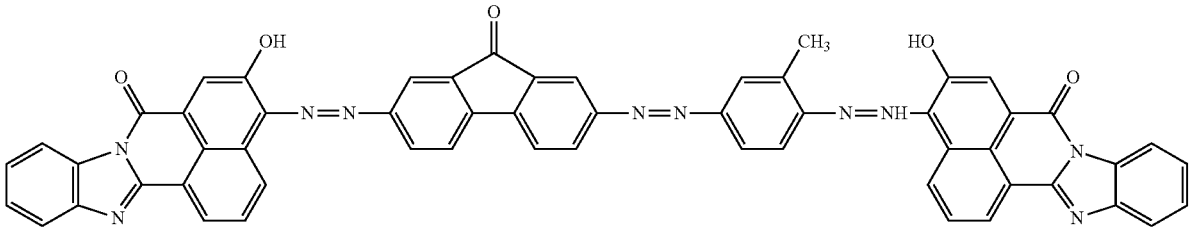

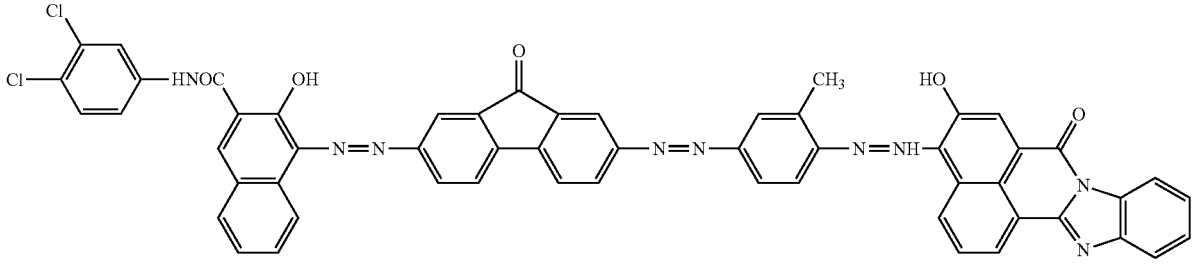

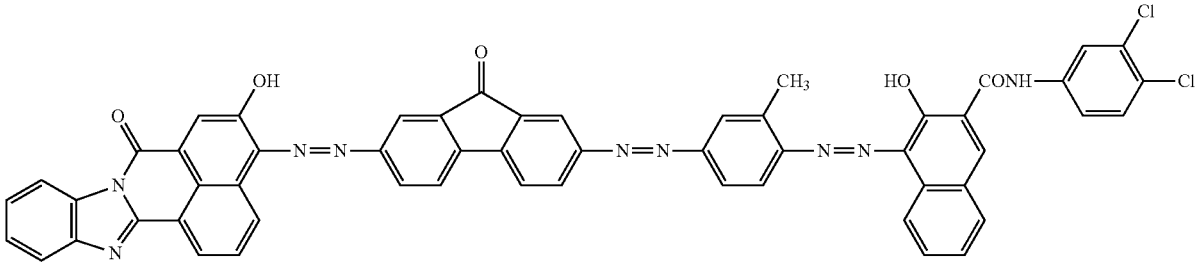

(2. Multilayer Type Photoreceptor)

In the case where the electrophotographic photoreceptors of the invention are so-called multilayer type photoreceptors, the layer containing a charge-generating substance generally is a charge-generating layer. In the multilayer type photoreceptors, however, a charge-generating substance may be contained in a charge-transporting layer unless this considerably lessens the effects of the invention.

The charge-generating substance is not limited in volume-average particle diameter. However, when used in multilayer type photoreceptors, the charge-generating substance has a volume-average particle diameter of generally 1 μm or smaller, preferably 0.5 μm or smaller. Incidentally, the volume-average particle diameter of a charge-generating substance may be determined in the same manner as in the determination of the volume-average diameter of the metal oxide particles contained in the undercoat layer in the invention. The volume-average particle diameter thereof may be defined as a value determined with a particle size analyzer operated by the known laser diffraction scattering method or with a particle size analyzer operated by the light-transmitting centrifugal sedimentation method.

The charge-generating layer may have any desired thickness. However, the thickness thereof is generally 0.1 μm or larger, preferably 0.15 μm or larger, and is generally 2 μm or smaller, preferably 0.8 μm or smaller.

In the case where the layer containing a charge-generating substance is a charge-generating layer, the proportion of the charge-generating substance to be used in the charge-generating layer is generally 30 parts by mass or larger, preferably 50 parts by mass or larger, and is generally 500 parts by mass or smaller, preferably 300 parts by mass or smaller, per 100 parts by mass of the photosensitive-layer binder resin to be contained in the charge-generating layer. When the charge-generating substance is used in too small an amount, there are cases where the electrophotographic photoreceptor has insufficient electrical characteristics. When the amount thereof is too large, there are cases where the coating fluid has impaired stability.

The charge-generating layer may further contain a known plasticizer for improving film-forming properties, flexibility, mechanical strength, etc., an additive for controlling residual potential, a dispersing aid for improving dispersion stability, a leveling agent, surfactant, silicone oil, or fluorochemical oil for improving applicability, and other additive. One of these additives may be used alone, or any desired combination of two or more thereof may be used in any desired proportion.

(3. Single-Layer Type Photoreceptor)

In the case where the electrophotographic photoreceptors of the invention are so-called single-layer type photoreceptors, the charge-generating substance is dispersed in a matrix including a photosensitive-layer binder resin and a charge-transporting substance as main components in the same proportion as in the charge-transporting layer which will be described later. It is preferred that when the charge-generating substance is used in single-layer type photosensitive layers, the particle diameter thereof should be sufficiently small. Because of this, the volume-average particle diameter of the charge-generating substance in the single-layer type photosensitive layer is generally 0.5 μm or smaller, preferably 0.3 μm or smaller.

The single-layer type photosensitive layer may have any desired thickness. However, the thickness thereof is generally 5 μm or larger, preferably 10 μm or larger, and is generally 50 μm or smaller, preferably 45 μm or smaller.

The amount of the charge-generating substance to be dispersed in the photosensitive layer is not limited. However, too small amounts thereof may result in cases where sufficient sensitivity is not obtained. Too large amounts thereof may result in a decrease in electrification characteristics, a decrease in sensitivity, etc. Because of this, the content of the charge-generating substance in the single-layer type photosensitive layer is generally 0.5% by mass or higher, preferably 10% by mass or higher, and is generally 50% by mass or lower, preferably 45% by mass or lower.

The photosensitive layer of the single-layer type photoreceptor also may contain a known plasticizer for improving film-forming properties, flexibility, mechanical strength, etc., an additive for controlling residual potential, a dispersing aid for improving dispersion stability, a leveling agent, surfactant, silicone oil, or fluorochemical oil for improving applicability, and other additive. One of these additives may be used alone, or any desired combination of two or more thereof may be used in any desired proportion.

<Layer Containing Charge-Transporting Substance>

(1. Charge-Transporting Substance)

As the charge-transporting substance, any known compound which is a charge-transporting substance can be used unless this compound lessens the effects of the invention. A combination of two or more such compounds may also be used. More specifically, examples thereof include diphenoquinone derivatives, aromatic nitro compounds such as 2,4,7-trinitrofluorenone, heterocyclic compounds such as carbazole derivatives, indole derivatives, imidazole derivatives, oxazole derivatives, pyrazole derivatives, oxadiazole derivatives, pyrazoline derivatives, and thiadiazole derivatives, nitrogen-containing compounds such as aniline derivatives, compounds having a hydrazone structure, compounds having a diamine structure, and aromatic amine derivatives, stilbene derivatives, butadiene derivatives, enamine compounds, compounds made up of two or more of these compounds bonded to each other, and polymers having a group derived from any of these compounds in the main chain or a side chain.

In the multilayer type photoreceptors, a compound showing no absorption in an exposure region is preferred. Specifically, preferred examples include compounds having the following frameworks. These frameworks may have one or more substituents having 30 carbon atoms or less. Preferably, the substituents have 20 carbon atoms or less. Preferred substituents are, for example, alkyl, aryl, alkoxy, and unsaturated groups which each may have one or more substituents.

[Ka-26]

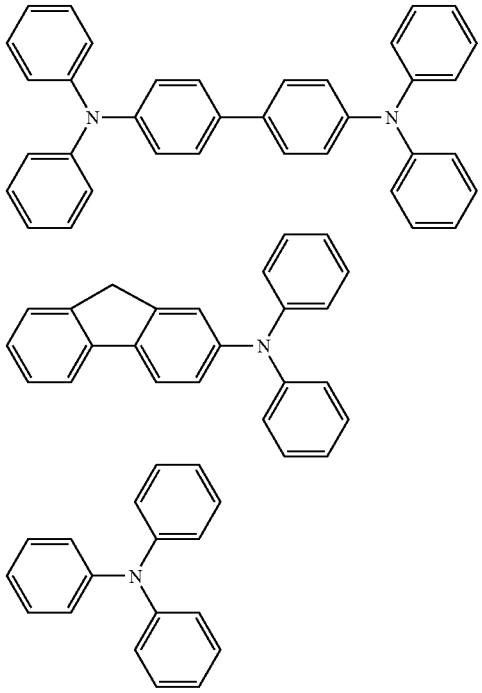

-continued

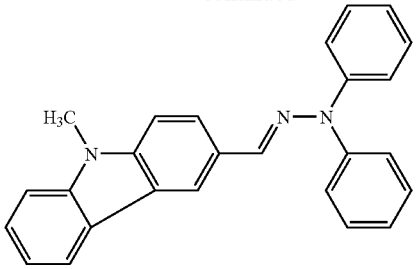

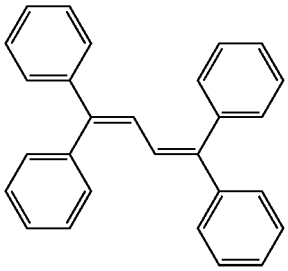

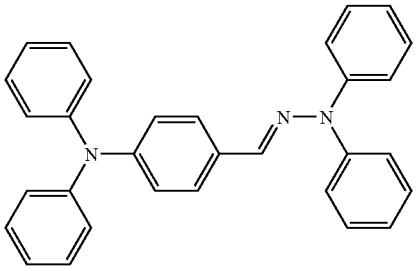

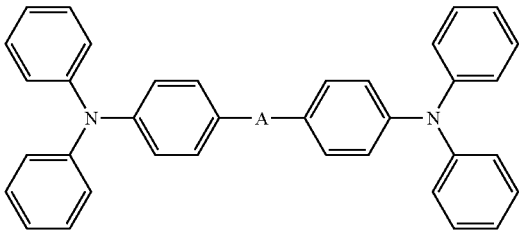

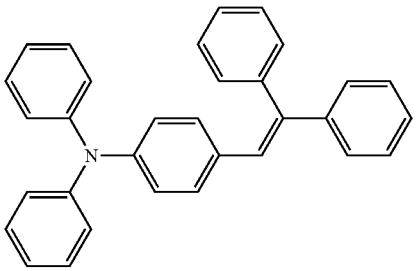

(Symbol A represents a connecting group, and preferably is an alkylidene group having 10 or less carbon atoms.)

Especially preferred are hydrazone compounds (compounds having a hydrazone structure), diamine compounds (compounds having a diamine structure), and butadiene compounds (compounds having a butadiene structure). Furthermore, the compounds having the following structures are more preferred because these compounds show excellent matching with the compound represented by formula (1).

[Ka-27]

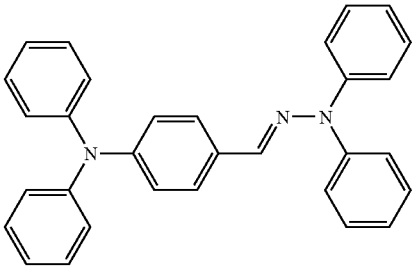

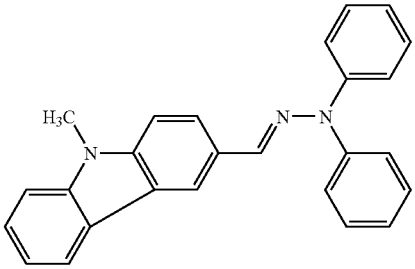

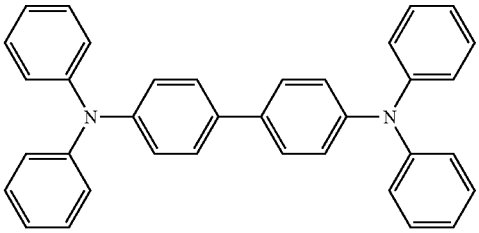

Preferred examples of the charge-transporting substance in the invention are shown below.

[Ka-28]

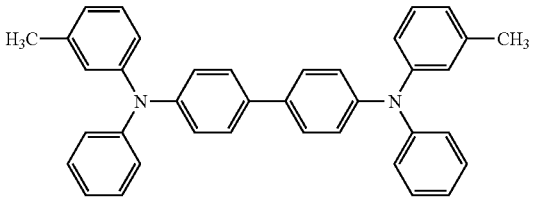

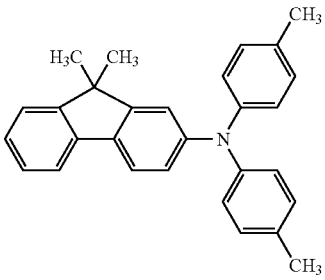

-continued
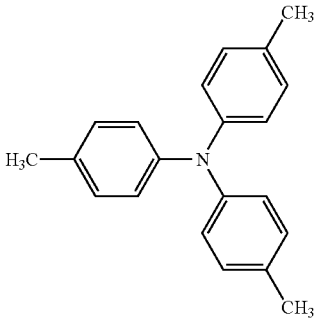
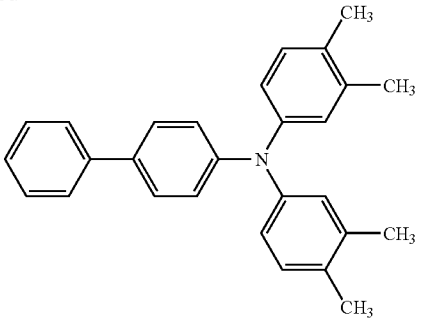
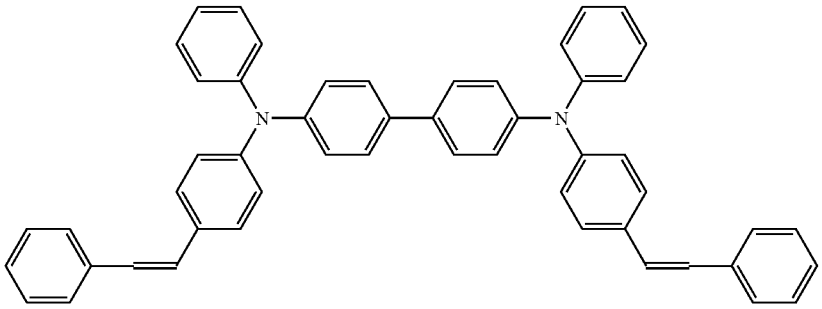
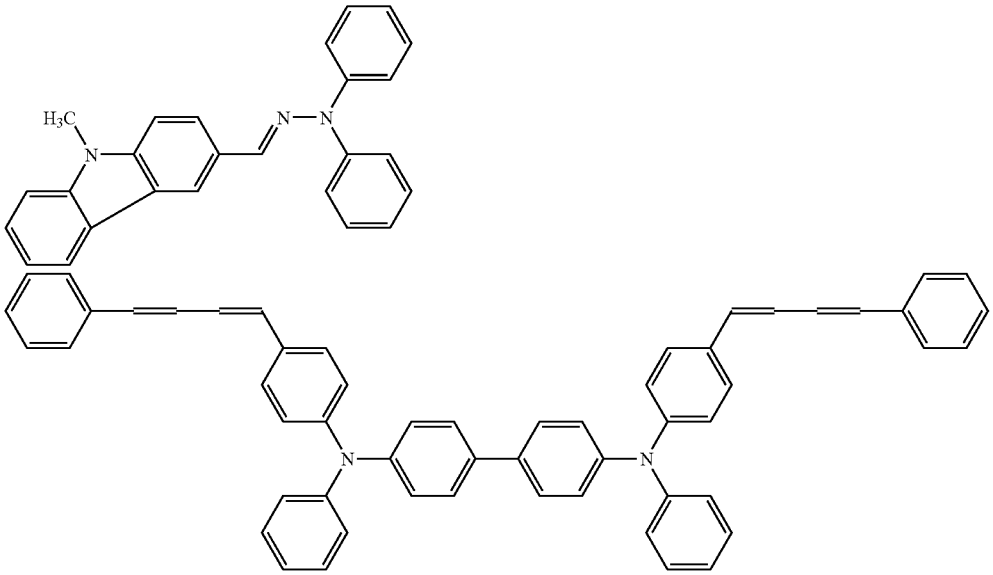
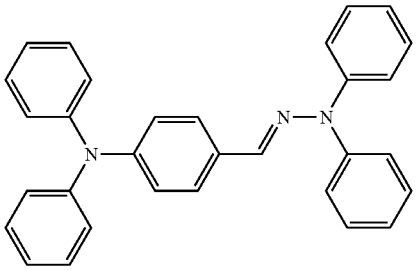
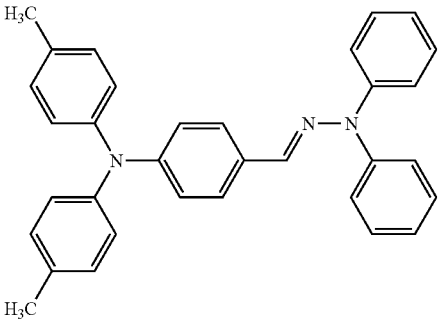

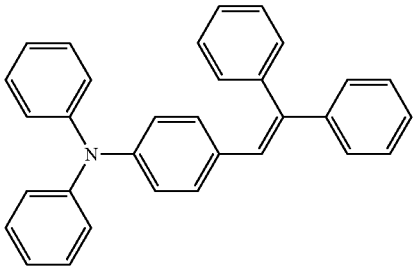
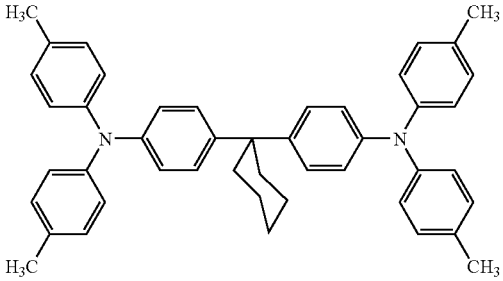
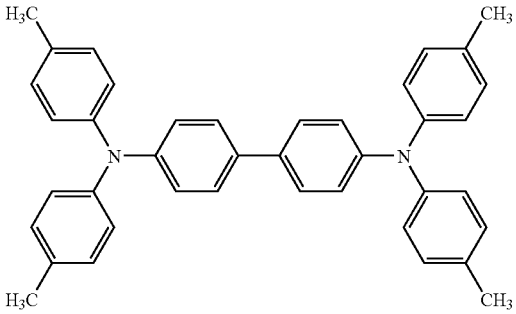
-continued
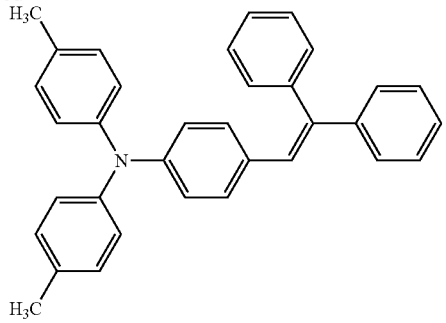
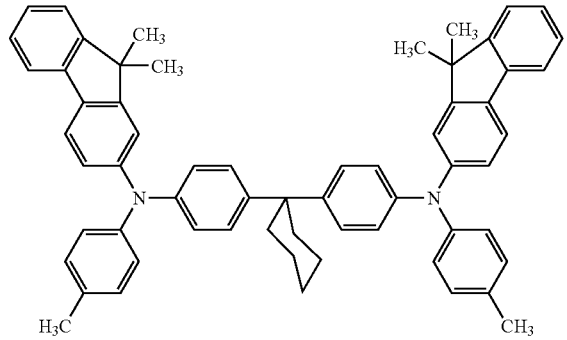
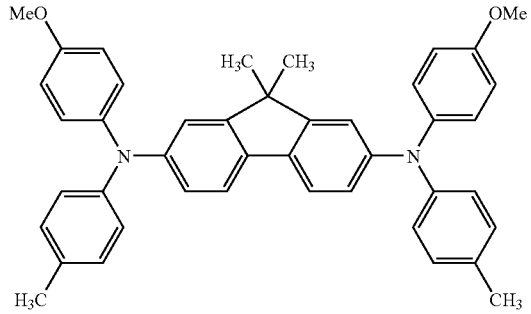
[Ka-29]
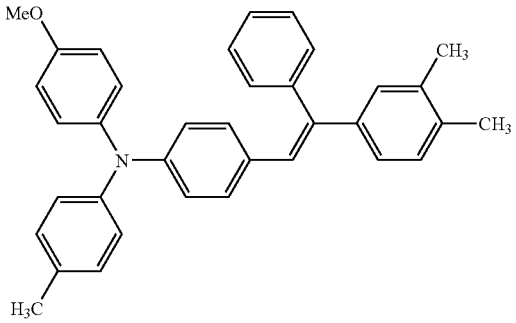
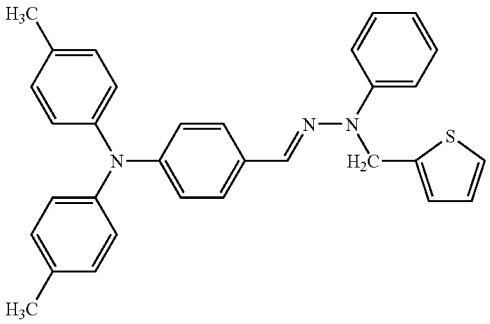
-continued
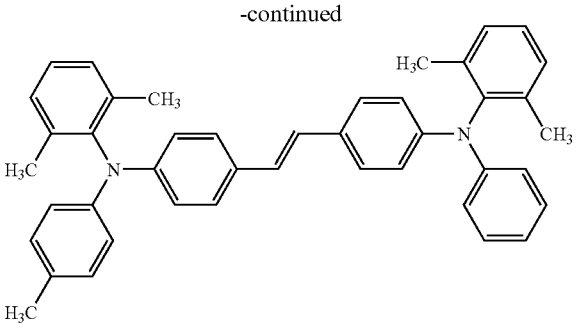
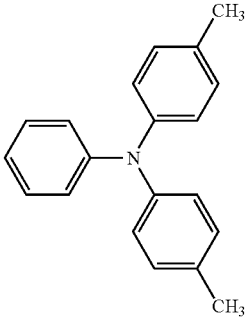

-continued

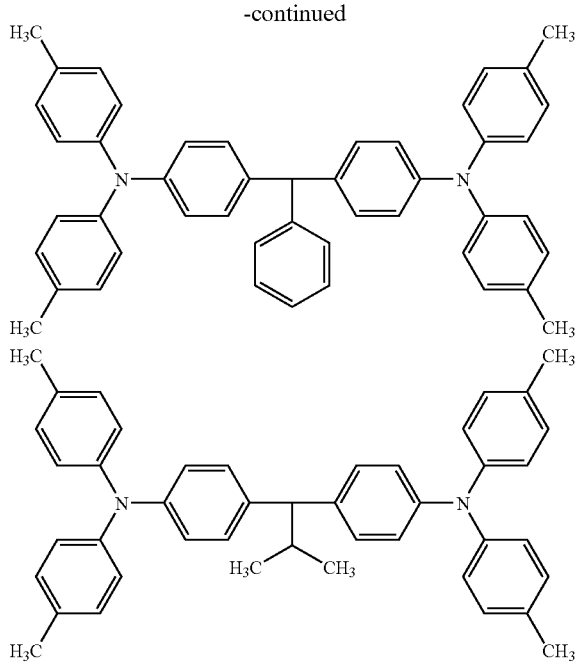

<Constitutions of Electrophotographic Photoreceptors>

In the case of a multilayer type photoreceptor, a charge-transporting layer containing a charge-transporting substance is formed. The charge-transporting layer may be constituted of a single layer, or may be composed of two or more superposed layers differing in component or composition. In the case of the photosensitive layer of a single-layer type photoreceptor, a charge-generating substance is dispersed in a charge-transporting medium having the same constitution as the charge-transporting layer of a multilayer type photoreceptor. The charge-transporting layer of a multilayer type photoreceptor and the charge-transporting medium of a single-layer type photoreceptor are usually obtained by binding a charge-transporting substance for the layer or medium with a binder resin.

A normal superposition type photoreceptor and a single-layer type photoreceptor work when a light which has passed through the charge-transporting layer or photosensitive layer reaches the charge-generating substance. Because of this, the charge-transporting layer and the charge-transporting medium must have excellent transparency to exposure light so as not to block the exposure light. It is preferred that the charge-transporting substance and the binder resin should be highly compatible with each other and cause neither precipitation of a constituent substance nor turbidity. From the standpoint of forming satisfactory images, ones which do not absorb exposure light are preferred. The charge-transporting layer and the charge-transporting medium preferably are ones having an exposure-light transmittance of preferably 87% or higher. The transmittance thereof is more preferably 90% or higher, even more preferably 93% or higher, especially preferably 95% or higher. The exposure-light transmittance of the charge-transporting layer or charge-transporting medium can be attained, for example, by selecting a charge-transporting substance, e.g., by using the compound represented by formula (1) according to the invention as a charge-transporting substance. Alternatively, the transmittance can be attained by regulating the thickness of the charge-transporting layer. For measuring exposure-light transmittance, any known method can be used. For example, the transmittance can be determined by forming the layer on a plate which is transparent at a measuring wavelength (e.g., a quartz glass plate) and examining the layer with a commercial spectrophotometer.

In the charge-transporting layer of a multilayer type photoreceptor and in the photosensitive layer of a single-layer type photoreceptor, the proportion of the binder resin to the charge-transporting substance(s) may be as follows. The amount of all charge-transporting substances is in the range of generally 30-200 parts by mass, preferably 40-150 parts by mass, per 100 parts by mass of the binder resin. The thickness of the charge-transporting layer of a multilayer type photoreceptor and that of the photosensitive layer of a single-layer type photoreceptor are generally 5-50 μm, preferably 10-45 μm. When the thicknesses thereof are too small, there are cases where the electrophotographic photoreceptor has a shortened life due to wear. When the thicknesses thereof are too large, there are case where the diffusion of exposure light and charges occurs, resulting in images having impaired resolution.

<Additives>

Known additives such as plasticizers, antioxidants, ultraviolet absorbers, electron-attracting compounds, leveling agents, surfactants, plasticizers, and other additives including silicone oils and fluorochemical oils may be incorporated in order to improve film-forming properties, flexibility, applicability, nonfouling properties, gas resistance, light resistance, etc. Examples of the antioxidants include hindered phenol compounds and (hindered) amine compounds.

<Binder Resin for Photosensitive Layer>

Examples of the binder resin for use in the charge-transporting layer of a multilayer type photoreceptor and in the photosensitive layer of a single-layer type photoreceptor include vinyl polymers such as poly(methyl methacrylate), polystyrene, and poly(vinyl chloride) and copolymers thereof, polycarbonates, polyesters, polyester carbonates, polysulfones, polyimides, phenoxy resins, epoxy resins, and silicone resins. These resins may be used as a cured resin obtained by partial crosslinking or as a mixture thereof.

Preferred examples of the binder resin for use in the photosensitive layer in the invention include polycarbonate resins and polyester resins. Polycarbonate resins and polyester resins generally have partial structures of a diol ingredient. Examples of the diol ingredient constituting these structures include a bisphenol residue and a biphenol residue. Examples thereof include: bisphenol ingredients such as bis(4-hydroxy-3,5-dimethylphenyl)methane, bis(4-hydroxyphenyl)methane, bis(4-hydroxy-3-methylphenyl)methane, 1,1-bis(4-hydroxyphenyl)ethane, 1,1-bis(4-hydroxyphenyl)propane, 2,2-bis(4-hydroxyphenyl)propane, 2,2- bis(4-hydroxy-3-methylphenyl)propane, 2,2-bis(4- hydroxyphenyl)butane, 2,2-bis(4- hydroxyphenyl)pentane, 2,2- bis(4-hydroxyphenyl)-3-methylbutane, 2,2-bis(4- hydroxyphenyl)hexane, 2,2-bis(4-hydroxyphenyl)-4-methylpentane, 1,1-bis(4-hydroxyphenyl)cyclopentene, 1,1-bis(4-hydroxyphenyl) cyclohexane, bis(3-phenyl-4- hydroxyphenyl)methane, 1,1-bis(3-phenyl-4- hydroxyphenyl)ethane, 1,1- bis(3-phenyl-4-hydroxyphenyl) propane, 2,2- bis(3-phenyl-4-hydroxyphenyl) propane, 1,1-bis(4-hydroxy-3-methylphenyl) ethane, 2,2-bis(4- hydroxy-3-methylphenyl) propane, 2,2-bis(4-hydroxy-3-ethylphenyl) propane, 2,2-bis (4-hydroxy-3- isopropylphenyl)propane, 2,2-bis(4-hydroxy-3-sec-butylphenyl) propane, 1,1- bis (4-hydroxy-3,5-dimethylphenyl) ethane, 2,2-bis (4-hydroxy- 3,5-dimethylphenyl) propane, 1,1-bis (4-hydroxy- 3,5-dimethylphenyl) cyclohexane, 1,1-bis(4-hydroxy- 3,6-dimethylphenyl) ethane, bis(4-hydroxy-2,3,5-trimethylphenyl) methane, 1,1-bis(4-hydroxy-2,3,5-trimethylphenyl)ethane, 2,2-bis(4-hydroxy-2,3,5-trimethylphenyl)propane, bis(4-hydroxy-2,3,5-trimethylphenyl)phenylmethane, 1,1-bis(4-hydroxy-2,3,5-trimethylphenyl)phenylethane, 1,1-bis(4-hydroxy-2,3,5-trimethylphenyl)cyclohexane, bis(4-hydroxyphenyl)phenylmethane, 1,1-bis(4-hydroxyphenyl)-1-phenylethane, 1,1-bis(4-hydroxyphenyl)-1-phenylpropane, bis(4-hydroxyphenyl)diphenylmethane, bis(4-hydroxyphenyl)dibenzylmethane, 4,4'-[1,4-phenylenebis(1-methylethylidene)]bis[phenol], 4,4'-[1,4-phenylenebismethylene]bis[phenol], 4,4'-[1,4-phenylenebis(1-methylethylidene)]bis[2,6-dimethylphenol], 4,4'-[1,4-phenylenebismethylene]bis[2,6-dimethylphenol], 4,4'-[1,4-phenylenebismethylene]bis[2,3,6-trimethylphenol], 4,4'-[1,4-phenylenebis(1-methylethylidene)]bis[2,3,6-trimethylphenol], 4,4'-[1,3-phenylenebis(1-methylethylidene)]bis[2,3,6-trimethylphenol], 4,4'-dihydroxydiphenyl ether, stearyl ester of 4,4-bis(4-hydroxyphenyl)valeric acid, 4,4'-dihydroxydiphenyl sulfone, 4,4'-dihydroxydiphenyl sulfide, 3,3',5,5'-tetramethyl-4,4'-dihydroxydiphenyl ether, 3,3',5,5'-tetramethyl-4,4'-dihydroxydiphenyl sulfone, 3,3',5,5'-tetramethyl-4,4'-dihydroxydiphenyl sulfide, phenolphthalein, 4,4'-[1,4-phenylenebis(1-methylvinylidene)]bisphenol, 4,4'-[1,4-phenylenebis(1-methylvinylidene)]bis[2-methylphenol], (2-hydroxyphenyl)(4-hydroxyphenyl)methane, (2-hydroxy-5-methylphenyl)(4-hydroxy-3-methylphenyl)methane, 1,1-(2-hydroxyphenyl)(4-hydroxyphenyl)ethane, 2,2-(2-hydroxyphenyl)(4-hydroxyphenyl)propane, and 1,1-(2-hydroxyphenyl)(4-hydroxyphenyl)propane; and biphenol ingredients such as 4,4'-biphenol, 2,4'-biphenol, 3,3'-dimethyl-4,4'-dihydroxy-1,1'-biphenyl, 3,3'-dimethyl-2,4'-dihydroxy-1,1'-biphenyl, 3,3'-di(t-butyl)-4,4'-dihydroxy-1,1'-biphenyl, 3,3',5,5'-tetramethyl-4,4'-dihydroxy-1,1'-biphenyl, 3,3',5,5'-tetra(t-butyl)-4,4'-dihydroxy-1,1'-biphenyl, and 2,2',3,3',5,5'-hexamethyl-4,4'-dihydroxy-1,1'-biphenyl.

Preferred examples of those compounds include bisphenol ingredients such as bis(4-hydroxy-3,5-dimethylphenyl)methane, bis(4-hydroxyphenyl)methane, bis(4-hydroxy-3-methylphenyl)methane, 2,2-bis(4-hydroxy-3-methylphenyl)propane, 1,1-bis(4-hydroxyphenyl)ethane, 2,2-bis(4-hydroxyphenyl)propane, 2-hydroxyphenyl(4-hydroxyphenyl)methane, and 2,2-(2-hydroxyphenyl)(4-hydroxyphenyl)propane.

Specific examples of diol ingredients (bisphenols, biphenols, etc.) for polycarbonate resins which can be advantageously used are shown below. The following examples are intended to clarify the spirit of the invention, and the diol ingredients should not be construed as being limited to the following structures unless this is counter to the spirit of the invention.

[Ka-30]

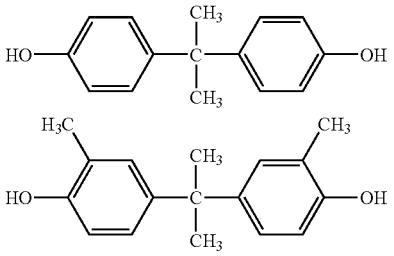

-continued

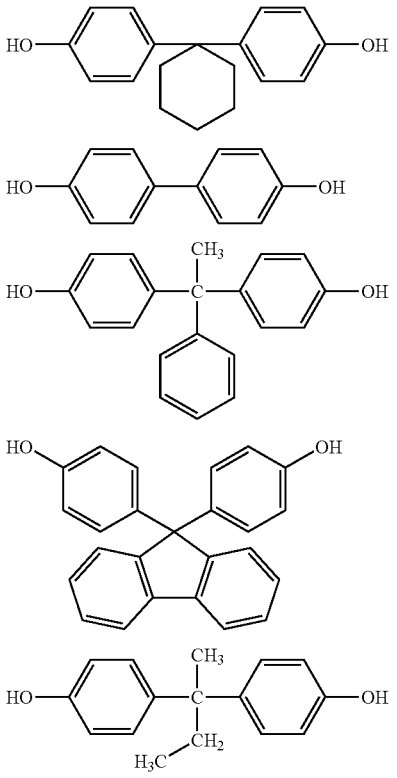

From the standpoint of maximizing the effects of the invention, the diol ingredients having the following structures are more preferred.

[Ka-31]

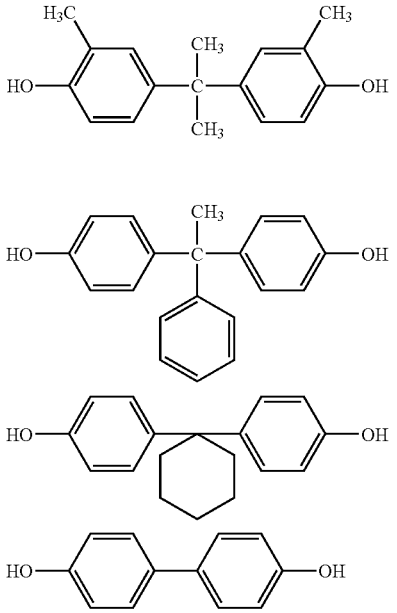

Especially preferred is the following structure. It is preferred that the binder resin should have the repeating structure represented by the following formula (2).

[Ka-32]

(2)

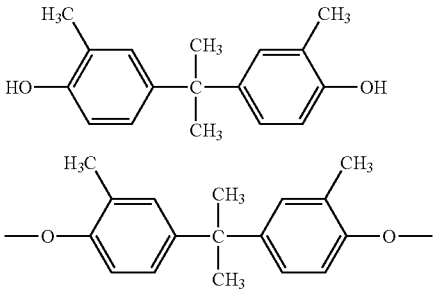

From the standpoint of improving mechanical properties, it is preferred to use a polyarylate resin. In this case, it is preferred to use the following structures as diol ingredients.

[Ka-33]

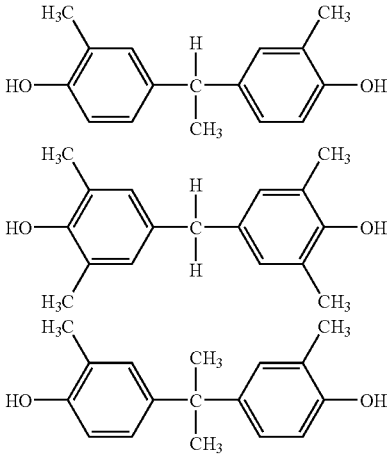

As acid ingredients, it is preferred to use the following structures.

[Ka-34]

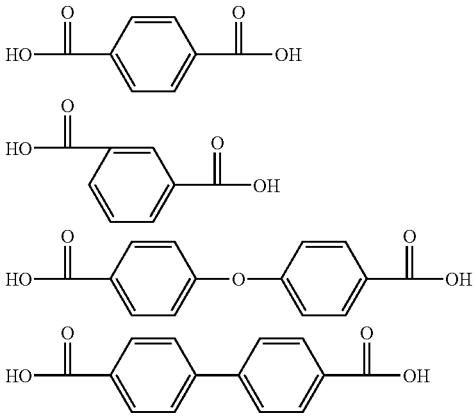

An especially preferred acid ingredient is the following. It is also possible to use a combination of two or more of those dicarboxylic acid ingredients and a combination of two or more of those diol ingredients.

[Ka-35]

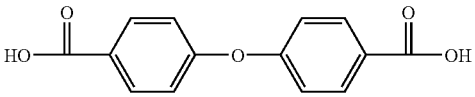

With respect to the molecular weight of the binder resin, too low molecular weights may result in insufficient mechanical strength. Conversely, when the molecular weight thereof is too high, there are cases where the coating fluid for photosensitive-layer formation has too high a viscosity, resulting in reduced productivity. Consequently, in the case where a polycarbonate resin or polyarylate resin is to be used, the viscosity-average molecular weight thereof may be in the range of from 10,000, preferably 20,000, to 100,000, preferably 70,000.

<Protective Layer and Others>

A protective layer may be formed on the photosensitive layer for the purpose of preventing electrical or mechanical deterioration. Furthermore, for the purpose of reducing the frictional resistance or friction of the surface of an electrophotographic photoreceptor, a surface layer may contain a fluororesin, silicone resin, or the like or may contain particles made of any of these resins or particles of an inorganic compound.

<Methods of Forming Photosensitive Layer>

The photosensitive layer of an electrophotographic photoreceptor of the invention can be produced in an ordinary manner by dissolving or dispersing the compound represented by formula (1) in an appropriate solvent together with a binder, optionally adding thereto a suitable charge-generating substance, sensitizing dye, electron-attracting compound, another charge-transporting substance, known additives such as a plasticizer and a pigment, etc., applying the resultant coating fluid on a conductive base, and drying the coating.

In the case of a photosensitive layer composed of two layers, i.e., a charge-generating layer and a charge-transporting layer, this photosensitive layer can be produced by applying that coating fluid on a charge-generating layer or by forming a charge-generating layer on a charge-transporting layer obtained by applying that coating fluid.

Examples of methods for photosensitive-layer formation by coating-fluid application include spray coating, spiral coating, ring coating, and dip coating. Examples of the spray coating include air spraying, airless spraying, electrostatic air spraying, electrostatic airless spraying, rotary atomization type electrostatic spraying, hot spraying, and hot airless spraying. However, when the degree of reduction into fine particles for obtaining an even film thickness, efficiency of adhesion, etc. are taken into account, it is preferred to use rotary atomization type electrostatic spraying in which the conveyance method disclosed in Domestic Re-publication of PCT Patent Application No. 1-805198, i.e., a method in which cylindrical works are successively conveyed while rotating these without spacing these in the axial direction, is used. Thus, electrophotographic photoreceptors having excellent evenness in film thickness can be obtained while attaining a comprehensively high efficiency of adhesion.

Examples of the spiral coating include: the method employing a cast coater or curtain coater disclosed in JP-A-52-119651; the method in which a coating material is caused to continuously fly in a streak form through a minute opening as disclosed in JP-A-1-231966; and the method employing a multinozzle head as disclosed in JP-A-3-193161.

In the case of dip coating, a coating fluid or dispersion may be produced in the following manners. In the case of a single-layer type photosensitive layer and of the charge-transporting layer of a multilayer type photosensitive layer, the coating fluid or dispersion is regulated so as to have a total solid concentration of preferably from 10% by mass to 50% by mass, more preferably from 15% by mass to 35% by mass, and a viscosity of 50-700 mPa·s, more preferably 100-500 mPa·s. In the case of the charge-generating layer of a multilayer type photosensitive layer, the coating fluid or dispersion is regulated so as to have a solid concentration of preferably 15% by mass or lower, more preferably 1-10% by mass, and a viscosity of 0.1-10 mPa·s.

After the formation of a coating film, the coating film is dried. Drying temperature and drying period are preferably regulated so as to conduct necessary and sufficient drying. Too high drying temperatures may be causative of air bubble inclusion into the photosensitive layer, while too low temperatures necessitate a prolonged drying time and result in cases where the photosensitive layer has an increased residual-solvent amount and this adversely influences electrical characteristics. Consequently, the drying temperature is in the range of generally 100-250° C., preferably 110-170° C., more preferably 120-140° C. For the drying, use can be made of a hot-air drying oven, steam dryer, infrared dryer, far-infrared dryer, or the like.

<Solvent or Dispersion Medium for Use in Forming Photosensitive Layer>

Examples of solvents or dispersion media usable in producing coating fluids for forming therefrom the layers constituting the electrophotographic photoreceptors include alcohols such as methanol, ethanol, propanol, and 2-methoxyethanol; ethers such as tetrahydrofuran, 1,4-dioxane, and dimethoxyethane; esters such as methyl formate and ethyl acetate; ketones such as acetone, methyl ethyl ketone, and cyclohexanone; aromatic hydrocarbons such as benzene, toluene, and xylene; chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichloroethylene; nitrogen-containing compounds such as n-butylamine, isopropanolamine, diethylamine, triethanolamine, ethylenediamine, and triethylenediamine; and aprotic polar solvents such as acetonitrile, N-methylpyrrolidone, N,N-dimethylformamide, and dimethyl sulfoxide. These solvents may be used alone or in combination of two or more thereof.

[Toner]

The toner to be used in the image-forming apparatus of the invention is explained next. The toner, which is a developer for developing latent images, preferably is a toner having a specific degree of circularity. Use of a toner having a specific degree of circularity enables the image-forming apparatus of the invention to form high-quality images.

<Average Degree of Circularity of Toner>

A preferred toner shape in the invention is as follows. The more the shapes of individual particles included in the group of particles constituting the toner are akin to each other and close to sphere, the higher the tendency that charge amount localization within the toner particles is less apt to occur and the toner has even developing ability. Such shape is preferred from the standpoint of heightening image quality. However, when the shape of the toner is too close to complete sphere, there are cases where this toner shows poor removability in cleaning after image formation and hence remains on the surface of the electrophotographic photoreceptor to foul images formed, resulting in defects. In such cases, it is necessary to conduct powerful cleaning in order to avoid cleaning failures. There are hence cases where the powerful cleaning in turn accelerates the wear or marring of the electrophotographic photoreceptor to shorten the life of the electrophotographic photoreceptor. In addition, to produce a completely spherical toner is difficult and leads to an increase in toner cost. The industrial use thereof is hence less valuable.

Consequently, the shape of the toner is specifically as follows. The toner has an average degree of circularity as determined with a flow type particle image analyzer of generally 0.940 or higher, preferably 0.950 or higher, more preferably 0.960 or higher. There is not upper limit on the average degree of circularity thereof so long as it is 1.000 or lower. However, the average degree of circularity thereof is preferably 0.995 or lower, more preferably 0.990 or lower.

The average degree of circularity in the invention is used as a simple measure in quantitatively expressing the shape of toner particles. In the invention, a measurement is made with flow type particle image analyzer FPIA-2000, manufactured by Sysmex Corp., and the degree of circularity [a] of a particle examined is determined using the following equation (A).

$$\text{Degree of circularity } a = L_0/L \quad \text{(A)}$$

[In equation (A), $L_0$ indicates the periphery length of a circle having the same projected area as the particle image; and L indicates the periphery length of the particle image obtained by image processing.]

The average degree of circularity is an index to the degree of surface irregularities of toner particles. When a toner is completely spherical, this toner has an average degree of circularity of 1.00. The more the surface shape is complicated, the smaller the degree of circularity.

A specific method of determining the average degree of circularity is as follows. A surfactant (preferably, an alkylbenzenesulfonic acid salt) is added as a dispersant to 20 mL of water which is placed in a vessel and from which impurities have been removed beforehand. Thereto is added about 0.05 g of a test sample (toner). An ultrasonic wave is propagated for 30 seconds to the resultant suspension containing the sample dispersed therein to prepare a dispersion having a concentration of $3.0\times10^3$-$8.0\times10^3$ particles per μL (microliter). This suspension is examined with the flow type particle image analyzer to determine a circularity distribution of particles having an equivalent-circle diameter of 0.60 μm to 160 μm, excluding 160 μm.

<Kind of Toner>

With respect to the kinds of toners, various toners are usually obtained according to production processes. Any of these may be used as the toner in the invention.

Processes for toner production are explained below together with the kinds of the toners produced by the processes. A toner may be produced by any method which has been known hitherto. Examples include toners produced by the polymerization method, melt suspension method, etc. Also usable is a toner obtained by rounding a so-called pulverization toner by a treatment with, e.g., heat. However, a toner produced by the so-called polymerization method in which toner particles are yielded in an aqueous medium is preferred.

Examples of the polymerization toner include suspension polymerization toners and emulsion polymerization aggregation toners. In particular, the emulsion polymerization aggregation method, which is a process in which fine polymer resin particles are aggregated together with a colorant, etc. in a liquid medium to produce a toner, is preferred because the particle diameter and degree of circularity of the toner can be regulated by controlling aggregation conditions.

A technique has been proposed in which a substance having a low softening point (e.g., a wax) is incorporated into a toner in order to improve the releasability, low-temperature fixability, high-temperature non-offset properties, non-filming properties, or other properties of the toner. In a melt kneading pulverization method, it is difficult to increase the amount of a wax to be incorporated into a toner, and about 5% by mass based on the polymer (binder resin) is regarded as a limit. In contrast, in the case of a polymerization toner, it is possible to incorporate a low-softening-point substance in a large amount (5-30% by mass). Incidentally, the term "polymer" herein means one of the materials constituting a toner. For example, in the case of a toner produced by the emulsion polymerization aggregation method which will be described below, the term "polymer" means a material obtained by polymerizing one or more polymerizable monomers.

The toner produced by the emulsion polymerization aggregation method is explained in more detail. In the case of producing a toner by the emulsion polymerization aggregation method, the production steps generally include a polymerization step, mixing step, aggregation step, fusion step, and washing/drying step. Namely, the process generally includes: conducting emulsion polymerization to obtain primary polymer particles (polymerization step); optionally mixing a dispersion of a colorant (pigment), wax, charge control agent, etc. with the resultant dispersion containing the primary polymer particles (mixing step); adding a coagulant to the resultant dispersion to aggregate the primary particles and thereby obtain particle aggregates (aggregation step); optionally conducting an operation for adhering fine particles, etc.; subsequently fusing the primary particles in each aggregate to obtain particles (fusion step); and washing and drying the resultant particles (washing/drying step) to obtain base particles.

(Polymerization Step)

The fine particles of a polymer (primary polymer particles) are not particularly limited. Consequently, either of fine particles obtained by polymerizing one or more polymerizable monomers in a liquid medium by the suspension polymerization method, emulsion polymerization method, or the like and fine particles obtained by pulverizing a lump of a polymer, e.g., a resin, may be used as the primary polymer particles. However, primary polymer particles obtained by polymerization, in particular by emulsion polymerization especially using a wax as seeds, are preferred. When a wax is used as seeds in emulsion polymerization, fine particles having a structure constituted of a polymer and the wax encapsulated therein can be produced as primary polymer particles. By this method, a wax can be incorporated into inner parts of toner particles without being exposed on the surface of the toner. Because of this, the wax thus incorporated is prevented from fouling apparatus members, does not impair the electrification characteristics of the toner, and can improve the low-temperature fixability, high-temperature non-offset properties, non-filming properties, releasability, and other properties of the toner.

The method in which a wax is used as seeds to conduct emulsion polymerization and thereby obtain primary polymer particles is explained below. The emulsion polymerization may be conducted by a method which has been known hitherto. Usually, the following procedure is used. A wax is dispersed in a liquid medium in the presence of an emulsifying agent to obtain fine wax particles. This dispersion is mixed with a polymerization initiator and one or more polymerizable monomers which give a polymer through polymerization, i.e., one or more compounds having a polymerizable carbon-carbon double bond, and optionally with a chain transfer agent, pH regulator, polymerization degree regulator, antifoamer, protective colloid, internal additive, etc. The monomers are polymerized while stirring the resultant mixture. Thus, an emulsion is obtained in which fine polymer particles having a structure constituted of a polymer and the wax encapsulated therein (i.e., primary polymer particles) are dispersed in the liquid medium. Examples of the structure constituted of a polymer and a wax encapsulated therein include the core-shell type, phase separation type, and occlusion type. However, the core-shell type is preferred.

(i. Wax)

As the wax, any desired one which is known to be usable in this application can be employed. Examples thereof include olefin waxes such as low-molecular polyethylene, low-molecular polypropylene, and polyethylene copolymers; paraffin waxes; silicone waxes having an alkyl group; fluororesin waxes such as low-molecular polytetrafluoroethylene; higher fatty acids such as stearic acid; long-chain aliphatic alcohols such as eicosanol; ester waxes having one or more long-chain aliphatic groups, such as behenyl behenate, montanic esters, and stearyl stearate; ketones having one or more long-chain alkyl groups, such as distearyl ketone; vegetable waxes such as hydrogenated castor oil and carnauba wax; esters or partly esterified compounds obtained from a polyhydric alcohol, e.g., glycerol or pentaerythritol, and a long-chain fatty acid; higher fatty acid amides such as oleamide and stearamide; and low-molecular polyesters. Preferred of these are waxes having at least one endothermic peak at 50-100° C. in differential thermal analysis (DSC).

Furthermore, ester waxes, paraffin waxes, olefin waxes such as low-molecular polypropylene and polyethylene copolymers, silicone waxes, and the like are preferred of those waxes because these are effective in imparting releasability even when used in a small amount. In particular, paraffin waxes are preferred. One wax may be used alone, or any desired combination of two or more waxes in any desired proportion may be used.

In the case of using a wax, the amount of the wax to be used is not limited. However, the amount of the wax to be used per 100 parts by mass of the polymer is generally 3 parts by mass or larger, preferably 5 parts by mass or larger, and is generally 40 parts by mass or smaller, preferably 30 parts by mass or smaller. Too small wax amounts may result in cases where the width of fixing temperatures is insufficient. Too large wax amounts may result in cases where the wax fouls apparatus members to reduce image quality.

(ii. Emulsifying Agent)

The emulsifying agent is not limited, and any desired one can be used unless this considerably lessens the effects of the invention. For example, any of nonionic, anionic, cationic, and amphoteric surfactants can be used.

Examples of the nonionic surfactant include polyoxyalkylene alkyl ethers such as polyoxyethylene lauryl ether, polyoxyalkylene alkylphenyl ethers such as polyoxyethylene octylphenyl ether, and sorbitan/fatty acid esters such as sorbitan monolaurate.

Examples of the anionic surfactant include fatty acid salts such as sodium stearate and sodium oleate, alkylarylsulfonic acid salts such as sodium dodecylbenzenesulfonate, and sulfuric acid alkyl ester salts such as sodium lauryl sulfate. Examples of the cationic surfactant include alkylamine salts such as laurylamine acetate and quaternary ammonium salts such as lauryltrimethylammonium chloride. Examples of the amphoteric surfactant include alkylbetaines such as laurylbetaines. Preferred of these are nonionic surfactants and anionic surfactants. One emulsifying agent may be used alone, or any desired combination of two or more emulsifying agents may be used in any desired proportion.

The amount of the emulsifying agent to be added is not limited unless the effects of the invention are considerably lessened thereby. However, the emulsifying agent is used in an amount of generally 1-10 parts by mass per 100 parts by mass of the polymerizable monomer(s).

(iii. Liquid Medium)

As the liquid medium, an aqueous medium is generally used. Especially preferably, water is used. It is, however, noted that the nature of a liquid medium affects the enlargement by re-aggregation of particles in the liquid medium. Use of a liquid medium having a high conductivity tends to result in impaired long-term dispersion stability. Consequently, when an aqueous medium such as, e.g., water is employed, it is preferred to use desalted ion-exchanged water or distilled water so as to attain a conductivity of generally 10 μS/cm or lower, preferably 5 μS/cm or lower. A measurement of conductivity is made with a conductivity meter (Personal SC Meter Model SC72 and detector SC72SN-11, both manufactured by Yokogawa Electric Corporation) at 25° C. There are no limitations on the amount of the liquid medium to be used. However, the liquid medium is used generally in an amount of about 1-20 times by mass the amount of the polymerizable monomer(s).

The wax is dispersed in the liquid medium in the presence of an emulsifying agent to thereby obtain fine wax particles. The sequence of adding the emulsifying agent and the wax to the liquid medium is not limited. Usually, however, the emulsifying agent is first added to the liquid medium, and the wax is then mixed therewith. The emulsifying agent may be continuously added to the liquid medium.

(iv. Polymerization Initiator)

After the preparation of fine wax particles, a polymerization initiator is added to the liquid medium. As the polymerization initiator, any desired one can be used unless this considerably lessens the effects of the invention. Examples thereof include persulfates such as sodium persulfate and ammonium persulfate; organic peroxides such as t-butyl hydroperoxide, cumene hydroperoxide, and p-menthane hydroperoxide; and inorganic peroxides such as hydrogen peroxide. Preferred of these are inorganic peroxides. One polymerization initiator may be used alone, or any desired combination of two or more polymerization initiators may be used in any desired proportion.

Other examples of the polymerization initiator include a redox initiator which is a combination of any of persulfates and organic or inorganic peroxides with a reducing organic compound, e.g., ascorbic acid, tartaric acid, or citric acid, a reducing inorganic compound, e.g., sodium thiosulfate, sodium bisulfite, or sodium metabisulfite, or the like. In this case, one reducing inorganic compound only may be used, or any desired combination of two or more reducing inorganic compounds in any desired proportion may be used. The polymerization initiator may be used in any desired amount without limitations. However, the polymerization initiator is used generally in an amount of 0.05-2 parts by mass per 100 parts by mass of the polymerizable monomer(s).

(v. Polymerizable Monomers)

After the preparation of fine wax particles, one or more polymerizable monomers are added to the liquid medium besides the polymerization initiator. The polymerizable monomers are not particularly limited. For example, monofunctional monomers are mainly used, such as styrene compounds, (meth)acrylic esters, acrylamide compounds, monomers having a Brφnsted acidic group (hereinafter sometimes referred to simply as "acidic monomers"), and monomers having a Brφnsted basic group (hereinafter sometimes referred to simply as "basic monomers"). Such monofunctional monomers may be used in combination with a polyfunctional monomer.

Examples of the styrene compounds include styrene, methylstyrene, chlorostyrene, dichlorostyrene, p-tert-butylstyrene, p-n-butylstyrene, and p-n-nonylstyrene. Examples of the (meth)acrylic esters include methyl acrylate, ethyl acrylate, propyl acrylate, n-butyl acrylate, isobutyl acrylate, hydroxyethyl acrylate, 2-ethylhexyl acrylate, methyl methacrylate, ethyl methacrylate, propyl methacrylate, n-butyl methacrylate, isobutyl methacrylate, hydroxyethyl methacrylate, and 2-ethylhexyl methacrylate. Examples of the acrylamide compounds include acrylamide, N-propylacrylamide, N,N-dimethylacrylamide, N,N-dipropylacrylamide, and N,N-dibutylacrylamide.

Examples of the acidic monomers include monomers having one or more carboxyl groups, such as acrylic acid, methacrylic acid, maleic acid, fumaric acid, and cinnamic acid; monomers having a sulfo group, such as sulfonated styrene; and monomers having a sulfonamide group, such as vinylbenzenesulfonamide. Examples of the basic monomers include aromatic vinyl compounds having an amino group, such as aminostyrene; monomers containing a nitrogenous heterocycle, such as vinylpyridine and vinylpyrrolidone; and (meth)acrylic esters having an amino group, such as dimethylaminoethyl acrylate and diethylaminoethyl methacrylate. The acidic monomers and the basic monomers may be present as salts including a counter ion.

Examples of the polyfunctional monomer include divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol diacrylate, and diallyl phthalate. It is also possible to use monomers having a reactive group, such as glycidyl methacrylate, N-methylolacrylamide, and acrolein. Preferred of these are the radical-polymerizable bifunctional monomers. Especially preferred are divinylbenzene and hexanediol diacrylate.

It is preferred that the polymerizable monomer(s) should be constituted at least of a styrene compound, (meth)acrylic ester, or acidic monomer having one or more carboxyl groups of those monomers. In particular, the styrene compound preferably is styrene, the (meth)acrylic ester preferably is butyl acrylate, and the acidic monomer having one or more carboxyl groups preferably is acrylic acid. One polymerizable monomer may be used alone, or any desired combination of two or more polymerizable monomers may be used in any desired proportion.

When emulsion polymerization is conducted using a wax as seeds, it is preferred to use an acidic monomer or basic monomer in combination with one or more other monomers. This is because use of the combination including an acidic monomer or basic monomer is effective in yielding primary polymer particles having improved dispersion stability.

In this case, the amount of the acidic monomer or basic monomer to be added is not limited. It is, however, desirable that the amount of the acidic monomer or basic monomer to be used should be regulated to generally 0.05 parts by mass or larger, preferably 0.5 parts by mass or larger, more preferably 1 part by mass or larger, and to generally 10 parts by mass or smaller, preferably 5 parts by mass or smaller, per 100 parts by mass of all polymerizable monomers. When the acidic monomer or basic monomer is added in an amount smaller than that range, there are cases where the resultant primary polymer particles have impaired dispersion stability. When the amount thereof exceeds the upper limit, there are cases where an adverse influence is exerted on the electrification characteristics of the toner.

In the case where a polyfunctional monomer is also used, the amount of this monomer to be added is not limited. However, the amount of the polyfunctional monomer to be added is generally 0.005 parts by mass or larger, preferably 0.1 part by mass or larger, more preferably 0.3 parts by mass or larger, and is generally 5 parts by mass or smaller, preferably 3 parts by mass or smaller, more preferably 1 part by mass or smaller, per 100 parts by mass of the polymerizable monomers. Use of a polyfunctional monomer is effective in improving the fixability of the toner. In this case, when the polyfunctional monomer is added in an amount smaller than that range, there are cases where poor high-temperature non-offset properties result. When the amount thereof exceeds the upper limit, there are cases where poor low-temperature fixability results.

Methods for adding a polymerizable monomer to the liquid medium are not particularly limited, and any of, for example, en bloc addition, continuous addition, and intermittent addition may be employed. However, from the standpoint of reaction control, it is preferred to continuously add the monomer. In the case where two or more polymerizable monomers are used in combination, the polymerizable monomers may be separately added or may be added after having been mixed together. It is also possible to add a monomer mixture while changing the composition thereof.

(vi. Chain Transfer Agent, Etc.)

After the preparation of fine wax particles, additives such as a chain transfer agent, pH regulator, polymerization degree regulator, antifoamer, protective colloid, and internal additive may be added to the liquid medium according to need besides the polymerization initiator and polymerizable monomers. As those additives, any desired ones can be used unless the effects of the invention are considerably lessened thereby. One of those additives may be used alone, or any desired combination of two or more thereof may be used in any desired proportion.

As the chain transfer agent, any known one can be used. Examples thereof include t-dodecyl mercaptan, 2-mercaptoethanol, diisopropylxanthogen, carbon tetrachloride, and trichlorobromomethane. The chain transfer agent may be used in an amount of generally 5 parts by mass or smaller per 100 parts by mass of the polymerizable monomers.

As the protective colloid, use can be made of any one which is known to be usable in this application. Examples thereof include poly(vinyl alcohol)s such as partly or wholly saponified poly(vinyl alcohol) and cellulose derivatives such as hydroxyethyl cellulose.

Examples of the internal additive include ones for modifying the adhesiveness, aggregating properties, flowability, electrification characteristics, surface resistance, or other properties of the toner, such as silicone oils, silicone varnishes, and fluorochemical oils.

(vii. Primary Polymer Particles)

The polymerization initiator and the polymerizable monomers are mixed, optionally together with additives, with the liquid medium containing fine wax particles. The resultant mixture is stirred and the monomers are polymerized to thereby obtain primary polymer particles. These primary polymer particles can be obtained in the state of an emulsion in the liquid medium.

There are no limitations on the sequence of mixing the polymerization initiator, polymerizable monomers, additives, etc. with the liquid medium. Mixing/stirring methods and the like also are not limited, and any desired method may be used. Furthermore, any desired reaction temperature may be used for the polymerization (emulsion polymerization reaction) so long as the reaction proceeds. However, the polymerization temperature is generally 50° C. or higher, preferably 60° C. or higher, more preferably 70° C. or higher, and is generally 120° C. or lower, preferably 100° C. or lower, more preferably 90° C. or lower.

The primary polymer particles are not particularly limited in volume-average particle diameter. However, the volume-average particle diameter thereof is generally 0.02 μm or larger, preferably 0.05 μm or larger, more preferably 0.1 μm or larger, and generally 3 μm or smaller, preferably 2 μm or smaller, more preferably 1 μm or smaller. When the volume-average particle diameter thereof is too small, there are cases where it is difficult to control the rate of aggregation. When the volume-average particle diameter thereof is too large, there are cases where aggregation gives a toner having too large a particle diameter and it is difficult to obtain a toner having a target particle diameter. Volume-average particle diameter is determined with the particle size analyzer which will be described below, which operates by the dynamic light-scattering method.

In the invention, volume particle size distribution is determined by the dynamic light scattering method. In this method, the speed of Brownian movement of particles which have been finely dispersed is determined by irradiating the particles with a laser light and detecting the scattering of lights differing in phase according to the speed (Doppler shift) to determine the particle size distribution. An actual examination for determining the volume particle diameter is made with a particle size distribution analyzer for ultrafine particles (UPA-EX150, manufactured by Nikkiso Co., Ltd.; hereinafter sometimes abbreviated to "UPA-EX"), which operates by the dynamic light scattering method, under the following conditions.

Upper limit of measurement: 6.54 μm
Lower limit of measurement: 0.0008 μm
Number of channels: 52
Examination period: 100 sec
Examination temperature: 25° C.
Particle transparency: absorption
Refractive index of particle: N/A (not applied)
Particle shape: non-spherical
Density: 1 g/cm$^3$
Kind of dispersion medium: water
Refractive index of the dispersion medium: 1.333

Before being examined, a dispersion of particles is diluted with a liquid medium so as to result in a sample concentration index in the range of 0.01-0.1. The dispersion diluted is subjected to a dispersing treatment with an ultrasonic cleaner and the resultant sample is examined. The volume-average particle diameter in the invention is defined as the arithmetic average of results concerning the volume particle size distribution.

The polymer constituting the primary polymer particles may be one in which at least one of the peak molecular weights measured by gel permeation chromatography is generally 3,000 or higher, preferably 10,000 or higher, more preferably 30,000 or higher, and is generally 100,000 or lower, preferably 70,000 or lower, more preferably 60,000 or lower. When the polymer has a peak molecular weight within that range, the primary particles tend to give a toner satisfactory in durability, storability, and fixability. The peak molecular weights herein mean values calculated for standard polystyrene, and the ingredients insoluble in the solvent are removed before the examination. The peak molecular weights can be determined in the same manner as for the toner which will be described later.

Especially when the polymer is a styrene resin, this polymer may have a number-average molecular weight, as determined by gel permeation chromatography, which has a lower limit of generally 2,000 or higher, preferably 2,500 or higher, more preferably 3,000 or higher, and has an upper limit of generally 50,000 or lower, preferably 40,000 or lower, more preferably 35,000 or lower. This polymer may further have a weight-average molecular weight which has a lower limit of generally 20,000 or higher, preferably 30,000 or higher, more preferably 50,000 or higher, and has an upper limit of generally 1,000,000 or lower, preferably 500,000 or lower. This is because when a styrene resin in which at least one of the number-average molecular weight and weight-average molecular weight, preferably each of these, is within that range is used as the polymer, then a toner satisfactory in durability, storability, and fixability is obtained therefrom. The styrene resin may be one which has a molecular weight distribution including two main peaks. The term styrene resin means a polymer in which generally 50% by mass or more, preferably 65% by mass or more, of the whole polymer is accounted for by one or more styrene compounds.

It is preferred from the standpoint of low-energy fixing that the polymer should have a softening point (hereinafter sometimes abbreviated at "Sp") of generally 150° C. or lower, preferably 140° C. or lower. From the standpoints of high-temperature non-offset properties and durability, it is preferred that the softening point thereof should be generally 80° C. or higher, preferably 100° C. or higher. The softening point of a polymer herein can be determined through an examination in which 1.0 g of a sample is examined with a flow tester under the conditions of a nozzle of 1 mm×10 mm, load of 30 kg, preheating time of 5 minutes at 50° C., and heating rate of 3° C./min. The temperature of the intermediate point in the strand during the period from the initiation to the termination of flow is taken as the softening point of the polymer.

Furthermore, the polymer may have a glass transition temperature (Tg) of generally 80° C. or lower, preferably 70° C. or lower. When the glass transition temperature (Tg) of the polymer is too high, there are cases where low-energy fixing is impossible. The lower limit of the glass transition temperature (Tg) of the polymer is generally 40° C. or higher, preferably 50° C. or higher. When the glass transition temperature (Tg) of the polymer is too low, there are cases where non-blocking properties decrease. The glass transition temperature (Tg) of a polymer herein is determined from a curve obtained through an examination with a differential scanning calorimeter under the conditions of a heating rate of 10° C./min. Specifically, a tangent is drawn to the curve at each of the transition (inflection) initiation points, and the temperature corresponding to the intersection of the two tangents is taken as the glass transition temperature. A polymer having a softening point and a glass transition temperature (Tg) which are within those ranges can be obtained by regulating the kind of the polymer, monomer proportion, molecular weight, etc.

(Mixing Step and Aggregation Step)

An emulsion containing the primary polymer particles dispersed therein is mixed with pigment particles, and the primary particles and pigment particles are aggregated to thereby obtain an emulsion of aggregates (aggregated particles) including the polymer and the pigment. It is preferred in this operation that a pigment particle dispersion prepared beforehand by evenly dispersing the pigment in a liquid medium with a surfactant or the like should be mixed with the emulsion of primary polymer particles. In this case, an aqueous solvent such as, e.g., water is usually used as the liquid medium for the pigment particle dispersion to prepare the pigment particle dispersion as an aqueous dispersion. Furthermore, a wax, charge control agent, release agent, internal additive, etc. may be mixed with the emulsion in this operation according to need. The emulsifying agent described above may also be added in order to maintain the stability of the pigment particle dispersion.

As the primary polymer particles, use can be made of the primary polymer particles obtained by emulsion polymerization. In this case, one kind of primary polymer particles may be used, or any desired combination of two or more kinds of primary polymer particles may be used in any desired proportion. Furthermore, primary polymer particles produced by a process differing in raw materials and conditions from the emulsion polymerization described above (hereinafter often referred to as "optional polymer particles") may also be used.

Examples of the optional polymer particles include fine particles obtained by suspension polymerization or pulverization. A resin can be used as a material for such optional polymer particles. Besides (co)polymers of the monomers which can be subjected to the emulsion polymerization described above, examples of that resin include thermoplastic resins such as homopolymers or copolymers of vinyl monomers, e.g., vinyl acetate, vinyl chloride, vinyl alcohol, vinyl butyral, and vinylpyrrolidone, saturated polyester resins, polycarbonate resins, polyamide resins, polyolefin resins, polyarylate resins, polysulfone resins, and poly(phenylene ether) resins and thermosetting resins such as unsaturated polyester resins, phenol resins, epoxy resins, urethane resins, and rosin-modified maleic acid resins. With respect to such optional polymer particles also, one kind only may be used or any desired combination of two or more kinds may be used in any desired proportion. However, the proportion of the optional polymer particles is generally 5% by mass or smaller, preferably 4% by mass or smaller, more preferably 3% by mass or smaller, based on the sum of the polymers constituting the primary polymer particles and optional polymer particles.

The pigment is not limited, and any desired pigment can be used according to the application. Although pigments are usually present in a particulate form as colorant particles, it is preferred that the difference in density between the pigment particles to be used here and the primary polymer particles produced by the emulsion polymerization aggregation method should be smaller. This is because a smaller difference in density between these enables the aggregation of the primary polymer particles and the pigment to give an even aggregated state, resulting in improved toner performances. Incidentally, the primary polymer particles have a density of generally 1.1-1.3 g/cm$^3$.

From that standpoint, the true density of the pigment particles, as measured by the pycnometer method as provided for in JIS K 5101-11-1:2004, is generally 1.2 g/cm$^3$ or higher, preferably 1.3 g/cm$^3$ or higher, and is generally lower than 2.0 g/cm$^3$, preferably 1.9 g/cm$^3$ or lower, more preferably 1.8 g/cm$^3$ or lower. When the pigment has a high true density, there are cases where the pigment shows enhanced sedimentation especially in the liquid medium. In view of this and problems concerning storability, susceptibility to sublimation, etc., the pigment preferably is a carbon black or an organic pigment.

Examples of pigments which satisfy those requirements include the yellow pigments, magenta pigments, and cyan pigments which will be shown later. As a black pigment, use may be made of a carbon black or a pigment prepared so as to have a black color by mixing a yellow pigment, magenta pigment, and cyan pigment among those shown later.

Of those pigments, the carbon black to be used as a black pigment is present as aggregates of extremely fine primary particles. When dispersed for preparing a pigment particle dispersion, the carbon black particles are apt to enlarge due to re-aggregation. The degree of carbon black particle re-aggregation correlates to the amount of impurities (amount of residual undecomposed organic substances) contained in the carbon black. Large impurity amounts tend to enhance the enlargement of dispersed particles due to re-aggregation.

With respect to a quantitative measure of impurity amount, a toluene extract of a carbon black has an ultraviolet absorbance, as determined by the following examination method, of generally 0.05 or lower, preferably 0.03 or lower. In general, carbon blacks produced by the channel process tend to contain a larger amount of impurities. Consequently, the carbon black to be used in the toner in the invention preferably is one produced by the furnace process.

The ultraviolet absorbance ($\lambda c$) of a carbon black is determined by the following method. First, 3 g of the carbon black is sufficiently dispersed in and mixed with 30 mL of toluene. Subsequently, this liquid mixture is filtered through a No. 5 filter paper. Thereafter, the filtrate is placed in a quartz cell having a 1 cm-square absorption area and examined with a commercial ultraviolet spectrophotometer to measure the absorbance at a wavelength of 336 nm ($\lambda s$). Toluene only as a reference is examined for the value of absorbance ($\lambda o$) by the same method. From the values of $\lambda s$ and $\lambda o$, the ultraviolet absorbance is determined using $\lambda c=\lambda s-\lambda o$. Examples of the commercial spectrophotometer include an ultraviolet/visible spectrophotometer (UV-3100PC) manufactured by Shimadzu Corp.

Examples of yellow pigments include compounds represented by condensation azo compounds and isoindoline compounds. Specifically, C.I. Pigment Yellows 12, 13, 14, 15, 17, 62, 74, 83, 93, 94, 95, 109, 110, 111, 128, 129, 147, 168, 180, and 185 and the like are preferred.

Examples of magenta pigments include condensation azo compounds, diketopyrrolopyrrole compounds, anthraquinone, quinacridone compounds, basic dye lakeu compounds, naphthol compounds, benzimidazolone compounds, thioindigo compounds, and perylene compounds. Specifically, C.I. Pigment Reds 2, 3, 5, 6, 7, 23, 48:2, 48:3, 48:4, 57:1, 81:1, 122, 144, 146, 166, 169, 177, 184, 185, 202, 206, 207, 209, 220, 221, 238, and 254, C.I. Pigment Violet 19, and the like are preferred. More preferred of these are quinacridone pigments represented by C.I. Pigment Reds 122, 202, 207, and 209 and C.I. Pigment Violet 19. These quinacridone pigments are suitable for use as magenta pigments because of their bright hue, high light resistance, etc. Especially preferred of the quinacridone pigments are compounds represented by C.I. Pigment Red 122.

Examples of cyan pigments include copper phthalocyanine compounds and derivatives thereof, anthraquinone compounds, and basic dye lake compounds. Specifically, C.I. Pigment Blues 1, 7, 15, 15:1, 15:2, 15:3, 15:4, 60, 62, and 66 and the like are preferred. One pigment may be used alone, or any desired combination of two or more pigments may be used in any desired proportion.

The pigment is dispersed in a liquid medium to prepare a pigment particle dispersion, and this dispersion is mixed with the emulsion containing primary polymer particles. In this operation, the amount of the pigment particles to be used in the pigment particle dispersion is generally 3 parts by mass or larger, preferably 5 parts by mass or larger, and is generally 50 parts by mass or smaller, preferably 40 parts by mass or smaller, per 100 parts by mass of the liquid medium. When the colorant is added in an amount exceeding that range, there are cases where the dispersion has too high a pigment concentration and the pigment particles re-aggregate in the dispersion. When the amount thereof is smaller than that range, there are cases where the pigment particles are excessively dispersed and it is difficult to obtain a proper particle size distribution.

Furthermore, the proportion of the pigment to be used to the polymer contained in the primary polymer particles is generally 1% by mass or larger, preferably 3% by mass or larger, and is generally 20% by mass or smaller, preferably 15% by mass or smaller. When the pigment is used in too small an amount, there are cases where a reduced image density results. Too large pigment amounts may result in cases where aggregation control is difficult.

A surfactant may be further incorporated into the pigment particle dispersion. This surfactant is not particularly limited. Examples thereof include the same surfactants as those shown above as examples of the emulsifying agent in the explanation of the emulsion polymerization method. Preferred of these are nonionic surfactants, anionic surfactants such as alkylarylsulfonic acid salts, e.g., sodium dodecylbenzenesulfonate, polymeric surfactants, and the like. In this case, one surfactant may be used alone, or any desired combination of two or more surfactants may be used in any desired proportion.

The proportion of the pigment in the pigment particle dispersion may be generally 10-50% by mass. As the liquid medium for the pigment particle dispersion, an aqueous medium is generally used. Preferably, the medium is water. In this connection, it is noted that the nature of the water in the primary polymer particles and in the pigment particle dispersion affects the enlargement by re-aggregation of the two kinds of particles. There are cases where use of a liquid medium having a high conductivity impairs long-term dispersion stability. Consequently, it is preferred to use desalted ion-exchanged water or distilled water so as to attain a conductivity of generally 10 μS/cm or lower, preferably 5 μS/cm or lower. A measurement of conductivity is made with a conductivity meter (Personal SC Meter Model SC72 and detector SC72SN-11, both manufactured by Yokogawa Electric Corporation) at 25° C.

When the pigment is mixed with the emulsion containing primary polymer particles, a wax may be mixed with the emulsion. As the wax, use can be made of any of the same waxes as those described above in the explanation of the emulsion polymerization method. The wax may be added at any timing, i.e., either before, during, or after the mixing of the pigment with the emulsion containing primary polymer particles.

Furthermore, a charge control agent may be mixed with the emulsion containing primary polymer particles when the pigment is mixed with the emulsion. As the charge control agent, use can be made of any desired one which is known to be usable in this application. Examples of positive charge type charge control agents include Nigrosine dyes, quaternary ammonium salts, triphenylmethane compounds, imidazole compounds, and polyamine resins. Examples of negative charge type charge control agents include azo complex dyes containing an atom of, e.g., Cr, Co, Al, Fe, or B, metal salts or metal complexes of salicylic acid or alkylsalicylic acids, calixarene compounds, metal salts or metal complexes of benzilic acid, amide compounds, phenol compounds, naphthol compounds, and phenolamide compounds. Of these charge control agents, ones which are colorless or have a light color are preferred from the standpoint of avoiding a color tone trouble. In particular, quaternary ammonium salts and imidazole compounds are preferred positive charge type charge control agents, and alkylsalicylic acid complexes containing an atom of, e.g., Cr, Co, Al, Fe, or B and calixarene compounds are preferred negative charge type charge control agents. One charge control agent may be used alone, or any desired combination of two or more charge control agents may be used in any desired proportion.

The amount of the charge control agent to be used is not limited. However, the amount thereof is generally 0.01 part by mass or larger, preferably 0.1 part by mass or larger, and is generally 10 parts by mass or smaller, preferably 5 parts by mass or smaller, per 100 parts by mass of the polymer. When the amount of the charge control agent used is either too small or too large, there are cases where a desired charge amount is not obtained.

The charge control agent may be added at any timing, i.e., either before, during, or after the mixing of the pigment with the emulsion containing primary polymer particles. It is preferred that the charge control agent should be brought into the state of being emulsified in a liquid medium (usually an aqueous medium), like the pigment particles, and mixed in this state at the time of aggregation.

After the pigment has been mixed with the emulsion containing primary polymer particles, the primary polymer particles and the pigment are aggregated. As described above, the pigment is usually mixed as a pigment particle dispersion. Methods for aggregation are not limited, and any desired method may be used. Examples thereof include heating, electrolyte addition, and pH regulation. Of these, aggregation by electrolyte addition is preferred.

In the case where aggregation is conducted by adding an electrolyte, examples of the electrolyte include chlorides such as NaCl, KCl, LiCl, $MgCl_2$, and $CaCl_2$; inorganic salts such as sulfuric acid salts, e.g., $Na_2SO_4$, $K_2SO_4$, $Li_2SO_4$, $MgSO_4$, $CaSO_4$, $ZnSO_4$, $Al_2(SO_4)_3$, and $Fe_2(SO_4)_3$; and organic salts such as $CH_3COONa$ and $C_6H_5SO_3Na$. Preferred of these are the inorganic salts having one or more polyvalent metal cations having a valence of 2 or higher. One electrolyte may be used alone, or any desired combination of two or more electrolytes may be used in any desired proportion.

The amount of the electrolyte to be used varies depending on the kind of the electrolyte. However, the amount thereof is generally 0.05 parts by mass or larger, preferably 0.1 part by mass or larger, and is generally 25 parts by mass or smaller, preferably 15 parts by mass or smaller, more preferably 10 parts by mass or smaller, per 100 parts by mass of the solid components of the emulsion. In case where the amount of the electrolyte used for conducting aggregation by electrolyte addition is too small, the progress of an aggregation reaction is slow and this may pose problems, for example, that the product of the aggregation reaction contains residual fine particles of 1 μm or smaller and the average particle diameter of the aggregates obtained is smaller than a target particle diameter. In case where the electrolyte is used in too large an amount, an aggregation reaction proceeds rapidly and it is hence difficult to control particle diameter. There are hence cases where the aggregates obtained include coarse particles and particles of irregular shapes.

It is preferred that the aggregates obtained should be successively heated in the liquid medium, like the secondary aggregates which will be described later (aggregates which have undergone the fusion step), and rounded. The heating may be conducted under the same conditions as for the secondary aggregates (the same conditions as those which will be described in the explanation of the fusion step).

On the other hand, in the case where aggregation is conducted by heating, any desired temperature conditions may be used so long as aggregation proceed. Specifically, examples of temperature conditions under which aggregation is conducted include a temperature which is generally 15° C. or higher, preferably 20° C. or higher, and is not higher than the glass transition temperature (Tg) of the polymer constituting the primary polymer particles, preferably not higher than 55° C. The period of aggregation also is not limited. However, the period of aggregation is generally 10 minutes or longer, preferably 60 minutes or longer, and is generally 300 minutes or shorter, preferably 180 minutes or shorter. It is preferred to conduct stirring during the aggregation. Although the apparatus to be used for the stirring is not particularly limited, one having a double-helical blade is preferred.

The aggregates obtained may be subjected, without undergoing any treatment, to the next step of forming a resinous coating layer (encapsulation step). Alternatively, the aggregates obtained may be subjected successively to a fusion treatment with heating in the liquid medium and then to an encapsulation step. It is desirable that the aggregation step should be followed by an encapsulation step and the encapsulated aggregates be heated at a temperature not lower than the glass transition temperature (Tg) of the encapsulant-resin fine particles to thereby conduct a fusion step. This method is preferred because step simplification can be attained and the resultant toner does not suffer deterioration in performance (e.g., thermal deterioration).

(Encapsulation Step)

It is preferred that after aggregates have been obtained, a resinous coating layer should be formed on the aggregates according to need. The encapsulation step for forming a resinous coating layer on the aggregates is a step in which a resinous coating film is formed on the surface of the aggregates to thereby coat the aggregates with the resin. Consequently, the resultant aggregates give a toner having a resinous coating layer. There are cases where the toner is not completely coated in the encapsulation step. However, a toner in which the pigment is not substantially exposed in the surface of the toner particles can be obtained. Although the thickness of the resinous coating layer in this step is not limited, it is generally in the range of 0.01-0.5 μm.

Methods for forming the resinous coating layer are not particularly limited. Examples thereof include the spray drying method, method of mechanically combining particles, in-situ polymerization method, and in-liquid particle-coating method. For forming a resinous coating layer by the spray drying method, use may, for example, be made of a technique in which the aggregates for forming an inner layer and fine resin particles for forming a resinous coating layer are dispersed in an aqueous medium to produce a dispersion and this dispersion is spray-dried, whereby a resinous coating layer can be formed on the surface of the aggregates.

The method of mechanically combining particles for forming a resinous coating layer is, for example, a method in which the aggregates for forming an inner layer and fine resin particles for forming a resinous coating layer are dispersed in a gas phase and a mechanical force is applied to the dispersed aggregates and fine particles within a narrow gap to thereby form a film of the fine resin particles on the surface of the aggregates. For this method, use can be made of apparatus such as, e.g., Hybridization System (manufactured by Nara Machinery Co., Ltd.) and Mechanofusion System (manufactured by Hosokawa Micron Corp.).

The in-situ polymerization method is, for example, a method which includes dispersing the aggregates in water, mixing a monomer and a polymerization initiator with the dispersion to adsorb the monomer and initiator onto the surface of the aggregates, and heating the resultant mixture to polymerize the monomer and thereby form a resinous coating layer on the surface of the aggregates each serving as an inner layer.

The in-liquid particle-coating method is, for example, a method in which the aggregates for forming an inner layer are reacted or combined in an aqueous medium with fine resin particles for forming an outer layer to thereby form a resinous coating layer on the surface of the aggregates each constituting an inner layer.

The fine resin particles to be used in forming an outer layer are particles having a smaller particle diameter than the aggregates and constituted mainly of a resinous ingredient. These fine resin particles are not particularly limited so long as they are particles constituted of a polymer. However, it is preferred to use fine particles of the same resin as that of the primary polymer particles or aggregates described above or that of particles obtained by the fusion of the aggregates, because use of such fine particles renders the thickness of the outer layer controllable. These fine particles of the same resin as that of the primary polymer particles or the like can be produced in the same manners as for the primary polymer particles in the aggregates for use as an inner layer.

The amount of the fine resin particles to be used is not limited. However, the amount thereof is generally 1% by mass or larger, preferably 5% by mass or larger, and is generally 50% by mass or smaller, preferably 25% by mass or smaller, based on the whole toner particles. From the standpoint of effectively conducting the bonding or fusion of fine resin particles to the aggregates, it is preferred that the fine resin particles should have a particle diameter of generally about 0.04-1 μm.

The glass transition temperature (Tg) of the polymeric ingredient (resinous ingredient) for use in forming a resinous coating layer is generally 60° C. or higher, preferably 70° C. or higher, and is generally 110° C. or lower. Furthermore, the glass transition temperature (Tg) of the polymeric ingredient for use in forming a resinous coating layer is preferably higher than the glass transition temperature (Tg) of the primary polymer particles by at least 5° C., more preferably by at least 10° C. Too low glass transition temperatures (Tg) thereof may result in cases where storage in general environments is difficult. Too high glass transition temperatures (Tg) thereof may result in cases where sufficient fusibility is not obtained.

It is preferred that a polysiloxane wax should be incorporated in the resinous coating layer. The incorporation thereof can bring about an advantage that high-temperature non-offset properties are improved. Examples of the polysiloxane wax include silicone waxes having an alkyl group.

The content of the polysiloxane wax is not limited. However, the content thereof is generally 0.01% by mass or higher, preferably 0.05% by mass or higher, more preferably 0.08% by mass or higher, and is generally 2% by mass or lower, preferably 1% by mass or lower, more preferably 0.5% by mass or lower, based on the whole toner particles. When the amount of the polysiloxane wax in the resinous coating layer is too small, there are cases where high-temperature non-offset properties become insufficient. When the amount thereof is too large, there are cases where nonblocking properties decrease.

For incorporating a polysiloxane wax into the resinous coating layer, any desired method may be used. For example, emulsion polymerization is conducted using the polysiloxane wax as seeds, and the resultant fine resin particles are reacted or combined in an aqueous medium with the aggregates for forming an inner layer. Thus, a resinous coating layer containing the polysiloxane wax can be formed on the surface of the aggregates each constituting an inner layer, whereby the polysiloxane wax can be incorporated.

(Fusion Step)

In the fusion step, the aggregates are heat-treated to thereby fuse and unite the polymer constituting each aggregate. In the case where a resinous coating layer has been formed on the aggregates to obtain encapsulated fine resin particles, the encapsulated particles are heat-treated, whereby the polymer constituting each aggregate and the resinous coating layer on the surface thereof are fused and united. Thus, the pigment particles are substantially prevented from being exposed in the surface of the toner to be obtained.

The heat treatment in the fusion step is conducted at a temperature not lower than the glass transition temperature (Tg) of the primary polymer particles constituting the aggregates. In the case where a resinous coating layer has been formed, the heat treatment is conducted at a temperature not lower than the glass transition temperature (Tg) of the polymeric ingredient constituting the resinous coating layer. Although specific temperature conditions are not limited, it is preferred that the temperature should be higher generally by at least 5° C. than the glass transition temperature (Tg) of the polymeric ingredient constituting the resinous coating layer. There is no upper limit on the temperature. However, it is preferred that this heat treatment should be conducted at a temperature not higher than the temperature which is higher by 50° C. than the glass transition temperature (Tg) of the polymeric ingredient constituting the resinous coating layer. The period of heat treatment is generally 0.5-6 hours, although it depends on treatment capacity and production amount.

(Washing/Drying Step)

In the case where the steps described above have been conducted in a liquid medium, the encapsulated resin particles obtained through the fusion step are washed and dried to remove the liquid medium, whereby a toner can be obtained. Methods for the washing and drying are not limited, and any desired methods may be used.

<Property Values Concerning Particle Diameters of Toner>

The volume-average particle diameter (Dv) of the toner in the invention is not limited, and may have any desired value unless this considerably lessens the effects of the invention. However, the volume-average particle diameter thereof is generally 4 μm or larger, preferably 5 μm or larger, and is generally 10 μm or smaller, preferably 8 μm or smaller. When the volume-average particle diameter (Dv) of the toner is too small, there are cases where image quality stability decreases. When the diameter (Dv) thereof is too large, there are cases where resolution decreases.

In the toner in the invention, the value obtained by dividing the volume-average particle diameter (Dv) by the number-average particle diameter (Dn), (Dv/Dn), is generally 1.0 or larger and is generally 1.25 or smaller, preferably 1.20 or smaller, more preferably 1.15 or smaller. The value of (Dv/Dn) indicates the state of particle size distribution. The closer the value thereof to 1.0, the narrower the particle size distribution. Narrower particle size distributions are desirable because the toner has more even electrification characteristics.

In the toner in the invention, the volume proportion of particles having a volume-average particle diameter (Dv) of 25 μm or larger is generally 1% or smaller, preferably 0.5% or smaller, more preferably 0.1% or smaller, even more preferably 0.05% or smaller. The smaller the value thereof, the more this toner is preferred. This is because smaller values thereof mean that the proportion of coarse particles contained in the toner is small, and because the small proportion of coarse particles enables the toner to be consumed in a reduced amount in continuous development and attain stable image quality. Although it is preferred that coarse particles having a particle diameter of 25 μm or larger should be nil, it is difficult to actually produce such a toner. Usually, the proportion of such coarse particles need not be reduced to 0.005% or smaller.

Furthermore, in the toner in the invention, the volume proportion of particles having a volume-average particle diameter (Dv) of 15 μm or larger is generally 2% or smaller, preferably 1% or smaller, more preferably 0.1% or smaller. Although it is preferred that coarse particles having a particle diameter of 15 μm or larger also should be nil, it is difficult to actually produce such a toner. Usually, the proportion of such coarse particles need not be reduced to 0.01% or smaller.

Moreover, it is preferred that in the toner in the invention, the number proportion of particles having a volume-average particle diameter (Dv) of 5 μm or smaller should be generally 15% or smaller, preferably 10% or smaller. This is because such a toner is effective in reducing image fogging.

The volume-average particle diameter (Dv), number-average particle diameter (Dn), volume proportion, number proportion, etc. of a toner are determined in the following manner. Coulter Counter Multisizer Type II or Type III (manufactured by Beckman Coulter Inc.) is used as an apparatus for measuring toner particle diameters. This apparatus is used together with an interface for outputting a number distribution/volume distribution and a general personal computer both connected to the apparatus. As an electrolytic solution, Isotan II is used. The measuring method is as follows. To 100-150 mL of the electrolytic solution is added 0.1-5 mL of a surfactant (preferably, an alkylbenzenesulfonic acid salt) as a dispersant. Thereto is added 2-20 mg of a test sample (toner). The electrolytic solution containing the sample suspended therein is treated with an ultrasonic disperser for about 1-3 minutes to disperse the sample. This dispersion is examined with the Coulter Counter Multisizer Type II or Type III using a 100-μm aperture. Thus, the numbers and volumes of the toner particles are determined, and a number distribution and a volume distribution are calculated. The volume-average particle diameter (Dv) and the number-average particle diameter (Dn) are determined respectively from these distributions.

<Property Values Concerning Peak Molecular Weight of Toner>

The THF soluble of the toner in the invention, when examined by gel permeation chromatography (hereinafter sometimes abbreviated to "GPC") has one or more peak molecular weights, at least one of which is generally 10,000 or higher, preferably 20,000 or higher, more preferably 30,000 or higher, and is generally 150,000 or lower, preferably 100,000 or lower, more preferably 70,000 or lower. Incidentally, THF means tetrahydrofuran. When all the peak molecular weights thereof are lower than that range, there are cases where this toner has impaired mechanical durability when used in a nonmagnetic one-component development system. When all the peak molecular weights thereof are higher than that range, there are cases where this toner is impaired in low-temperature fixability and fixing strength.

The THF insoluble content of the toner, as determined by the Celite-filtration gravimetric method which will be described later, is generally 10% or higher, preferably 20% or higher, and is generally 60% or lower, preferably 50% or lower. When the THF insoluble content thereof is outside that range, there are cases where it is difficult to reconcile mechanical durability and low-temperature fixability.

The peak molecular weights of the toner in the invention may be determined with measuring apparatus HLC-8120GPC (manufactured by Tosoh Corp.) under the following conditions. Columns are stabilized in a 40° C. heating chamber. Tetrahydrofuran (THF) as a solvent is passed through the columns having that temperature at a flow rate of 1 mL (milliliter) per minute. Subsequently, the toner is dissolved in THF, and the solution is filtered through a 0.2-μm filter. This filtrate is used as a sample. In the measurement, the resin solution in THF regulated so as to have a sample concentration (concentration of the resin in the toner) of 0.05-0.6% by mass is injected in an amount of 50-200 μL into the measuring apparatus. In determining molecular weights of the sample, a molecular weight distribution possessed by the sample is calculated from the relationship between logarithmic value and count in a calibration curve drawn from several monodisperse standard polystyrene samples. As the standard polystyrene samples for calibration curve drawing, use may be made, for example, of ones respectively having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ manufactured by Pressure Chemical Co. or Tosoh Corp. At least about ten standard polystyrene samples are used. As a detector is used an RI (refractive index) detector.

As the columns for the measurement, it is preferred to use a combination of two or more commercial polystyrene gel columns in order to accurately determine molecular weights in the range of from $10^3$ to $2\times10^6$. For example, a combination of μ-styragel 500, 103, 104, and 105, manufactured by Waters Inc., or a combination of shodex KA 801, 802, 803, 804, 805, 806, and 807, manufactured by Showa Denko K.K., is preferred.

The tetrahydrofuran (THF) insoluble content of the toner is determined in the following manner. One gram of a sample (toner) is added to 100 g of THF, and this mixture is allowed to stand at 25° C. for 24 hours for dissolution. This mixture is filtered through 10 g of Celite. The solvent is removed from the filtrate by distillation, and the amount of the THF soluble is measured. This amount is subtracted from 1 g, whereby the amount of a THF insoluble can be calculated.

<Softening Point and Glass Transition Temperature of Toner>

The toner in the invention is not limited in softening point (Sp), and may have any desired softening point unless the effects of the invention are considerably lessened thereby. However, from the standpoint of attaining low-energy fixing, the softening point thereof is generally 150° C. or lower, preferably 140° C. or lower. From the standpoints of high-temperature non-offset properties and durability, the softening point thereof is generally 80° C. or higher, preferably 100° C. or higher. The softening point (Sp) of the toner is determined through an examination in which 1.0 g of a sample is examined with a flow tester under the conditions of a nozzle of 1 mm×10 mm, load of 30 kg, preheating time of 5 minutes at 50° C., and heating rate of 3° C./min. The temperature of the intermediate point in the strand during the period from the initiation to the termination of flow is taken as the softening point of the polymer.

Furthermore, the toner in the invention is not limited in glass transition temperature (Tg), and may have any desired glass transition temperature (Tg) unless the effects of the invention are considerably lessened thereby. However, it is preferred from the standpoint of enabling low-energy fixing that the glass transition temperature (Tg) thereof should be generally 80° C. or lower, preferably 70° C. or lower. From the standpoint of nonblocking properties, it is preferred that the glass transition temperature (Tg) thereof should be generally 40° C. or higher, preferably 50° C. or higher. The glass transition temperature (Tg) of the toner is determined from a curve obtained through an examination with a differential scanning calorimeter under the conditions of a heating rate of 10° C./min. Specifically, a tangent is drawn to the curve at each of the transition (inflection) initiation points, and the temperature corresponding to the intersection of the two tangents is taken as the glass transition temperature.

The softening point (Sp) and glass transition temperature (Tg) of a toner are highly influenced by the kind and composition of the polymer contained in the toner. Consequently, the softening point (Sp) and glass transition temperature (Tg) of a toner can be regulated by suitably optimizing the kind and composition of the polymer. These can be regulated also by regulating the molecular weight and gel content of the polymer or regulating the kind and addition amount of a low-melting ingredient, e.g., a wax.

<Wax in Toner>

In the case where the toner in the invention contains a wax, the dispersed-particle diameter of the wax in the toner is generally 0.1 μm or lager, preferably 0.3 μm or larger, in terms of average particle diameter. The upper limit thereof is generally 3 μm or smaller, preferably 1 μm or smaller. When the dispersed-particle diameter thereof is too small, there are cases where the effect of improving the non-filming properties of the toner is not obtained. When the dispersed-particle diameter thereof is too large, the wax is apt to be exposed in the surface of the toner and there are cases where electrification characteristics and heat resistance decrease. Examples of methods for determining the dispersed-particle diameter of the wax include a method in which the toner is sliced and the thin section is examined with an electron microscope. Examples thereof further include a method which includes dissolving away the polymer of the toner with, e.g., an organic solvent in which the wax is insoluble, subsequently removing the dissolved polymer by filtration through a filter, and measuring the sizes of the wax particles remaining on the filter with a microscope.

The proportion of the wax in the toner is not limited unless the effects of the invention are considerably lessened. However, the proportion thereof is generally 0.05% by mass or larger, preferably 0.1% by mass or larger, and is generally 20% by mass or smaller, preferably 15% by mass or smaller. Too small wax proportions may result in cases where the width of fixing temperatures is insufficient. Too large wax proportions may result in cases where the wax fouls apparatus members to reduce image quality.

<External-Additive Fine Particles>

External-additive fine particles may be attached to the surface of the toner particles in order to improve the flowability, electrification stability, high-temperature nonblocking properties, or other properties of the toner. Examples of methods for attaching external-additive fine particles to the surface of toner particles include: a method in which in the toner production process described above, the secondary aggregates are mixed with external-additive fine particles in a liquid medium and the resultant mixture is heated to bond the external-additive fine particles to the toner particles; and a method in which the secondary aggregates are separated from the liquid medium, washed, and dried to obtain toner particles and external-additive fine particles are mixed with or bonded to the toner particles by a dry process.

Examples of mixing machines usable for mixing the toner particles with external-additive fine particles by a dry process include a Henschel mixer, supermixer, Nauta mixer, twin-cylinder mixer, Loedige Mixer, double-cone mixer, and drum mixer. It is preferred to use a high-speed agitation type mixing machine such as a Henschel mixer or supermixer, among those mixers, to evenly agitate and mix the ingredients using suitably set conditions including blade shape, rotation speed, period, and number of operation-stop repetitions.

Examples of apparatus usable for bonding external-additive fine particles to the toner particles by a dry process include a compression shear treatment apparatus capable of applying compression shear stress and a particle surface fusion treatment apparatus capable of treating particle surfaces by fusion. The compression shear treatment apparatus generally has a narrow gap constituted of two surfaces which move relatively to each other while maintaining a distance between these and which are a combination of a head surface and a head surface, combination of a head surface and a wall surface, or combination of a wall surface and a wall surface. This apparatus has been constituted so that when particles to be treated are forcedly passed through the gap, a compression stress and a shear stress are applied to the surface of the particles by the forced passing without causing substantially no pulverization. Examples of such compression shear treatment apparatus include the Mechanofusion apparatus manufactured by Hosokawa Micron Corp.

On the other hand, the particle surface fusion treatment apparatus generally has a constitution in which a mixture of fine particles as a base and external-additive fine particles can be instantaneously heated with, e.g., a hot air stream to or above the melting initiation temperature of the fine particles as a base to bond the external-additive fine particles to the base particles. Examples of such particle surface fusion treatment apparatus include Surfusing System, manufactured by Nippon Pneumatic Mfg. Co., Ltd.

As the external-additive fine particles, known ones which are known to be usable in this application can be used. Examples thereof include inorganic fine particles and organic fine particles. Examples of the inorganic fine particles include:

carbides such as silicon carbide, boron carbide, titanium carbide, zirconium carbide, hafnium carbide, vanadium carbide, tantalum carbide, niobium carbide, tungsten carbide, chromium carbide, molybdenum carbide, and calcium carbide;

nitrides such as boron nitride, titanium nitride, zirconium nitride, and silicon nitride;

borides such as zirconium boride;

oxides and hydroxides, such as silica, colloidal silica, titanium oxide, aluminum oxide, calcium oxide, magnesium oxide, zinc oxide, copper oxide, zirconium oxide, cerium oxide, talc, and hydrotalcite;

various titanic acid compounds such as calcium titanate, magnesium titanate, strontium titanate, and barium titanate;

phosphoric acid compounds such as tricalcium phosphate, calcium dihydrogen phosphate, calcium monohydrogen phosphate, and substituted calcium phosphates in which the phosphate ions have been partly replaced by an anion; sulfides such as molybdenum disulfide;

fluorides such as magnesium fluoride and carbon fluoride;

metal soaps such as aluminum stearate, calcium stearate, zinc stearate, and magnesium stearate; and talc, bentonite, and various carbon blacks including conductive carbon blacks. Furthermore, a magnetic substance such as, e.g., magnetite, maghematite, or an intermediate between magnetite and maghematite may be used.

On the other hand, examples of the organic fine particles include fine particles of styrene resins, acrylic resins such as poly(methyl acrylate) and poly(methyl methacrylate), epoxy resins, melamine resins, tetrafluoroethylene resins, trifluoroethylene resins, poly(vinyl chloride) resins, polyethylene, and polyacrylonitrile.

Preferred of those external-additive fine particles are silica, titanium oxide, alumina, zinc oxide, carbon blacks, and the like. External-additive fine particles of one kind may be used alone, or any desired combination of two or more kinds of external-additive fine particles may be used in any desired proportion.

The surface of those inorganic or organic fine particles may have undergone a surface treatment, e.g., hydrophobizing treatment, with a treating agent such as a silane coupling agent, titanate coupling agent, silicone oil, modified silicone oil, silicone varnish, fluorinated silane coupling agent, fluorinated silicone oil, or coupling agent having an amino group or quaternary ammonium salt group. One treating agent may be used alone, or any desired combination of two or more treating agents may be used in any desired proportion.

The external-additive fine particles may have any desired number-average particle diameter unless this considerably lessens the effects of the invention. The number-average particle diameter thereof is generally 0.001 μm or larger, preferably 0.005 μm or larger, and is generally 3 μm or smaller, preferably 1 μm or smaller. Two or more finely particulate external additives differing in average particle diameter may be used. The average particle diameter of external-additive fine particles may be determined, for example, through an examination with an electron microscope or conversion from values of BET specific surface area.

The proportion of the external-additive fine particles to the toner is not limited unless the effects of the invention are considerably lessened. However, the proportion of the external-additive fine particles, in terms of content thereof based on the sum of the toner and the external-additive fine particles, is generally 0.1% by mass or higher, preferably 0.3% by mass or higher, more preferably 0.5% by mass or higher, and is generally 10% by mass or lower, preferably 6% by mass or lower, more preferably 4% by mass or lower. When the proportion of the external-additive fine particles is too small, there are cases where this toner is insufficient in flowability and electrification stability. Too large proportions thereof may result in cases where this toner has impaired fixability.

<Others>

With respect to the electrification characteristics of the toner in the invention, the toner may be of the negative electrification type or the positive electrification type. The toner can be regulated so as to be either of these according to the type of the image-forming apparatus to be used. The electrification characteristics of the toner can be regulated, for example, by selecting a component of the toner base particles, e.g., a charge control agent, regulating the proportion of the component, selecting external-additive fine particles, and regulating the proportion thereof.

The toner in the invention can be used as a one-component developer or can be mixed with a carrier and used as a two-component developer. In the case of use as a two-component developer, the carrier to be mixed with the toner to form the developer can be, for example, a known magnetic substance such as an iron-powder, ferrite, or magnetite carrier, a material obtained by coating the surface of such a magnetic substance with a resin, or a magnetic resin carrier.

As the resin for carrier coating, use can be made, for example, of a generally known resin such as a styrene resin, acrylic resin, styrene/acrylic copolymer resin, silicone resin, modified silicone resin, or fluororesin. However, the coating resin should not be construed as being limited to these.

Those carriers are not particularly limited in average particle diameter. However, ones each having an average particle diameter of 10-200 μm are preferred. It is preferred that those carriers should be used in an amount of 5-100 parts by mass per part by mass of the toner.

Incidentally, the formation of a full-color image by electrophotography can be conducted in an ordinary manner using toners respectively having magenta, cyan, and yellow colors and optionally further using a black toner.

[Image-Forming Apparatus]

An embodiment of the image-forming apparatus employing the electrophotographic photoreceptors of the invention is explained below by reference to FIG. 1, which illustrates the constitution of important parts of the apparatus. However, embodiments of the apparatus should not be construed as being limited to that explained below, and the apparatus can be modified at will so long as the modifications do not depart from the spirit of the invention.

As shown in FIG. 1, the image-forming apparatus includes an electrophotographic photoreceptor 1, a charging device 2, an exposure device 3, a developing device 4, and a transfer device 5. The apparatus may further has a cleaner 6 and a fixing device 7 according to need.

The electrophotographic photoreceptor 1 is not particularly limited so long as it is any of the electrophotographic photoreceptors of the invention described above. FIG. 1 shows, as an example thereof, a drum-shaped electrophotographic photoreceptor constituted of a cylindrical conductive substrate and, formed on the surface thereof, the photosensitive layer described above. The charging device 2, exposure device 3, developing device 4, transfer device 5, and cleaner 6 have been disposed along the peripheral surface of this electrophotographic photoreceptor 1.

The charging device 2 serves to charge the electrophotographic photoreceptor 1. It evenly charges the surface of the electrophotographic photoreceptor 1 to a given potential. FIG. 1 shows a roller type charging device (charging roller) as an example of the charging device 2. However, corona charging devices such as corotrons and scorotrons, contact type charging devices such as charging brushes, and the like are frequently used besides the charging rollers.

In many cases, the electrophotographic photoreceptor 1 and the charging device 2 have been designed to constitute a cartridge (hereinafter sometimes referred to as "electrophotographic photoreceptor cartridge") which involves these two members and is removable from the main body of the image-forming apparatus. In the invention also, it is desirable to use the photoreceptor 1 and the charging device 2 in this form.

In the invention, the effects thereof are remarkably produced when the charging device is disposed so as to be in contact with the electrophotographic photoreceptor. This constitution is hence desirable. In this constitution, when, for example, the electrophotographic photoreceptor 1 and the charging device 2 have deteriorated, this electrophotographic photoreceptor cartridge can be removed from the main body of the image-forming apparatus and a fresh electrophotographic photoreceptor cartridge can be mounted in the main body of the image-forming apparatus. With respect to the toner also, the toner in many cases has been designed to be stored in a toner cartridge and be removable from the main body of the image-forming apparatus. In this constitution, when the toner in the toner cartridge in use has run out, this toner cartridge can be removed from the main body of the image-forming apparatus and a fresh toner cartridge can be mounted.

The electrophotographic photoreceptor cartridge preferably includes the electrophotographic photoreceptor and at least one member selected from a charging unit which charges the electrophotographic photoreceptor, an exposure unit which exposes the charged electrophotographic photoreceptor to light to form an electrostatic latent image, a developing unit which develops the electrostatic latent image formed on the electrophotographic photoreceptor, and a cleaning unit which cleans the surface of the electrophotographic photoreceptor. Furthermore, a cartridge including all of the electrophotographic photoreceptor, a charging device, and a toner is also especially preferred.

The exposure device 3 is not particularly limited in kind so long as it can illuminate the electrophotographic photoreceptor 1 and thereby form an electrostatic latent image in the photosensitive surface of the electrophotographic photoreceptor 1. Examples thereof include halogen lamps, fluorescent lamps, lasers such as semiconductor lasers and He—Ne lasers, and LEDs. Of these exposure devices, LEDs capable of directly illuminating the electrophotographic photoreceptor without via a member such as, e.g., a polygon mirror are preferred because a high-resolution electrostatic latent image can be highly accurately formed therewith. More preferred of LEDs is an LED array, i.e., an array of LEDs. It is also possible to conduct exposure by the technique of internal photoreceptor exposure. Any desired light can be used for exposure. For example, the monochromatic light having a wavelength of 780 nm, a monochromatic light having a slightly short wavelength of 600-700 nm, a monochromatic light having a short wavelength of 350-600 nm, or the like may be used to conduct exposure. It is preferred to conduct exposure with a monochromatic light having a short wavelength of 350-600 nm among those lights. More preferred is to conduct exposure with a monochromatic light having a wavelength of 380-500 nm.

The electrophotographic photoreceptors of the invention are excellent in image properties represented by fogging characteristics and also in dot skipping characteristics. Because of this, the electrophotographic photoreceptors can produce especially remarkable effects in the formation of higher-resolution images, which are apt to develop defects such as fogging and dot skipping. From this standpoint, the image-forming apparatus of the invention preferably are ones in which the electrostatic latent image has a resolution of 1,200 dpi or higher.

The developing device 4 is not particularly limited in kind, and any desired device can be used, such as one operated by a dry development technique, e.g., cascade development, development with one-component conductive toner, or two-component magnetic brush development, a wet development technique, etc. In FIG. 1, the developing device 4 includes a developing chamber 41, agitators 42, a feed roller 43, a developing roller 44, and a control member 45. This device has such a constitution that a toner T is stored in the developing chamber 41. According to need, the developing device 4 may be equipped with a replenishing device (not shown) for replenishing the toner T. This replenishing device has such a constitution that the toner T can be supplied from a container such as a bottle or cartridge.

The feed roller 43 is made of an electrically conductive sponge, etc. The developing roller 44 is constituted of, for example, a metallic roll made of iron, stainless steel, aluminum, nickel, or the like or a resinous roll obtained by coating such a metallic roll with a silicone resin, urethane resin, fluororesin, or the like. The surface of this developing roller 44 may be subjected to a surface-smoothing processing or surface-roughening processing according to need.

The developing roller 44 is disposed between the electrophotographic photoreceptor 1 and the feed roller 43 and is in contact with each of the electrophotographic photoreceptor 1 and the feed roller 43. The feed roller 43 and the developing roller 44 are rotated by a rotation driving mechanism (not shown). The feed roller 43 holds the toner T stored and supplies it to the developing roller 44. The developing roller 44 holds the toner T supplied by the feed roller 43 and brings it into contact with the surface of the electrophotographic photoreceptor 1.

The control member 45 is constituted of a resinous blade made of a silicone resin, urethane resin, or the like, a metallic blade made of stainless steel, aluminum, copper, brass, phosphor bronze, or the like, a blade obtained by coating such a metallic blade with a resin, etc. This control member 45 is in contact with the developing roller 44 and is pushed against the developing roller 44 with a spring or the like at a given force (the linear blade pressure is generally 5-500 g/cm). According to need, this control member 45 may have the function of charging the toner T based on electrification by friction with the toner T.

The agitators 42 each are rotated by the rotation driving mechanism. They agitate the toner T and convey the toner T to the feed roller 43 side. Two or more agitators 42 differing in blade shape, size, etc. may be disposed.

The toner T is as described above.

The transfer device 5 is not particularly limited in kind, and use can be made of a device operated by any desired technique selected from an electrostatic transfer technique, pressure transfer technique, adhesive transfer technique, and the like, such as corona transfer, roller transfer, and belt transfer. Here, the transfer device 5 is one constituted of a transfer charger, transfer roller, transfer belt, or the like disposed so as to face the electrophotographic photoreceptor 1. A given voltage (transfer voltage) which has the polarity opposite to that of the charge potential of the toner T is applied to the transfer device 5, and this transfer device 5 thus transfers the toner image formed on the electrophotographic photoreceptor 1 to a receiving material (paper or medium) P. In the invention, the apparatus is effective when the transfer device 5 is disposed so as to be in contact with the electrophotographic photoreceptor 1 through the receiving material.

The cleaner 6 is not particularly limited, and any desired cleaner can be used, such as a brush cleaner, magnetic brush cleaner, electrostatic brush cleaner, magnetic roller cleaner, or blade cleaner. The cleaner 6 serves to scrape off the residual toner adherent to the electrophotographic photoreceptor 1 with a cleaning member and thus recover the residual toner. However, when there is little or almost no residual toner adherent to the electrophotographic photoreceptor 1, the cleaner 6 may be omitted.

The fixing device 7 is constituted of an upper fixing member (fixing roller) 71 and a lower fixing member (fixing roller) 72. The fixing member 71 or 72 is equipped with a heater 73 inside. FIG. 1 shows an example in which the upper fixing member 71 is equipped with a heater 73 inside. As the upper and lower fixing members 71 and 72 can be used a known heat-fixing member such as a fixing roll obtained by coating a metallic tube made of stainless steel, aluminum, or the like with a silicone rubber, a fixing roll obtained by further coating that fixing roll with a fluororesin, or a fixing sheet. Furthermore, the fixing members 71 and 72 each may have a constitution in which a release agent such as a silicone oil is supplied thereto in order to improve release properties, or may have a constitution in which the two members are forcedly pressed against each other with a spring or the like.

The toner which has been transferred to the recording paper P passes through the nip between the upper fixing member 71 heated at a given temperature and the lower fixing member 72, during which the toner is heated to a molten state. After the passing, the toner is cooled and fixed to the recording paper P. The fixing device also is not particularly limited in kind. Fixing devices which can be mounted include ones operated by any desired fixing technique, such as heated-roller fixing, flash fixing, oven fixing, or pressure fixing, besides the device used here.

[Method of Image Formation]

In the image-forming apparatus having the constitution described above, image recording is conducted in the following manner. First, the surface (photosensitive surface) of the electrophotographic photoreceptor 1 is charged to a given potential (e.g., −600 V) by the charging device 2. This charging may be conducted with a direct-current voltage or with a direct-current voltage on which an alternating-current voltage has been superimposed. Subsequently, the charged photosensitive surface of the electrophotographic photoreceptor 1 is exposed by the exposure device 3 according to the image to be recorded. Thus, an electrostatic latent image is formed in the photosensitive surface. This electrostatic latent image formed in the photosensitive surface of the electrophotographic photoreceptor 1 is developed by the developing device 4.

In the developing device 4, the toner T fed by the feed roller 43 is formed into a thin layer with the control member (developing blade) 45 and, simultaneously therewith, frictionally charged so as to have a given polarity (here, the toner is charged so as to have negative polarity, which is the same as the polarity of the charge potential of the electrophotographic photoreceptor 1). This toner T is conveyed while being held by the developing roller 44 and is brought into contact with the surface of the electrophotographic photoreceptor 1. When the charged toner T held on the developing roller 44 comes into contact with the surface of the electrophotographic photoreceptor 1, a toner image corresponding to the electrostatic latent image is formed on the photosensitive surface of the electrophotographic photoreceptor 1. This toner image is transferred to a recording paper P by the transfer device 5. Thereafter, the toner which has not been transferred and remains on the photosensitive surface of the electrophotographic photoreceptor 1 is removed by the cleaner 6.

After the transfer of the toner image to the recording paper P, this recording paper P is passed through the fixing device 7 to thermally fix the toner image to the recording paper P. Thus, a finished image is obtained. Incidentally, the image-forming apparatus may have a constitution in which an erase step, for example, can be conducted, in addition to the constitution described above. The erase step is a step in which the electrophotographic photoreceptor is exposed to a light to thereby erase the residual charges from the electrophotographic photoreceptor. As an eraser may be used a fluorescent lamp, LED, or the like. The light to be used in the erase step, in many cases, is a light having such an intensity that the exposure energy thereof is at least 3 times the energy of the exposure light.

The constitution of the image-forming apparatus may be further modified. For example, the apparatus may have a constitution in which steps such as a pre-exposure step and an auxiliary charging step can be conducted, or have a constitution in which offset printing is conducted. Furthermore, the apparatus may have a four-cycle color constitution or full-color tandem constitution employing two or more toners. When a full-color image is to be printed in the four-cycle color mode, it is necessary for forming one full-color image to successively conduct a charge/exposure/development cycle four times on the same photoreceptor to respectively form images of four colors. In this mode, there is a possibility that the history of exposure for the preceding color might exert an influence in the course of the formation of one full-color image to cause image defects, e.g., memory, resulting in reduced image quality. In view of this, the full-color tandem mode, in which an electrostatic latent image is formed on each of different electrophotographic photoreceptors for respective colors, is more preferred from the standpoint of providing high-quality images. FIG. 2 is a diagrammatic view illustrating the important constitution of a full-color tandem image-forming apparatus. This apparatus has electrophotographic photoreceptors 1, LED exposure devices 10, and toner cartridges 11. A full-color image can be obtained by forming superposed layers of magenta, yellow, cyan, and black toners so as to obtain desired colors. In the tandem mode, the electrophotographic photoreceptors 1 undergo development with the respective toners, and the toner images are transferred in tandem. Because of this, this mode is more apt to cause color shifting as compared with the four-cycle mode. Especially in the tandem mode, there has been the following trouble. In the development with toners of electrostatic latent images formed on the photoreceptors, when the electrostatic latent images are not faithfully developed with the toners, the color shifting appears more conspicuously in the final image obtained through a transfer step, etc. However, by using photoreceptors of the invention, toners can be deposited on the photoreceptors so as to more faithfully develop the latent images. That drawback of the tandem mode can be remarkably mitigated. The invention produces marked effects especially in the tandem mode.

EXAMPLES

The invention will be explained below in more detail by reference to Examples according to the invention, Comparative Examples, and Reference Examples. However, the invention should not be construed as being limited to the following Examples unless the invention departs from the spirit thereof. Each "parts" in the following Examples, Comparative Examples, and Reference Examples indicates "parts by mass" unless otherwise indicated, and each "%" indicates "% by mass" unless otherwise indicated.

Production Example 1

Rutile-form titanium oxide having an average primary-particle diameter of 40 nm ("TTO55N" manufactured by Ishihara Sangyo Kaisha, Ltd.) was introduced into a high-speed flow type mixing/kneading machine ("SMG300" manufactured by Kawata MFG. Co., Ltd.) together with 3% by mass methyldimethoxysilane ("TSL8117" manufactured by Toshiba Silicone Co., Ltd.) based on the titanium oxide. The ingredients were mixed together at a high speed of 34.5 m/sec in terms of peripheral rotation speed. The surface-treated titanium oxide obtained was dispersed in a mixed solvent composed of methanol and 1-propanol in a ratio of 7/3 by mass with a ball mill to thereby obtain a dispersion slurry of the hydrophobized titanium oxide. This dispersion slurry was mixed with a methanol/1-propanol/toluene mixed solvent and with pellets of the copolyamide described in an Example of JP-A-4-31870 composed of ϵ-caprolactam [compound represented by the following formula (A)]/bis(4-amino-3-methylcyclohexyl)methane [compound represented by the following formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] in a molar ratio of 60%/15%/5%/15%/5%, with stirring and heating. After the polyamide pellets were dissolved, this mixture was subjected to an ultrasonic dispersion treatment. Thus, a dispersion for undercoat layer formation A was produced which had a methanol/1-propanol/toluene ratio of 7/1/2 by mass, contained the hydrophobized titanium oxide and the copolyamide in a ratio of 3/1 by mass, and had a solid concentration of 18.0%.

[Ka-36]

A

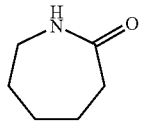

B

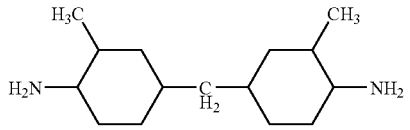

C

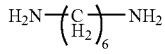

D

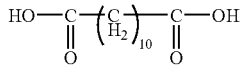

E

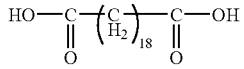

An aluminum cylinder (outer diameter, 30 mm; length, 351 mm; thickness, 1.0 mm) which had not been anodized was immersed in the dispersion for undercoat layer formation A to thereby form, by dip coating, an undercoat layer having a thickness of 1.5 μm on a dry basis. Subsequently, 20 parts of D-form oxytitanium phthalocyanine was mixed as a charge-generating substance with 280 parts of 1,2-dimethoxyethane, and this mixture was treated with a sand grinding mill for 2 hours to pulverize the phthalocyanine. Thus, a pulverization/dispersion treatment was conducted. Subsequently, this liquid obtained by the pulverization treatment was mixed with a binder solution obtained by dissolving 10 parts of poly(vinyl butyral) (trade name "Denka Butyral" #6000, manufactured by Denki Kagaku Kogyo K.K.) in a liquid mixture of 253 parts of 1,2-dimethoxyethane and 85 parts of 4-methoxy-4-methyl-2-pentanone and further with 230 parts of 1,2-dimethoxyethane. Thus, a dispersion for charge-generating-layer formation was prepared. The aluminum cylinder on which the undercoat layer had been formed was immersed in the dispersion for charge-generating-layer formation to form, by dip coating, a charge-generating layer in a thickness of 0.3 μm (0.3 g/m$^2$) on a dry basis.

Subsequently, a liquid obtained by dissolving 56 parts of the following compound CT-1 and 14 parts of the following compound CT-2 as charge-transporting substances, 1.5 parts of the following compound AD-1, 0.1 part of the compound represented by Exemplified Compound 1, 100 parts of a polycarbonate having the following structure P-1 as repeating units (polycarbonate P-1; viscosity-average molecular weight, about 30,000) as a binder resin,

[Ka-37]

CT-1

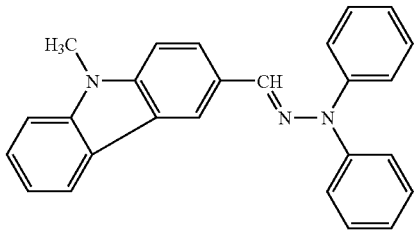

CT-2

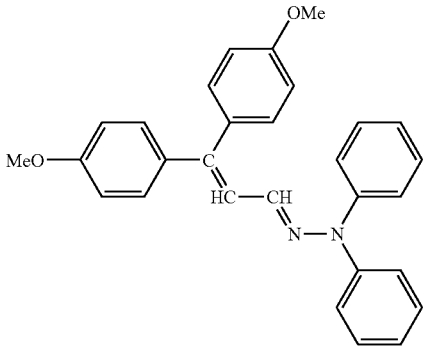

AD-1

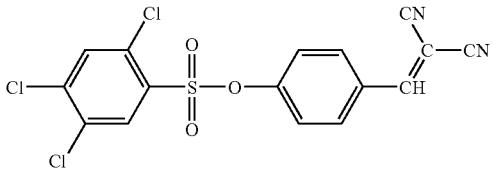

P-1

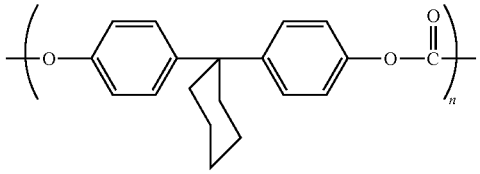

8 parts of the antioxidant having the following structure,

[Ka-38]

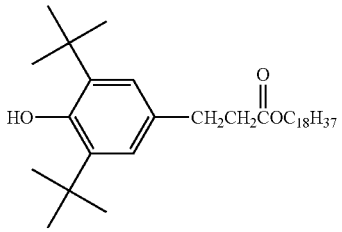

and 0.03 parts of a silicone oil (trade name KF96, manufactured by Shin-Etsu Chemical Co., Ltd.) as a leveling agent in 640 parts of a tetrahydrofuran/toluene (8/2) mixed solvent was applied by dip coating to the charge-generating layer in a thickness of 18 μm on a dry basis. Thus, an electrophotographic photoreceptor E1 having a multilayered photosensitive layer was obtained.

Production Example 2

An electrophotographic photoreceptor was produced in the same manner as in Production Example 1, except that the compound represented by Exemplified Compound 1 used in Production Example 1 was used in an amount of 1.0 part by mass in place of 0.1 part by mass. Thus, an electrophotographic photoreceptor E2 was obtained.

Production Example 3

An electrophotographic photoreceptor was produced in the same manner as in Production Example 1, except that the following general formula (P-2: viscosity-average molecular weight, about 40,000; x:y:z=45/45/10) was used. Thus, an electrophotographic photoreceptor E3 was obtained.

[Ka-39]

P-2

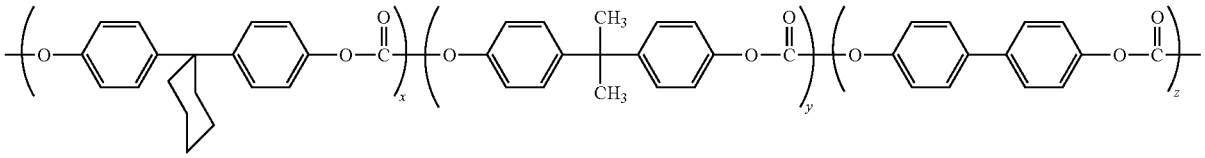

Production Example 4

The same procedure as in Production Example 1 was conducted, except that the following general formula (P-3: viscosity-average molecular weight, about 40,000; m:n=1:1) was used as a binder in place of general formula (P-1). Thus, an electrophotographic photoreceptor E4 was obtained.

[Ka-40]

P-3

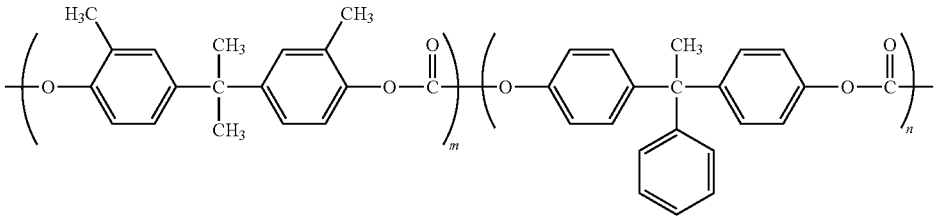

Production Example 5

The same procedure as in Production Example 1 was conducted, except that the following general formula (P-4: viscosity-average molecular weight, about 30,000; m:n=3:7) was used as a binder in place of general formula (P-1). Thus, an electrophotographic photoreceptor E5 was obtained.

[Ka-41]

P-4

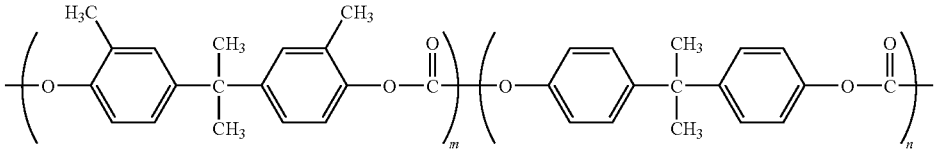

Production Example 6

The same procedure as in Production Example 1 was conducted, except that the following general formula (P-5: viscosity-average molecular weight, about 30,000; m:n=3:7) was used as a binder in place of general formula (P-1), and that 60 parts of the following compound CT-3 was used as a charge-transporting substance in place of the compounds CT-1 and CT-2. Thus, an electrophotographic photoreceptor E6 was obtained.

[Ka-42]

P-5

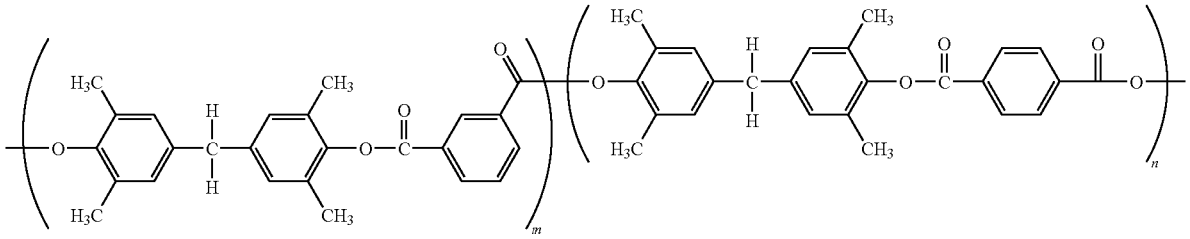

CT-3

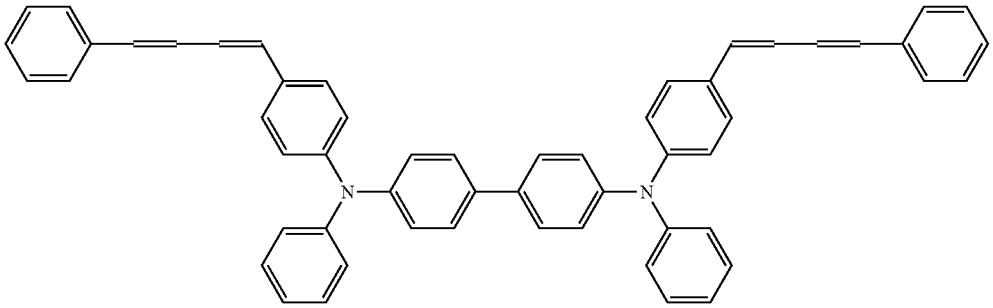

Production Example 7

The same procedure as in Production Example 6 was conducted, except that the following general formula (P-6: viscosity-average molecular weight, about 30,000) was used as a binder in place of general formula (P-5). Thus, an electrophotographic photoreceptor E7 was obtained.

[Ka-43]

P-6

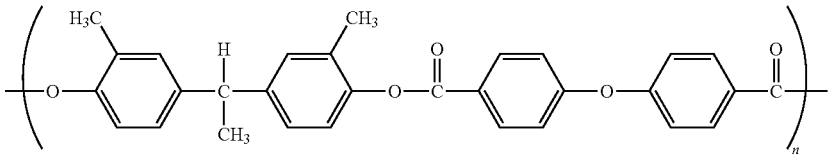

Production Example 8

The same procedure as in Production Example 1 was conducted, except that 0.1 part of Exemplified Compound 37 was used in place of 0.1 part of Exemplified Compound 1 used in Production Example 1, and that 40 parts of the following compound CT-4 was used in place of CT-1 and CT-2. Thus, an electrophotographic photoreceptor E8 was obtained.

[Ka-44]

CT-4

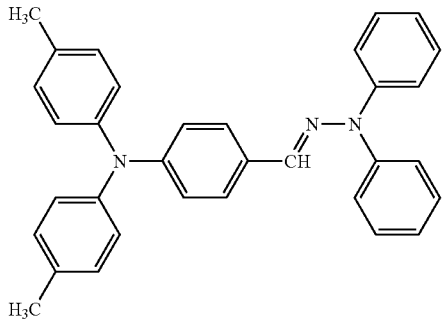

Production Example 9

Fifty parts of a surface-treated titanium oxide obtained by mixing rutile-form titanium oxide having an average primary-particle diameter of 40 nm ("TTO55N" manufactured by Ishihara Sangyo Kaisha, Ltd.) with 3% by mass methyldimethoxysilane ("TSL8117" manufactured by Toshiba Silicone Co., Ltd.) based on the titanium oxide by means of a Henschel mixer was mixed with 120 parts of methanol to obtain a raw slurry. One kilogram of the raw slurry was subjected to a 1-hour dispersion treatment with Ultra Apex Mill having a capacity of about 0.15 L (UAM Type 015), manufactured by Kotobuki Industries Co., Ltd., using zirconia beads having a diameter of about 100 μm (YTZ, manufactured by Nikkato Corp.) while circulating the liquid at a rotor peripheral speed of 10 m/sec and a liquid flow rate of 10 kg/hr. Thus, a titanium oxide dispersion was produced.

The titanium oxide dispersion was mixed with a methanol/1-propanol/toluene mixed solvent and with pellets of a copolyamide composed of ϵ-caprolactam [compound represented by the following formula (A)]/bis(4-amino-3-methylcyclohexyl)methane [compound represented by the following formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] in a molar ratio of 60%/15%/5%/15%/5%, with stirring and heating. After the polyamide pellets were dissolved, this mixture was subjected to a 1-hour ultrasonic dispersion treatment with an ultrasonic oscillator having an output of 1,200 W and then filtered through a PTFE membrane filter having a pore diameter of 5 μm (Mitex LC, manufactured by Advantech Co., Ltd.). Thus, a dispersion for undercoat layer formation B was obtained which contained the surface-treated titanium oxide and the copolyamide in a ratio of 3/1 by mass and in which the methanol/1-propanol/toluene mixed solvent had a ratio of 7/1/2 by mass and the concentration of the solid ingredients contained therein was 18.0% by mass.

[Ka-45]

A

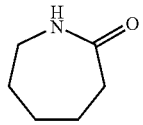

B

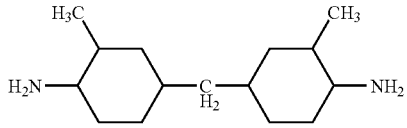

C

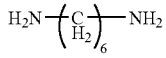

D

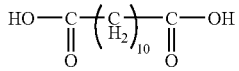

E

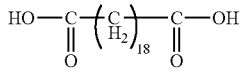

The coating fluid for undercoat layer formation B was applied by dip coating to an anodized aluminum cylinder (outer diameter, 30 mm; length, 351 mm; thickness, 1.0 mm) to thereby form an undercoat layer in a thickness of 1.5 μm on a dry basis. A 94.2-$cm^2$ portion of this undercoat layer was immersed in a mixing liquid composed of 70 $cm^3$ of methanol and 30 $cm^3$ of 1-propanol. This undercoat layer in the solvent was subjected to a 5-minute ultrasonic treatment with an ultrasonic oscillator having an output of 600 W to obtain an undercoat layer dispersion. The metal oxide particles in this dispersion were examined with UPA for particle size distribution. As a result, the particles were found to have a volume-average diameter My of 0.078 μm, number-average diameter Mp of 0.059 μm, and Mv/Mp of 1.32. A charge-generating layer and a charge-transporting layer were formed, in the same manner as in Production Example 1, on the undercoat layer obtained. Thus, an electrophotographic photoreceptor E9 was obtained.

A 94.2-$cm^2$ portion of the photosensitive layer of the electrophotographic photoreceptor E9 obtained was immersed in 100 $cm^3$ of tetrahydrofuran and dissolved away by a 5-minute ultrasonic treatment with an ultrasonic oscillator having an output of 600 W. Thereafter, this part was immersed in a mixing liquid composed of 70 $cm^3$ of methanol and 30 $cm^3$ of 1-propanol. The part in the solvent was subjected to a 5-minute ultrasonic treatment with an ultrasonic oscillator having an output of 600 W to obtain an undercoat layer dispersion. The metal oxide particles in this dispersion were examined with UPA for particle size distribution. As a result, the particles were found to have a volume-average diameter My of 0.079 μm, number-average diameter Mp of 0.059 μm, and Mv/Mp of 1.34.

Production Example 10 to Production Example 18

The same procedures as in Production Examples 1 to Production Example 9 were conducted, except that the compounds represented by formula (1) (Exemplified Compound 1 and Exemplified Compound 37) were not used. Thus, electrophotographic photoreceptors P1 to P9 were produced.

Production Example 19

The same procedure as in Production Example 1 was conducted, except that 0.1 part of the following compound was used in place of 0.1 part of Exemplified Compound 1. Thus, an electrophotographic photoreceptor P10 was produced.

[Ka-46]

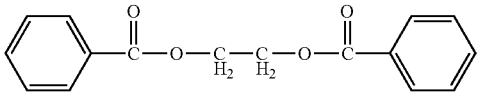

<Evaluation of Electrical Characteristics>

The electrophotographic photoreceptors produced in the Production Examples each were mounted on an electrophotographic-property evaluation apparatus produced in accordance with a standard of The Society of Electrophotography of Japan (described in The Society of Electrophotography of Japan, ed., *Zoku Denshi Shashin Gijutsu No Kiso To Ōyō, Corona Publishing Co., Ltd., pp.* 404-405). The electrophotographic photoreceptor was evaluated for electrical characteristics through a cycle including charging (minus polarity), exposure, potential measurement, and erase by the following procedure.

The electrophotographic photoreceptor was charged to an initial surface potential of −700 V. This photoreceptor was irradiated with 780-nm monochromatic light obtained by passing the light of a halogen lamp through an interference filter, and the irradiation energy required for the surface potential to reach −350 V (half-decay exposure energy) was measured as sensitivity (E1/2) (μJ/cm$^2$). Furthermore, the photoreceptor was irradiated with the exposure light at an intensity of 1.0 μJ/cm$^2$ and examined for post-exposure surface potential (VL1) (−V) after 233 ms. The results thereof are shown in Table 1.

TABLE 1

| No. | Electrophotographic photoreceptor | Electrical characteristics E½ μJ/cm$^2$ | VL1 (−V) |
|---|---|---|---|
| Production Example 1 | E1 | 0.100 | 115 |
| Production Example 10 | P1 | 0.105 | 128 |
| Production Example 2 | E2 | 0.100 | 116 |
| Production Example 11 | P2 | 0.105 | 128 |
| Production Example 3 | E3 | 0.100 | 119 |
| Production Example 12 | P3 | 0.106 | 127 |
| Production Example 4 | E4 | 0.099 | 112 |
| Production Example 13 | P4 | 0.104 | 119 |
| Production Example 5 | E5 | 0.101 | 117 |
| Production Example 14 | P5 | 0.106 | 122 |
| Production Example 6 | E6 | 0.102 | 105 |
| Production Example 15 | P6 | 0.109 | 115 |
| Production Example 7 | E7 | 0.098 | 102 |
| Production Example 16 | P7 | 0.102 | 109 |
| Production Example 8 | E8 | 0.097 | 70 |
| Production Example 17 | P8 | 0.102 | 76 |
| Production Example 9 | E9 | 0.099 | 115 |
| Production Example 18 | P9 | 0.106 | 129 |
| Production Example 19 | P10 | 0.109 | 132 |

<Image Evaluation 1>

An Example of the first mode of the invention is shown below.

Example 1A

The electrophotographic photoreceptor E8 was mounted in a cyan drum cartridge for a commercial tandem type color printer capable of A3 printing (Microline 3050c, manufactured by Oki Data Corp.), and this cartridge was mounted on the printer. As a toner was used a commercial toner for the printer which had been produced by the melt kneading pulverization method. This toner had an average degree of circularity of 0.935. First, the printing medium type was set at OHP, and a cyan image was printed on 100 sheets of A4-size OHP film MC502, manufactured by Mitsubishi Kagaku Media Co., Ltd., under the conditions of a temperature of 35° C. and a humidity of 80% while feeding the sheets longitudinally. Subsequently, a cyan solid image was printed on an A3 sheet of paper, and this image was evaluated.

Color Printer MICROLINE 3050c

Four-cartridge tandem; color, 21 ppm; monochrome, 26 ppm

Resolution of electrostatic latent image: 1,200 dpi

LED exposure

As a result, no difference in density in the solid image printed on the A3 paper was observed between the OHP passing area (that part of the electrophotographic photoreceptor which had been damaged by transfer through the OHP sheets) and the OHP non-passing area (that part of the electrophotographic photoreceptor which had been damaged by direct transfer).

An Example of the second mode of the invention is shown below.

Example 2A

The electrophotographic photoreceptor E8 was mounted in a cyan drum cartridge for a commercial tandem type color printer capable of A3 printing (Microline 3050c, manufactured by Oki Data Corp.), and this cartridge was mounted on the printer. As a toner was used a commercial toner for the printer which had been produced by the melt kneading pulverization method. This toner had an average degree of circularity of 0.935. First, the printing medium type was set at OHP, and a cyan image was printed on 100 sheets of A4-size OHP film MC502, manufactured by Mitsubishi Kagaku Media Co., Ltd., under the conditions of a temperature of 35° C. and a humidity of 80% while feeding the sheets longitudinally. Subsequently, a cyan solid image was printed on an A3 sheet of paper, and this image was evaluated.

Color Printer MICROLINE 3050c

Four-cartridge tandem; color, 21 ppm; monochrome, 26 ppm

Resolution of electrostatic latent image: 1,200 dpi

LED exposure

As a result, no difference in density in the solid image printed on the A3 paper was observed between the OHP passing area (that part of the electrophotographic photoreceptor which had been damaged by transfer through the OHP sheets) and the OHP non-passing area (that part of the electrophotographic photoreceptor which had been damaged by direct transfer).

An Example of the fourth mode of the invention is shown below.

Example 4A

The electrophotographic photoreceptor E8 was mounted in a cyan drum cartridge for a commercial tandem type color printer capable of A3 printing (Microline 3050c, manufactured by Oki Data Corp.), and this cartridge was mounted on the printer. As a toner was used a commercial toner for the printer which had been produced by the melt kneading pulverization method. This toner had an average degree of circularity of 0.935. First, the printing medium type was set at OHP, and a cyan image was printed on 100 sheets of A4-size OHP film MC502, manufactured by Mitsubishi Kagaku Media Co., Ltd., under the conditions of a temperature of 35° C. and a humidity of 80% while feeding the sheets longitudinally. Subsequently, a cyan solid image was printed on an A3 sheet of paper, and this image was evaluated.

Color Printer MICROLINE 3050c

Four-cartridge tandem; color, 21 ppm; monochrome, 26 ppm

Resolution of electrostatic latent image: 1,200 dpi

LED exposure

As a result, no difference in density in the solid image printed on the A3 paper was observed between the OHP passing area (that part of the electrophotographic photoreceptor which had been damaged by transfer through the OHP sheets) and the OHP non-passing area (that part of the electrophotographic photoreceptor which had been damaged by direct transfer).

<Image Evaluation 2>

(Production of Toner for Development, 1)

Preparation of Wax/Long-Chain Polymerizable Monomer Dispersion T1

Twenty-seven parts (540 g) of a paraffin wax (HNP-9, manufactured by Nippon Seiro Co., Ltd.; surface tension, 23.5 mN/m; melting point, 82° C.; heat of fusion, 220 J/g; melting peak half-value width, 8.2° C.; crystallization peak half-value width, 13.0° C.), 2.8 parts of stearyl acrylate (manufactured by Tokyo Kasei Kogyo Co., Ltd.), 1.9 parts of a 20% by mass aqueous sodium dodecylbenzenesulfonate solution (Neogen S20A, manufactured by Dai-ichi Kogyo Seiyaku Co., Ltd.; hereinafter suitably abbreviated to "20% aqueous DBS solution"), and 68.3 parts of desalted water were heated to 90° C. and stirred with a homomixer (Mark II Model f, manufactured by Tokushu Kika Kogyo Co., Ltd.) for 10 minutes at a rotation speed of 8,000 rpm. Subsequently, the resultant dispersion was heated to 90° C. and subjected to emulsification with circulation by means of a homogenizer (Type 15-M-8PA, manufactured by Gaulin Company) under pressurization conditions of about 25 MPa. This dispersion treatment was conducted to a volume-average particle diameter of 250 nm while measuring the volume-average particle diameter with UPA-EX. Thus, a wax/long-chain polymerizable monomer dispersion T1 (emulsion solid concentration=30.2% by mass) was produced.

Preparation of Silicone Wax Dispersion T2

Into a 3-L stainless-steel vessel were introduced 27 parts (540 g) of an alkyl-modified silicone wax (melting point, 72° C.), 1.9 parts of 20% aqueous DBS solution, and 71.1 parts of desalted water. The contents were heated to 90° C. and stirred with a homomixer (Mark II Model f, manufactured by Tokushu Kika Kogyo Co., Ltd.) for 10 minutes at a rotation speed of 8,000 rpm. Subsequently, the resultant dispersion was heated to 99° C. and subjected to emulsification with circulation by means of a homogenizer (Type 15-M-8PA, manufactured by Gaulin Company) under pressurization conditions of about 45 MPa. This dispersion treatment was conducted to a volume-average particle diameter of 240 nm while measuring the volume-average particle diameter with UPA-EX. Thus, a silicone wax dispersion T2 (emulsion solid concentration=27.4% by mass) was produced.

Preparation of Primary-Polymer-Particle Dispersion T1

Into a reactor (capacity, 21 L; inner diameter, 250 mm; height, 420 mm) equipped with a stirrer (three blades), heating/cooling device, condenser, and raw material/aid feeder were introduced 35.6 parts (712.12 g) of the wax/long-chain polymerizable monomer dispersion T1 and 259 parts of desalted water. The contents were heated to 90° C. in a nitrogen stream with stirring at a rotation speed of 103 rpm. Thereafter, a mixture of the following monomers and the following aqueous emulsifier solution was added thereto over a period of 5 hours from polymerization initiation. The time at which the mixture of the monomers and the aqueous emulsifier solution began to be added dropwise was taken as the initiation of polymerization. After 30 minutes had passed since the polymerization initiation, the following aqueous initiator solution was added over 4.5 hours. Furthermore, after 5 hours had passed since the polymerization initiation, the following additional aqueous initiator solution was added over 2 hours. Thereafter, the reaction mixture was kept being stirred at the rotation speed of 103 rpm and internal temperature of 90° C. for 1 hour.

| [Monomers] | |
|---|---|
| Styrene | 76.8 parts (1,535.0 g) |
| Butyl acrylate | 23.2 parts |
| Acrylic acid | 1.5 parts |
| Trichlorobromomethane | 1.0 part |
| Hexanediol diacrylate | 0.7 parts |
| [Aqueous Emulsifier Solution] | |
| 20% aqueous DBS solution | 1.0 part |
| Desalted water | 67.1 parts |
| [Aqueous Initiator Solution] | |
| 8% aqueous hydrogen peroxide solution | 15.5 parts |
| 8% aqueous L(+)-ascorbic acid solution | 15.5 parts |
| [Additional Aqueous Initiator Solution] | |
| 8% aqueous L(+)-ascorbic acid solution | 14.2 parts |

After completion of the polymerization reaction, the reaction mixture was cooled. Thus, a milk-white primary-polymer-particle dispersion T1 was obtained. This dispersion had a volume-average particle diameter as determined with UPA-EX of 280 nm and a solid concentration of 21.1% by mass.

Preparation of Primary-Polymer-Particle Dispersion T2

Into a reactor (capacity, 21 L; inner diameter, 250 mm; height, 420 mm) equipped with a stirrer (three blades), heating/cooling device, condenser, and raw material/aid feeder were introduced 23.6 parts (472.3 g) of the silicone wax dispersion T2, 1.5 parts of 20% aqueous DBS solution, and 324 parts of desalted water. The contents were heated to 90° C. in a nitrogen stream. While the resultant mixture was being stirred at 103 rpm, 3.2 parts of 8% aqueous hydrogen peroxide solution and 3.2 parts of 8% aqueous L(+)-ascorbic acid solution were added thereto en bloc. After 5 minutes, a mixture of the following monomers and the following aqueous emulsifier solution was added thereto over a period of 5 hours from polymerization initiation (from the time when 5 minutes had passed since the en bloc addition of 3.2 parts of 8% aqueous hydrogen peroxide solution and 3.2 parts of 8% aqueous L(+)-ascorbic acid solution), and the following aqueous initiator solution was added over a period of 6 hours from the polymerization initiation. Thereafter, the reaction mixture was kept being stirred at the rotation speed of 103 rpm and internal temperature of 90° C. for 1 hour.

| [Monomers] | |
|---|---|
| Styrene | 92.5 parts (1,850.0 g) |
| Butyl acrylate | 7.5 parts |

-continued

| | |
|---|---|
| Acrylic acid | 1.5 parts |
| Trichlorobromomethane | 0.6 parts |
| [Aqueous Emulsifier Solution] | |
| 20% aqueous DBS solution | 1.5 parts |
| Desalted water | 66.2 parts |
| [Aqueous Initiator Solution] | |
| 8% aqueous hydrogen peroxide solution | 18.9 parts |
| 8% aqueous L(+)-ascorbic acid solution | 18.9 parts |

After completion of the polymerization reaction, the reaction mixture was cooled. Thus, a milk-white primary-polymer-particle dispersion T2 was obtained. This dispersion had a volume-average particle diameter as determined with UPA-EX of 290 nm and a solid concentration of 19.0% by mass.

Preparation of Colorant Dispersion T

Into a vessel having a capacity of 300 L and equipped with a stirrer (propeller blades) were introduced 20 parts (40 kg) of a carbon black produced by the furnace process which had a toluene-extract ultraviolet absorbance of 0.02 and a true density of 1.8 g/cm$^3$ (Mitsubishi Carbon Black MA100S, manufactured by Mitsubishi Chemical Corp.), 1 part of 20% aqueous DBS solution, 4 parts of a nonionic surfactant (Emulgen 120, manufactured by Kao Corp.), and 75 parts of ion-exchanged water having an electrical conductivity of 2 μS/cm. The carbon black was preliminarily dispersed to obtain a pigment premix liquid. The conductivity was measured with a conductivity meter (Personal SC Meter Model SC72 and detector SC72SN-11, both manufactured by Yokogawa Electric Crop.). The carbon black in the dispersion obtained by the premixing had a 50% volume-cumulative diameter (Dv50) of about 90 μm. The premix liquid was fed as a raw slurry to a wet bead mill and subjected to a dispersion treatment by a one-through operation. In the mill, the stator had an inner diameter of 75 mm, the separator had a diameter of 60 mm, and the separator-to-disk distance was 15 mm. As a dispersing medium, use was made of zirconia beads having a diameter of about 50 μm (true density, 6.0 g/cm$^3$). The stator had an effective capacity of about 0.5 L, and the medium was charged in such an amount as to occupy a volume of 0.35 L. The degree of medium packing was hence 70%. The rotation speed of the rotor was kept constant (rotor periphery speed, about 11 m/sec), and the premix slurry was continuously fed through the feed opening with a non-pulsating constant-delivery pump at a feed rate of about 50 L/hr and continuously discharged through the discharge opening. Thus, a black colorant dispersion T was obtained. This dispersion had a volume-average particle diameter as determined with UPA-EX of 150 nm and a solid concentration of 24.2% by mass.

Production of Base Particles for Development T

Using the following ingredients, base particles for development T were produced by the following procedure.

Primary-polymer-particle dispersion T1
95 parts on solid basis (998.2 g on solid basis)
Primary-polymer-particle dispersion T2
5 parts on solid basis
Colorant dispersion T
6 parts in terms of solid colorant amount
20% aqueous DBS solution
0.1 part on solid basis The primary-polymer-particle dispersion T1 and 20% aqueous DBS solution were introduced into a mixing vessel (capacity, 12 L; inner diameter, 208 mm; height, 355 mm) equipped with a stirrer (double-helical blade), heating/cooling device, condenser, and raw material/aid feeder. The contents were evenly mixed at 40 rpm for 5 minutes at an internal temperature of 12° C. Subsequently, the stirring rotation speed was elevated to 250 rpm, and a 5% aqueous solution of ferrous sulfate was added thereto over 5 minutes in an amount of 0.52 parts in terms of $FeSO_4.7H_2O$ amount at an internal temperature of 12° C. Thereafter, the colorant dispersion T was added over 5 minutes, and the contents were evenly mixed at an internal temperature of 12° C. while keeping the rotation speed of 250 rpm. Furthermore, 0.5% aqueous aluminum sulfate solution was added dropwise (in an amount of 0.10 part in terms of solid amount based on solid resin amount) under the same conditions. Thereafter, while the rotation speed was kept unchanged at 250 rpm, the internal temperature was elevated to 53° C. over 75 minutes and then elevated to 56° C. over 170 minutes. The resultant dispersion was examined for particle diameter with a precision particle size distribution analyzer (Multisizer III, manufactured by Beckman Coulter Inc.; hereinafter suitably abbreviated to "Multisizer") regulated so as to have an aperture diameter of 100 μm. As a result, the dispersion was found to have a 50% volume diameter of 6.7 μm.

Thereafter, the primary-polymer-particle dispersion T2 was added over 3 minutes while maintaining the rotation speed of 250 rpm, and the resultant mixture was held under the same conditions for 60 minutes. The rotation speed was lowered to 168 rpm. Immediately thereafter, 20% aqueous DBS solution (6 parts in terms of solid amount) was added thereto over 10 minutes. Thereafter, the mixture was heated to 90° C. over 30 minutes and held for 60 minutes while maintaining the rotation speed of 168 rpm. The mixture was then cooled to 30° C. over 20 minutes. The slurry obtained was discharged and subjected to suction filtration through a filter paper No. 5C (manufactured by Toyo Roshi Kaisha, Ltd.) using an aspirator. The cake which remained on the filter paper was transferred to a stainless-steel vessel having a capacity of 10 L (L) and equipped with a stirrer (propeller blades). Eight kilograms of ion-exchanged water having an electrical conductivity of 1 μS/cm was added thereto. The resultant mixture was stirred at 50 rpm to thereby evenly disperse the particles and was then kept being stirred for 30 minutes. Thereafter, the dispersion was subjected again to suction filtration through a filter paper No. 5C (manufactured by Toyo Roshi Kaisha, Ltd.) using an aspirator. The solid matter which remained on the filter paper was transferred again to a vessel having a capacity of 10 L which was equipped with a stirrer (propeller blades) and contained 8 kg of ion-exchanged water having an electrical conductivity of 1 μS/cm. The resultant mixture was stirred at 50 rpm to thereby evenly disperse the particles and was then kept being stirred for 30 minutes. This step was repeated five times. As a result, the filtrate finally obtained had an electrical conductivity of 2 μS/cm. The conductivity was measured with a conductivity meter (Personal SC Meter Model SC72 and detector SC72SN-11, both manufactured by Yokogawa Electric Corp.). The cake thus obtained was spread all over the bottom of a stainless-steel vat in a thickness of about 20 mm and dried for 48 hours in an air-circulating drying oven set at 40° C. Thus, base particles for development T were obtained.

Production of Toner for Development TA

A hundred parts (1,000 g) of the base particles for development T were introduced into a Henschel mixer having a capacity of 10 L (diameter, 230 mm; height, 240 mm) and equipped with a stirrer (Z/A0 blade) and a deflector extending from an upper part perpendicularly to the wall surface. Subsequently, 0.5 parts of fine silica particles having a volume-average primary-particle diameter of 0.04 μm and hydrophobized with a silicone oil and 2.0 parts of fine silica particles having a volume-average primary-particle diameter of 0.012 μm and hydrophobized with a silicone oil were added thereto. The contents were stirred/mixed at 3,000 rpm for 10 minutes and then filtered through a 150-mesh sieve to thereby obtain a toner for development TA. The toner for development TA had a volume-average particle diameter and a Dv/Dn, both determined with Multisizer II, of 7.05 μm and 1.14, respectively, and had an average degree of circularity, as determined with FPIA2000, of 0.963.

(Production of Toner for Development, 2)

Production of Toner for Development TB

The same procedure as in "Production of Toner for Development, 1" was conducted, except that the mixture obtained after addition of the aqueous DBS solution in the production of base particles for development T was "heated to 90° C. and held for 180 minutes" instead of "heated to 90° C. and held for 60 minutes". Thus, a toner for development TB was obtained. This toner had an average degree of circularity, as determined with FPIA2000, of 0.981.

Examples 1B-1 to 1B-3 and Comparative Examples 1B-1 to 1B-3

Examples of the first mode of the invention are shown below.

Example 1B-1

The electrophotographic photoreceptor E7 produced in Production Example 7 and the toner for development TA were incorporated respectively into a black drum cartridge and a black toner cartridge both for commercial tandem type LED color printer MICROLINE Pro 9800PS-E (manufactured by Oki Data Corp.), which was capable of A3 printing, and these cartridges were mounted on the printer. This printer was used to print of a gradation image (a test chart provided by The Imaging Society of Japan) on 10,000 sheets. Thereafter, a white-background image and a gradation image (a test chart provided by The Imaging Society of Japan) were printed, and the white-background image and the gradation image were evaluated for fogging and dot skipping, respectively. The results thereof are shown in Table 2. The specifications of MICROLINE Pro 9800PS-E include the following.

Four-cartridge tandem; color, 36 ppm; monochrome, 40 ppm

Resolution of electrostatic latent image: 1,200 dpi

Contact roller charging (DC voltage application)

LED exposure

With erase light

The value of fogging was determined in the following manner. A whiteness meter was regulated so that a standard sample had a whiteness of 94.4. This whiteness meter was used to measure the whiteness of a sheet of paper which had not been printed. Signals for printing in white throughout were inputted to the laser printer to thereby print the same paper. Thereafter, this paper was examined for whiteness again to determine the difference in whiteness between the unprinted state and the printed state and thereby determine the value of fogging. When the value of fogging is large, this means that the printed paper has many minute black spots and is blackish, i.e., the printed paper has poor image quality. The gradation image was evaluated in terms of the minimum standard density at which printing was possible without causing dot skipping. The density at which printing was possible without causing dot skipping was referred to as usable density. The smaller the value of this usable density, the better the image is and the lower the density of image areas which were capable of being formed.

At the time when the 10,000-sheet printing was completed, thin-line reproducibility was evaluated subsequently to the evaluation of fogging and usable density. First, exposure was conducted so as to result in a latent image having a line width of 0.20 mm and a fixed image was obtained therefrom as a test sample. With respect to positions where line widths were to be measured, since the thin-line toner image had an outline rugged in the width direction, the width of a mean image obtained by leveling the rugged outline was measured. Thin-line reproducibility was evaluated by calculating the ratio of the measured value of line width to the lien width of the latent image (0.20 mm) (line width ratio).

Criteria for evaluating thin-line reproducibility are shown below.

The ratio of the measured value of line width to the line width of the latent image (line width ratio) is A: below 1.10, B: 1.10-1.15, excluding 1.15, C: 1.15-1.20, excluding 1.20, D: 1.20-1.25, excluding 1.25, E: 1.25-1.30, excluding 1.30, F: 1.30 or higher.

Example 1B-2

Image evaluation was conducted in the same manner as in Example 1B-1, except that the electrophotographic photoreceptor/toner combination shown in Table 2 was used. The results obtained are shown in Table 2.

Example 1B-3

The electrophotographic photoreceptor E7 was mounted in a black drum cartridge for commercial color printer MICROLINE 3050c (manufactured by Oki Data Corp.), and this cartridge was mounted on the printer. As a toner was used a commercial toner for the printer which had been produced by the melt kneading pulverization method. Image evaluation was conducted in the same manner as in Example 1B-1. The results obtained are shown in Table 2. The toner had an average degree of circularity of 0.935.

Color Printer MICROLINE 3050c

Four-cartridge tandem; color, 21 ppm; monochrome, 26 ppm

Resolution of electrostatic latent image: 1,200 dpi

LED exposure

Comparative Example 1B-1

Image evaluation was conducted in the same manner as in Example 1B-1, except that the electrophotographic photoreceptor/toner combination shown in Table 2 was used. The results obtained are shown in Table 2.

Comparative Example 1B-2

Image evaluation was conducted in the same manner as in Example 1B-1, except that the electrophotographic photoreceptor/toner combination shown in Table 2 was used. The results obtained are shown in Table 2.

Comparative Example 1B-3

Image evaluation was conducted in the same manner as in Example 1B-3, except that the electrophotographic photoreceptor E7 was replaced by the electrophotographic photoreceptor P7. The results obtained are shown in Table 2.

TABLE 2

| | Photo-receptor | Toner | Toner Production process | Resolution | Degree of circularity of toner | Fogging | Usable density | Thin-line reproducibility |
|---|---|---|---|---|---|---|---|---|
| Example 1B-1 | E7 | toner for development TA | emulsification aggregation method | 1200 dpi | 0.963 | 1.1 | 0.07 | A |
| Comparative Example 1B-1 | P7 | toner for development TA | emulsification aggregation method | 1200 dpi | 0.963 | 1.2 | 0.10 | B |
| Example 1B-2 | E7 | toner for development TB | emulsification aggregation method | 1200 dpi | 0.981 | 1.2 | 0.09 | A |
| Comparative Example 1B-2 | P7 | toner for development TB | emulsification aggregation method | 1200 dpi | 0.981 | 1.3 | 0.11 | C |
| Example 1B-3 | E7 | commercial toner | melt kneading pulverization method | 1200 dpi | 0.935 | 1.6 | 0.15 | C |
| Comparative Example 1B-3 | P7 | commercial toner | melt kneading pulverization method | 1200 dpi | 0.935 | 1.8 | 0.17 | E |

Table 2 shows the following. Example 1B-1, in which the photoreceptor E7 was used, gave better results concerning all of fogging, usable density, and thin-line reproducibility than Comparative Example 1B-1, in which photoreceptor P7 was used. Likewise, Example 1B-2, in which the photoreceptor E7 was used, gave better results concerning all of fogging, usable density, and thin-line reproducibility than Comparative Example 1B-2, in which the photoreceptor P7 was used. Example 1B-3, in which the photoreceptor E7 was used, gave better results concerning all of fogging, usable density, and thin-line reproducibility than Comparative Example 1B-3, in which the photoreceptor P7 was used.

Examples 2B-1 to 2B-3 and Comparative Examples 2B-1 to 2B-5

Examples of the second mode of the invention are shown below.

Example 2B-1

The electrophotographic photoreceptor E7 produced in Production Example 7 and the toner for development TA were incorporated respectively into a black drum cartridge and a black toner cartridge both for commercial tandem type LED color printer MICROLINE Pro 9800PS-E (manufactured by Oki Data Corp.), which was capable of A3 printing, and these cartridges were mounted on the printer. This printer was used to print of a gradation image (a test chart provided by The Imaging Society of Japan) on 10,000 sheets. Thereafter, a white-background image and a gradation image (a test chart provided by The Imaging Society of Japan) were printed, and the white-background image and the gradation image were evaluated for fogging and dot skipping, respectively. The results thereof are shown in Table 2. The specifications of MICROLINE Pro 9800PS-E include the following.

Four-cartridge tandem; color, 36 ppm; monochrome, 40 ppm

Resolution of electrostatic latent image: 1,200 dpi

Contact roller charging (DC voltage application)

LED exposure

With erase light

The value of fogging was determined in the following manner. A whiteness meter was regulated so that a standard sample had a whiteness of 94.4. This whiteness meter was used to measure the whiteness of a sheet of paper which had not been printed. Signals for printing in white throughout were inputted to the laser printer to thereby print the same paper. Thereafter, this paper was examined for whiteness again to determine the difference in whiteness between the unprinted state and the printed state and thereby determine the value of fogging. When the value of fogging is large, this means that the printed paper has many minute black spots and is blackish, i.e., the printed paper has poor image quality. The gradation image was evaluated in terms of the minimum standard density at which printing was possible without causing dot skipping. The density at which printing was possible without causing dot skipping was referred to as usable density. The smaller the value of this usable density, the better the image is and the lower the density of image areas which were capable of being formed.

At the time when the 10,000-sheet printing was completed, thin-line reproducibility was evaluated subsequently to the evaluation of fogging and usable density. First, exposure was conducted so as to result in a latent image having a line width of 0.20 mm and a fixed image was obtained therefrom as a test sample. With respect to positions where line widths were to be measured, since the thin-line toner image had an outline rugged in the width direction, the width of a mean image obtained by leveling the rugged outline was measured. Thin-line reproducibility was evaluated by calculating the ratio of the measured value of line width to the lien width of the latent image (0.20 mm) (line width ratio).

Criteria for evaluating thin-line reproducibility are shown below.

The ratio of the measured value of line width to the line width of the latent image (line width ratio) is A: below 1.10, B: 1.10-1.15, excluding 1.15, C: 1.15-1.20, excluding 1.20, D: 1.20-1.25, excluding 1.25, E: 1.25-1.30, excluding 1.30, F: 1.30 or higher.

Example 2B-2

Image evaluation was conducted in the same manner as in Example 2B-1, except that the electrophotographic photoreceptor/toner combination shown in Table 3 was used. The results obtained are shown in Table 3.

Example 2B-3

The electrophotographic photoreceptor E7 was mounted in a black drum cartridge for commercial color printer MICROLINE 3050c (manufactured by Oki Data Corp.), and this cartridge was mounted on the printer. As a toner was used a commercial toner for the printer which had been produced by the melt kneading pulverization method. Image evaluation was conducted in the same manner as in Example 2B-1. The results obtained are shown in Table 3. The toner had an average degree of circularity of 0.935.

Color Printer MICROLINE 3050c

Four-cartridge tandem; color, 21 ppm; monochrome, 26 ppm

Resolution of electrostatic latent image: 1,200 dpi

LED exposure

Comparative Example 2B-1

The electrophotographic photoreceptor E7 was mounted in the black drum cartridge of commercial color printer MICROLINE 3010c (manufactured by Oki Data Corp.). As a toner was used a commercial toner for the printer which had been produced by the melt kneading pulverization method. Image evaluation (fogging, usable density, and thin-line reproducibility) was conducted in the same manner as in Example 2B-1. The results obtained are shown in Table 3. The toner had an average degree of circularity of 0.933.

Color Printer MICROLINE 3010c

Four-cartridge tandem; color, 10 ppm; monochrome, 16 ppm

Resolution of electrostatic latent image: 600 dpi

LED exposure

With erase light

Comparative Example 2B-2

Image evaluation was conducted in the same manner as in Example 2B-1, except that the electrophotographic photoreceptor/toner combination shown in Table 3 was used. The results obtained are shown in Table 3.

Comparative Example 2B-3

Image evaluation was conducted in the same manner as in Example 2B-1, except that the electrophotographic photoreceptor/toner combination shown in Table 3 was used. The results obtained are shown in Table 3.

Comparative Example 2B-4

Image evaluation was conducted in the same manner as in Comparative Example 2B-1, except that the electrophotographic photoreceptor E7 was replaced by the electrophotographic photoreceptor P7. The results obtained are shown in Table 3.

Comparative Example 2B-5

Image evaluation was conducted in the same manner as in Comparative Example 2B-1, except that the electrophotographic photoreceptor P7 was used in place of the electrophotographic photoreceptor E7. The results obtained are shown in Table 3.

TABLE 3

| | Photo-receptor | Toner | Toner Production process | Resolution | Degree of circularity of toner | Fogging | Usable density | Thin-line reproducibility |
|---|---|---|---|---|---|---|---|---|
| Example 2B-1 | E7 | toner for development TA | emulsification aggregation method | 1200 dpi | 0.963 | 1.1 | 0.07 | A |
| Comparative Example 2B-2 | P7 | toner for development TA | emulsification aggregation method | 1200 dpi | 0.963 | 1.2 | 0.10 | B |
| Example 2B-2 | E7 | toner for development TB | emulsification aggregation method | 1200 dpi | 0.981 | 1.2 | 0.09 | A |
| Comparative Example 2B-3 | P7 | toner for development TB | emulsification aggregation method | 1200 dpi | 0.981 | 1.3 | 0.11 | C |
| Example 2B-3 | E7 | commercial toner | melt kneading pulverization method | 1200 dpi | 0.935 | 1.6 | 0.15 | C |
| Comparative Example 2B-4 | P7 | commercial toner | melt kneading pulverization method | 1200 dpi | 0.935 | 1.8 | 0.17 | E |
| Comparative Example 2B-1 | E7 | commercial toner | melt kneading pulverization method | 600 dpi | 0.933 | 1.7 | 0.16 | F |
| Comparative Example 2B-5 | P7 | commercial toner | melt kneading pulverization method | 600 dpi | 0.933 | 1.7 | 0.17 | F |

Example 2B-1, in which the photoreceptor E7 was used and the resolution was within the range according to the invention, gave better results concerning all of fogging, usable density, and thin-line reproducibility than Comparative Example 2B-2, in which the photoreceptor P7 was used although the resolution was within the range according to the invention. It was found from a comparison between Example 2B-2 and Comparative Example 2B-3 and a comparison between Example 2B-3 and Comparative Example 2B-4 that these Examples also gave the same results.

Furthermore, Example 2B-3, in which the photoreceptor E7 was used and the resolution was within the range according to the invention, gave better results concerning all of fogging, usable density, and thin-line reproducibility than Comparative Example 2B-4, in which the photoreceptor P7 was used although the resolution satisfied the range according to the invention, and than Comparative Example 2B-1, in which the resolution was outside the range according to the invention although the photoreceptor E7 was used.

It was found from a comparison between Comparative Example 2B-1 and Comparative Example 2B-5 that when the resolution is low, use of the photoreceptor E7 brings about only a limited improvement in effect.

Examples 3B-1 to 3B-2 and Comparative Examples 3B-1 to 3B-6

Examples of the third mode of the invention are shown below.

Example 3B-1

The electrophotographic photoreceptor E7 produced in Production Example 7 and the toner for development TA were incorporated respectively into a black drum cartridge and a black toner cartridge both for commercial tandem type LED color printer MICROLINE Pro 9800PS-E (manufactured by Oki Data Corp.), which was capable of A3 printing, and these cartridges were mounted on the printer. This printer was used to print of a gradation image (a test chart provided by The Imaging Society of Japan) on 10,000 sheets. Thereafter, a white-background image and a gradation image (a test chart provided by The Imaging Society of Japan) were printed, and the white-background image and the gradation image were evaluated for fogging and dot skipping, respectively. The results thereof are shown in Table 4. The specifications of MICROLINE Pro 9800PS-E include the following.

Four-cartridge tandem; color, 36 ppm; monochrome, 40 ppm

Resolution of electrostatic latent image: 1,200 dpi

Contact roller charging (DC voltage application)

LED exposure

With erase light

The value of fogging was determined in the following manner. A whiteness meter was regulated so that a standard sample had a whiteness of 94.4. This whiteness meter was used to measure the whiteness of a sheet of paper which had not been printed. Signals for printing in white throughout were inputted to the laser printer to thereby print the same paper. Thereafter, this paper was examined for whiteness again to determine the difference in whiteness between the unprinted state and the printed state and thereby determine the value of fogging. When the value of fogging is large, this means that the printed paper has many minute black spots and is blackish, i.e., the printed paper has poor image quality. The gradation image was evaluated in terms of the minimum standard density at which printing was possible without causing dot skipping. The density at which printing was possible without causing dot skipping was referred to as usable density. The smaller the value of this usable density, the better the image is and the lower the density of image areas which were capable of being formed.

At the time when the 10,000-sheet printing was completed, thin-line reproducibility was evaluated subsequently to the evaluation of fogging and usable density. First, exposure was conducted so as to result in a latent image having a line width of 0.20 mm and a fixed image was obtained therefrom as a test sample. With respect to positions where line widths were to be measured, since the thin-line toner image had an outline rugged in the width direction, the width of a mean image obtained by leveling the rugged outline was measured. Thin-line reproducibility was evaluated by calculating the ratio of the measured value of line width to the lien width of the latent image (0.20 mm) (line width ratio).

Criteria for evaluating thin-line reproducibility are shown below.

The ratio of the measured value of line width to the line width of the latent image (line width ratio) is A: below 1.10, B: 1.10-1.15, excluding 1.15, C: 1.15-1.20, excluding 1.20, D: 1.20-1.25, excluding 1.25, E: 1.25-1.30, excluding 1.30, F: 1.30 or higher.

Example 3B-2

Image evaluation was conducted in the same manner as in Example 3B-1, except that the electrophotographic photoreceptor/toner combination shown in Table 4 was used. The results obtained are shown in Table 4.

Comparative Example 3B-1

The electrophotographic photoreceptor E7 was mounted in a black drum cartridge for commercial color printer MICROLINE 3050c (manufactured by Oki Data Corp.), and this cartridge was mounted on the printer. As a toner was used a commercial toner for the printer which had been produced by the melt kneading pulverization method. Image evaluation was conducted in the same manner as in Example 3B-1. The results obtained are shown in Table 4. The toner had an average degree of circularity of 0.935.

Color Printer MICROLINE 3050c

Four-cartridge tandem; color, 21 ppm; monochrome, 26 ppm

Resolution of electrostatic latent image: 1,200 dpi

LED exposure

Comparative Example 3B-2

The electrophotographic photoreceptor E7 was mounted in the black drum cartridge of commercial color printer MICROLINE 3010c (manufactured by Oki Data Corp.). As a toner was used a commercial toner for the printer which had been produced by the melt kneading pulverization method. Image evaluation (fogging, usable density, and thin-line reproducibility) was conducted in the same manner as in Example 3B-1. The results obtained are shown in Table 4. The toner had an average degree of circularity of 0.933.

Color Printer MICROLINE 3010c

Four-cartridge tandem; color, 10 ppm; monochrome, 16 ppm

Resolution of electrostatic latent image: 600 dpi

LED exposure

With erase light

Comparative Example 3B-3

Image evaluation was conducted in the same manner as in Example 3B-1, except that the electrophotographic photoreceptor/toner combination shown in Table 4 was used. The results obtained are shown in Table 4.

Comparative Example 3B-4

Image evaluation was conducted in the same manner as in Example 3B-1, except that the electrophotographic photoreceptor/toner combination shown in Table 4 was used. The results obtained are shown in Table 4.

Comparative Example 3B-5

Image evaluation was conducted in the same manner as in Comparative Example 3B-1, except that the electrophotographic photoreceptor E7 was replaced by the electrophotographic photoreceptor P7. The results obtained are shown in Table 4.

Comparative Example 3B-6

Image evaluation was conducted in the same manner as in Comparative Example 3B-2, except that the electrophotographic photoreceptor P7 was used in place of the electrophotographic photoreceptor E7. The results obtained are shown in Table 4.

TABLE 4

| | Photo-receptor | Toner | Toner Production process | Resolution | Degree of circularity of toner | Fogging | Usable density | Thin-line reproducibility |
|---|---|---|---|---|---|---|---|---|
| Example 3B-1 | E7 | toner for development TA | emulsification aggregation method | 1200 dpi | 0.963 | 1.1 | 0.07 | A |
| Example 3B-2 | E7 | toner for development TB | emulsification aggregation method | 1200 dpi | 0.981 | 1.2 | 0.09 | A |
| Comparative Example 3B-1 | E7 | commercial toner | melt kneading pulverization method | 1200 dpi | 0.935 | 1.6 | 0.15 | C |
| Comparative Example 3B-2 | E7 | commercial toner | melt kneading pulverization method | 600 dpi | 0.933 | 1.7 | 0.16 | F |
| Comparative Example 3B-3 | P7 | toner for development TA | emulsification aggregation method | 1200 dpi | 0.963 | 1.2 | 0.10 | B |
| Comparative Example 3B-4 | P7 | toner for development TB | emulsification aggregation method | 1200 dpi | 0.981 | 1.3 | 0.11 | C |
| Comparative Example 3B-5 | P7 | commercial toner | melt kneading pulverization method | 1200 dpi | 0.935 | 1.8 | 0.17 | E |
| Comparative Example 3B-6 | P7 | commercial toner | melt kneading pulverization method | 600 dpi | 0.933 | 1.7 | 0.17 | F |

Table 4 shows the following. Examples 3B-1 and 3B-2, in which the photoreceptor E7 was used and the toner had a degree of circularity satisfying the range of 0.94-1.00, gave better results concerning all of fogging, usable density, and thin-line reproducibility than Comparative Examples 3B-1 to 3B-4, which did not satisfy either of the photoreceptor E7 and the degree of toner circularity, and than Comparative Examples 3B-5 and 3B-6, which satisfied neither of these.

Examples 4B-1 to 4B-3 and Comparative Examples 4B-1 to 4B-3

Examples of the fourth mode of the invention are shown below.

Example 4B-1

The electrophotographic photoreceptor E7 produced in Production Example 7 and the toner for development TA were incorporated respectively into a black drum cartridge and a black toner cartridge both for commercial tandem type LED color printer MICROLINE Pro 9800PS-E (manufactured by Oki Data Corp.), which was capable of A3 printing, and these cartridges were mounted on the printer. This printer was used to print of a gradation image (a test chart provided by The Imaging Society of Japan) on 10,000 sheets. Thereafter, a white-background image and a gradation image (a test chart provided by The Imaging Society of Japan) were printed, and the white-background image and the gradation image were evaluated for fogging and dot skipping, respectively. The results thereof are shown in Table 5. The specifications of MICROLINE Pro 9800PS-E include the following.

Four-cartridge tandem; color, 36 ppm; monochrome, 40 ppm

Resolution of electrostatic latent image: 1,200 dpi

Contact roller charging (DC voltage application)

LED exposure

With erase light

The value of fogging was determined in the following manner. A whiteness meter was regulated so that a standard sample had a whiteness of 94.4. This whiteness meter was used to measure the whiteness of a sheet of paper which had not been printed. Signals for printing in white throughout were inputted to the laser printer to thereby print the same paper. Thereafter, this paper was examined for whiteness again to determine the difference in whiteness between the unprinted state and the printed state and thereby determine the value of fogging. When the value of fogging is large, this means that the printed paper has many minute black spots and is blackish, i.e., the printed paper has poor image quality. The gradation image was evaluated in terms of the minimum standard density at which printing was possible without causing dot skipping. The density at which printing was possible without causing dot skipping was referred to as usable density. The smaller the value of this usable density, the better the image is and the lower the density of image areas which were capable of being formed.

At the time when the 10,000-sheet printing was completed, thin-line reproducibility was evaluated subsequently to the evaluation of fogging and usable density. First, exposure was conducted so as to result in a latent image having a line width of 0.20 mm and a fixed image was obtained therefrom as a test sample. With respect to positions where line widths were to be measured, since the thin-line toner image had an outline rugged in the width direction, the width of a mean image obtained by leveling the rugged outline was measured. Thin-line reproducibility was evaluated by calculating the ratio of the measured value of line width to the lien width of the latent image (0.20 mm) (line width ratio).

Criteria for evaluating thin-line reproducibility are shown below.

The ratio of the measured value of line width to the line width of the latent image (line width ratio) is A: below 1.10, B: 1.10-1.15, excluding 1.15, C: 1.15-1.20, excluding 1.20, D: 1.20-1.25, excluding 1.25, E: 1.25-1.30, excluding 1.30, F: 1.30 or higher.

Example 4B-2

Image evaluation was conducted in the same manner as in Example 4B-1, except that the electrophotographic photoreceptor/toner combination shown in Table 5 was used. The results obtained are shown in Table 5.

Example 4B-3

The electrophotographic photoreceptor E7 was mounted in a black drum cartridge for commercial color printer MICRO- LINE 3050c (manufactured by Oki Data Corp.), and this cartridge was mounted on the printer. As a toner was used a commercial toner for the printer which had been produced by the melt kneading pulverization method. Image evaluation was conducted in the same manner as in Example 4B-1. The results obtained are shown in Table 5. The toner had an average degree of circularity of 0.935.

Color Printer MICROLINE 3050c

Four-cartridge tandem; color, 21 ppm; monochrome, 26 ppm

Resolution of electrostatic latent image: 1,200 dpi

LED exposure

Comparative Example 4B-1

Image evaluation was conducted in the same manner as in Example 4B-1, except that the electrophotographic photoreceptor/toner combination shown in Table 5 was used. The results obtained are shown in Table 5.

Comparative Example 4B-2

Image evaluation was conducted in the same manner as in Example 4B-1, except that the electrophotographic photoreceptor/toner combination shown in Table 5 was used. The results obtained are shown in Table 5.

Comparative Example 4B-3

Image evaluation was conducted in the same manner as in Example 4B-3, except that the electrophotographic photoreceptor E7 was replaced by the electrophotographic photoreceptor P7. The results obtained are shown in Table 5.

TABLE 5

| | Photo-receptor | Toner | Toner Production process | Resolution | Degree of circularity of toner | Fogging | Usable density | Thin-line reproducibility |
|---|---|---|---|---|---|---|---|---|
| Example 4B-1 | E7 | toner for development TA | emulsification aggregation method | 1200 dpi | 0.963 | 1.1 | 0.07 | A |
| Comparative Example 4B-1 | P7 | toner for development TA | emulsification aggregation method | 1200 dpi | 0.963 | 1.2 | 0.10 | B |
| Example 4B-2 | E7 | toner for development TB | emulsification aggregation method | 1200 dpi | 0.981 | 1.2 | 0.09 | A |
| Comparative Example 4B-2 | P7 | toner for development TB | emulsification aggregation method | 1200 dpi | 0.981 | 1.3 | 0.11 | C |
| Example 4B-3 | E7 | commercial toner | melt kneading pulverization method | 1200 dpi | 0.935 | 1.6 | 0.15 | C |
| Comparative Example 4B-3 | P7 | commercial toner | melt kneading pulverization method | 1200 dpi | 0.935 | 1.8 | 0.17 | E |

Table 5 shows the following. Example 4B-1, in which the photoreceptor E7 was used, gave better results concerning all of fogging, usable density, and thin-line reproducibility than Comparative Example 4B-1, in which photoreceptor P7 was used. Likewise, Example 4B-2, in which the photoreceptor E7 was used, gave better results concerning all of fogging, usable density, and thin-line reproducibility than Comparative Example 4B-2, in which the photoreceptor P7 was used. Example 4B-3, in which the photoreceptor E7 was used, gave better results concerning all of fogging, usable density, and thin-line reproducibility than Comparative Example 4B-3, in which the photoreceptor P7 was used.

It has become obvious from the results given above that use of the electrophotographic photoreceptors and image-forming apparatus of the invention enables high-resolution high-quality images to be stably formed even when the photoreceptors and the apparatus are repeatedly used over long.

The mechanism of this effect of the invention has not been elucidated. However, it is presumed that the uppermost layer of the electrophotographic photoreceptor has changed in property due to the addition thereto of the compound usable in the invention and has come into a state suitable for the development of high-resolution images. This state is presumed to produce an effect when high-resolution images are formed. It is thought that when a high-resolution electrostatic latent image is formed on the electrophotographic photoreceptor and developed, that effect renders a toner to adhere to the photoreceptor so as to faithfully develop the electrostatic latent image and enables the toner which has adhered to be transferred from the photoreceptor to a medium, e.g., paper.

While the invention has been described in detail and with reference to specific embodiments thereof, it will be apparent to one skilled in the art that various changes and modifications can be made therein without departing from the spirit and scope thereof. This application is based on a Japanese patent application filed on Jun. 28, 2007 (Application No. 2007-171305), the contents thereof being herein incorporated by reference.

INDUSTRIAL APPLICABILITY

According to the invention, an electrophotographic photoreceptor having a photosensitive layer containing a specific compound is used in an image-forming apparatus satisfying a specific requirement. Thus, an electrophotographic photoreceptor can be provided which has high sensitivity in a wide wavelength range and can stably form high-resolution high-quality images even when repeatedly used over long. Furthermore, by using the electrophotographic photoreceptor or by using an electrophotographic photoreceptor cartridge employing the electrophotographic photoreceptor, an image-forming apparatus can be provided in which suitable exposure is possible with various light sources for optical input and which can stably form high-resolution high-quality images even when repeatedly used over long.

The invention claimed is:

1. An electrophotographic photoreceptor an image-forming apparatus, comprising:

a charging unit which charges an electrophotographic photoreceptor;

an exposure unit which exposes the charged electrophotographic photoreceptor to light to form an electrostatic latent image on the electrophotographic photoreceptor; and a developing unit which develops the electrostatic latent image, wherein the electrophotographic photoreceptor comprises a conductive substrate and a photosensitive layer, the photosensitive layer comprises a compound of formula (1):

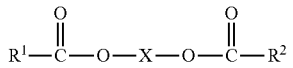

(1)

wherein $R^1$ and $R^2$ each independently represent an organic group having 30 carbon atoms or less and X represents a saturated hydrocarbon group having 3-30 carbon atoms, and the exposure unit comprises an LED.

2. An electrophotographic photoreceptor for an image-forming apparatus, comprising:

a charging unit which charges an electrophotographic photoreceptor;

an exposure unit which exposes the charged electrophotographic photoreceptor to light to form an electrostatic latent image on the electrophotographic photoreceptor; and a developing unit which develops the electrostatic latent image, wherein the electrophotographic photoreceptor comprises a conductive substrate and a photosensitive layer, the photosensitive layer comprises a compound of formula (1):

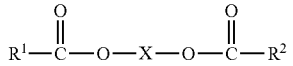

(1)

wherein $R^1$ and $R^2$ each independently represent an organic group having 30 carbon atoms or less and X represents a saturated hydrocarbon group having 3-30 carbon atoms and a resolution of the electrostatic latent image is 1,200 dpi or higher.

3. An electrophotographic photoreceptor for an image-forming apparatus, comprising:

a charging unit which charges an electrophotographic photoreceptor;

an exposure unit which exposes the charged electrophotographic photoreceptor to light to form an electrostatic latent image on the electrophotographic photoreceptor; and a developing unit which develops the electrostatic latent image with a toner, wherein the electrophotographic photoreceptor comprises a conductive substrate and a photosensitive layer, the photosensitive layer comprises a compound of formula (1):

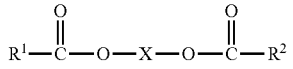

(1)

wherein $R^1$ and $R^2$ each independently represent an organic group having 30 carbon atoms or less and X represents a saturated hydrocarbon group having 3-30 carbon atoms and an average degree of circularity of the toner is from 0.94 to 1.00 as determined with a flow-type particle image analyzer.

4. An electrophotographic photoreceptor for a full-color tandem image-forming apparatus comprising:

a charging unit which charges an electrophotographic photoreceptor;

an exposure unit which exposes the charged electrophotographic photoreceptor to light to form an electrostatic latent image on the electrophotographic photoreceptor; and a developing unit which develops the electrostatic latent image, wherein the electrophotographic photoreceptor comprises a conductive substrate and a photosensitive layer, and the photosensitive layer comprises a compound of formula (1):

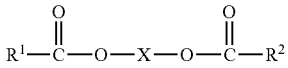

(1)

wherein $R^1$ and $R^2$ each independently represent an organic group having 30 carbon atoms or less and X represents a saturated hydrocarbon group having 3-30 carbon atoms.

5. The electrophotographic photoreceptor according to any one of claim 1 to claim 4, wherein at least one of $R^1$, $R^2$, and X in formula (1) has a cyclic structure.

6. The electrophotographic photoreceptor according to any one of claim 1 to claim 4, wherein the photosensitive layer further comprises a hydrazone compound.

7. The electrophotographic photoreceptor according to any one of claim 1 to claim 4, wherein the photosensitive layer further comprises a a diamine compound.

8. The electrophotographic photoreceptor according to any one of claim 1 to claim 4, which comprises a polyamide resin.

9. The electrophotographic photoreceptor according to any one of claim 1 to claim 4, wherein the photosensitive layer further comprises a polyarylate resin.

10. The electrophotographic photoreceptor according to any one of claim 1 to claim 4, wherein the photosensitive layer further comprises a binder resin comprising a repeating structure of formula (2):

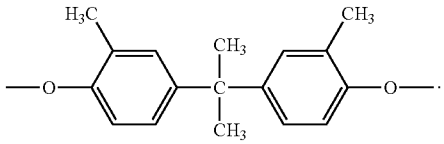

(2)

11. An electrophotographic photoreceptor cartridge comprising:

the electrophotographic photoreceptor according to any one of claim 1 to claim 4; and at least one selected from the group consisting of a charging unit which charges the electrophotographic photoreceptor, an exposure unit which exposes the charged electrophotographic photoreceptor to light to form an electrostatic latent image on the electrophotographic photoreceptor, a developing unit which develops the electrostatic latent image, and a cleaning unit which cleans the surface of the electrophotographic photoreceptor.

12. An image-forming apparatus comprising:

a charging unit which charges an electrophotographic photoreceptor having a photosensitive layer;

an exposure unit which exposes the charged electrophotographic photoreceptor to light to form an electrostatic latent image on the electrophotographic photoreceptor; and a developing unit which develops the electrostatic latent image, wherein the photosensitive layer comprises a compound of formula (1):

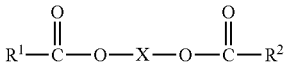

(1)

wherein $R^1$ and $R^2$ each independently represent an organic group having 30 carbon atoms or less and X represents a saturated hydrocarbon group having 3-30 carbon atoms and the exposure unit comprises an LED.

13. An image-forming apparatus comprising:

a charging unit which charges an electrophotographic photoreceptor having a photosensitive layer;

an exposure unit which exposes the charged electrophotographic photoreceptor to light to form an electrostatic latent image on the electrophotographic photoreceptor; and a developing unit which develops the electrostatic latent image, wherein the photosensitive layer comprises a compound of formula (1):

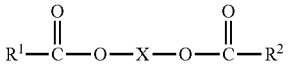

(1)

wherein $R^1$ and $R^2$ each independently represent an organic group having 30 carbon atoms or less and X represents a saturated hydrocarbon group having 3-30 carbon atoms and a resolution of the electrostatic latent image is 1,200 dpi or higher.

14. An image-forming apparatus comprising:

a charging unit which charges an electrophotographic photoreceptor having a photosensitive layer;

an exposure unit which exposes the charged electrophotographic photoreceptor to light to form an electrostatic latent image on the electrophotographic photoreceptor; and a developing unit which develops the electrostatic latent image with a toner, wherein the photosensitive layer comprises a compound of formula (1):

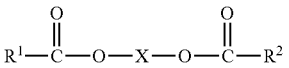

(1)

wherein $R^1$ and $R^2$ each independently represent an organic group having 30 carbon atoms or less and X represents a saturated hydrocarbon group having 3-30 carbon atoms and an average degree of circularity of the toner is from 0.94 to 1.00 as determined with a flow-type particle image analyzer.

15. A full-color tandem image-forming apparatus comprising:

a charging unit which charges an electrophotographic photoreceptor having a photosensitive layer;

an exposure unit which exposes the charged electrophotographic photoreceptor to light to form an electrostatic latent image on the electrophotographic photoreceptor; and a developing unit which develops the electrostatic latent image, wherein the photosensitive layer comprises a compound of formula (1):

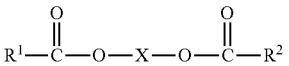

(1)

wherein $R^1$ and $R^2$ each independently represent an organic group having 30 carbon atoms or less and X represents a saturated hydrocarbon group having 3-30 carbon atoms.

* * * * *